US009134046B2

(12) United States Patent
Xu

(10) Patent No.: US 9,134,046 B2
(45) Date of Patent: Sep. 15, 2015

(54) PULSE TUBE REFRIGERATOR AND REGENERATIVE REFRIGERATOR

(71) Applicant: SUMITOMO HEAVY INDUSTRIES, LTD., Tokyo (JP)

(72) Inventor: Mingyao Xu, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 307 days.

(21) Appl. No.: 13/935,760

(22) Filed: Jul. 5, 2013

(65) Prior Publication Data

US 2013/0291565 A1 Nov. 7, 2013

Related U.S. Application Data

(62) Division of application No. 12/323,516, filed on Nov. 26, 2008, now Pat. No. 8,499,568.

(30) Foreign Application Priority Data

Mar. 25, 2008 (JP) ..... 2008-078549
Jun. 4, 2008 (JP) ..... 2008-147476

(51) Int. Cl.
*F25B 9/00* (2006.01)
*F25B 9/14* (2006.01)

(52) U.S. Cl.
CPC . *F25B 9/00* (2013.01); *F25B 9/145* (2013.01); *F25B 2309/1408* (2013.01); *F25B 2309/1413* (2013.01); *F25B 2309/1418* (2013.01); *F25B 2309/1421* (2013.01); *F25B 2309/14241* (2013.01)

(58) Field of Classification Search
CPC ..... F25B 9/00
See application file for complete search history.

(56) References Cited

U.S. PATENT DOCUMENTS 4,879,876 A * 11/1989 Robertson ..... 62/6
5,152,147 A 10/1992 Saho et al.
5,435,136 A * 7/1995 Ishizaki et al. ..... 60/517

(Continued)

FOREIGN PATENT DOCUMENTS

JP 2001-241793 9/2001
JP 2001-241794 9/2001

(Continued)

OTHER PUBLICATIONS

Japanese Office Action mailed Feb. 9, 2010 with partial English Translation.

(Continued)

*Primary Examiner* — Emmanuel Duke
(74) *Attorney, Agent, or Firm* — IPUSA, PLLC

(57) ABSTRACT

A pulse tube refrigerator includes a first pulse tube; a first regenerator connected to the first pulse tube; a compressor configured to compress the coolant gas; a first supply side valve; a first filter provided between a supply side of the first supply side valve and the high temperature end of the first regenerator; a first suction side valve connected to the first filter via a first joint point; a first self seal joint provided between the supply side of the compressor and a suction side of the first supply side valve; a second self seal joint provided between a supply side of the first suction side valve and the suction side of the compressor; and a third self seal joint provided between a first regenerator side of the first filter and the high temperature end of the first regenerator.

4 Claims, 28 Drawing Sheets

(56) References Cited

U.S. PATENT DOCUMENTS

| | | | | |
|---|---|---|---|---|
| 5,845,498 | A | 12/1998 | Matsui et al. | |
| 5,974,807 | A * | 11/1999 | Gao et al. | 62/6 |
| 6,256,998 | B1 * | 7/2001 | Gao | 62/6 |
| 6,536,218 | B1 | 3/2003 | Steinmeyer | |
| 6,629,418 | B1 * | 10/2003 | Gao et al. | 62/6 |
| 2001/0032469 | A1 * | 10/2001 | Zhu et al. | 62/6 |
| 2002/0066276 | A1 | 6/2002 | Kawano et al. | |
| 2005/0210889 | A1 * | 9/2005 | Arman et al. | 62/6 |
| 2007/0119189 | A1 | 5/2007 | Gao | |
| 2007/0157632 | A1 * | 7/2007 | Saito | 62/6 |
| 2011/0000226 | A1 | 1/2011 | Xu et al. | |

FOREIGN PATENT DOCUMENTS

| | | | | |
|---|---|---|---|---|
| JP | 2001241793 A * | 9/2001 | | F25B 9/00 |
| JP | 2002-228289 | 8/2002 | | |
| JP | 2002-349982 | 12/2002 | | |
| JP | 2003-507689 | 2/2003 | | |

OTHER PUBLICATIONS

Japanese Office Action mailed Oct. 5, 2010.

* cited by examiner

PULSE TUBE REFRIGERATOR AND REGENERATIVE REFRIGERATOR

CROSS-REFERENCE TO RELATED APPLICATIONS

This patent application is a divisional application of and claims the benefit of priority under 35 U.S.C. 120 to the patent application Ser. No. 12/323,516 filed on Nov. 26, 2008, which was based upon and claims the benefit of priority of Japanese Patent Application No. 2008-078549 filed on Mar. 25, 2008 and Japanese Patent Application No. 2008-147476 filed on Jun. 4, 2008 the entire contents of which are incorporated herein by reference.

BACKGROUND OF THE INVENTION

1. Field of the Invention

The present invention generally relates to pulse tube refrigerators and regenerative refrigerators. More specifically, the present invention relates to a pulse tube refrigerator and a regenerative refrigerator each having a filter configured to remove wear dust.

2. Description of the Related Art

In recent years, cryogenic refrigerators have been used for cooling superconducting magnets at cryogenic temperatures in systems having the superconducting magnets such as a MRI (magnetic resonance imaging) apparatus. For example, a GM (Gifford-McMahon) cryogenic refrigerator, a pulse tube refrigerator, or the like has been used as the cryogenic refrigerator. These are regenerative refrigerators wherein adiabatic expansion of coolant gas is performed and cooling generated at the adiabatic expansion is stored in the regenerator material so that refrigeration and cooling are performed.

The regenerative refrigerator includes an expander and a compressor. The expander has a regenerator configured to store the cooling generated at the time of the adiabatic expansion of the coolant gas. The compressor is configured to receive the coolant gas from the expander, compress the received coolant gas, and resupply the compressed coolant gas to the expander.

The compressor has pipes at a suction side and a supply side. The pipe at the suction side is configured to suction the received coolant gas. The pipe at the supply side is configured to supply the received and compressed coolant gas. The regenerator is in mutual communication with or is blocked off from communication with the supply side of the compressor.

A rotary valve is used to connected the generator in communication with the supply side supply side of the compressor. The rotary valve is periodically switched to open and block communication with the two pipes. The rotary valve includes a disk and a sealing member. The disk is rotatable and has a communicating hole for periodically switching a communicating state and a blocking state. The sealing member is fixed so as to receive the disk while the disk is slid.

On the other hand, due to sliding of the disk and the sealing member, the sealing member is worn so that wear dust is generated. Accordingly, if the pulse tube refrigerator is operated for a long time, the wear dust flows into the regenerator so that regenerator material becomes dirty and its capacity to be cooled is degraded. In this case, the regenerator material has to be exchanged. In addition, if the wear dust flows in the compressor, the compressing capacity of the compressor is degraded.

Accordingly, it is necessary to remove the wear dust generated by the rotary valve. A method for providing a filter between the rotary valve and the regenerator in order to remove the wear dust has been suggested. For example, Japanese Laid-Open Patent Application Publication No. 2001-241793 describes an example of a pulse tube refrigerator where filters are provided between the rotary valve and the regenerator and between the rotary valve and the pulse tube.

However, when the pulse tube refrigerator having the filters configured to remove the wear dust is operated, problems discussed below arise.

In the pulse tube refrigerator described in Japanese Laid-Open Patent Application Publication No. 2001-241793, while partition members are provided between the filter and the regenerator and between the filter and the pulse tube, it is not possible to easily separate the filter and the regenerator and the filter and the pulse tube while air tightness is secured. Accordingly, it takes a long time to perform a maintenance operation including a separation operation and an exchanging operation of a filter.

More specifically, the temperature of the entirety of the pulse tube refrigerator including the regenerator and the pulse tube should be increased to normal room temperature before the separation; the pulse tube refrigerator should be disassembled so that the filter is separated from the pulse tube refrigerator; a maintenance operation such as exchange of the separated filter should be applied; the filter where the maintenance operation is completed should be connected so that the pulse tube refrigerator is reassembled; and the insides of the regenerator and the pulse tube where air is mixed and pipes for connecting the regenerator and the pulse tube should be refilled with coolant gas such as helium gas.

In addition, in the pulse tube refrigerator described in Japanese Laid-Open Patent Application Publication No. 2001-241793, partition parts are not provided at the compressor side of the filter. Accordingly, it is not possible to easily separate the filter and the compressor while air tightness is secured. Hence, it takes time to perform the maintenance operation including the separation operation and the exchange operation of the filter.

More specifically, before separation is made between the filter and the compressor, the compressor should be separated, the filter should be exchanged, and the filter should be connected to the compressor. After that, the insides of the pipes at the supply side and the suction side of the compressor where the air is mixed should be refilled with the coolant gas such as helium gas.

In addition, even if the above-mentioned maintenance operation can be easily performed, the pulse tube refrigerator should be installed in the MRI apparatus. Accordingly, it is necessary to miniaturize the entirety of the pulse tube refrigerator including the valve unit and the expander.

SUMMARY OF THE INVENTION

Accordingly, embodiments of the present invention may provide a novel and useful pulse tube refrigerator and regenerative refrigerator solving one or more of the problems discussed above.

More specifically, the embodiments of the present invention may provide a refrigerator and a regenerative refrigerator where a maintenance operation of a filter configured to remove wear dust can be done without performing an operation for increasing the temperature of the refrigerator to a normal temperature and an operation for substituting gas inside the refrigerator.

One aspect of the embodiments of the present invention may be to provide a pulse tube refrigerator, including:

a first pulse tube configured to perform adiabatic expansion of a coolant gas;

a first regenerator connected to the first pulse tube, the first regenerator being configured to store a cooling generated at the first pulse tube based on the adiabatic expansion of the coolant gas;

a compressor configured to compress the coolant gas;

a first supply side valve configured to put in communication with or block off communication between a supply side of the compressor and a high temperature end of the first regenerator;

a first filter provided between a supply side of the first supply side valve and the high temperature end of the first regenerator;

a first suction side valve connected to the first filter via a first joint point, the first joint point being an intermediate point between the supply side of the first supply side valve and the first filter, the first suction side valve being configured to put in communication or block off communication between the first filter and a suction side of the compressor;

a first self seal joint provided between the supply side of the compressor and a suction side of the first supply side valve;

a second self seal joint provided between a supply side of the first suction side valve and the suction side of the compressor; and a third self seal joint provided between a first regenerator side of the first filter and the high temperature end of the first regenerator.

Another aspect of the embodiments of the present invention may be to provide a regenerative refrigerator, including:

a cylinder configured to perform adiabatic expansion of a coolant gas;

a regenerator connected to the cylinder, the regenerator being configured to store cooling generated at the cylinder based on the adiabatic expansion of the coolant gas;

a compressor configured to compress the coolant gas;

a supply side valve configured to put in communication or block off communication between a supply side of the compressor and a high temperature end of the regenerator;

a filter provided between a supply side of the supply side valve and the high temperature end of the regenerator;

a suction side valve connected to the filter via a joint point, the joint point being an intermediate point between the supply side of the supply side valve and the filter, the suction side valve being configured to put in communication or block off communication between the filter and a suction side of the compressor;

a first self seal joint provided between the supply side of the compressor and a suction side of the supply side valve;

a second self seal joint provided between a supply side of the suction side valve and the suction side of the compressor; and a third self seal joint provided between a regenerator side of the filter and the high temperature end of the regenerator.

Other aspect of the embodiments of the present invention may be to provide a pulse tube refrigerator, including:

a first pulse tube configured to perform adiabatic expansion of a coolant gas;

a first regenerator connected to the first pulse tube, the first regenerator being configured to store cooling generated at the first pulse tube based on the adiabatic expansion of the coolant gas;

a compressor configured to compress the coolant gas;

a first supply side valve configured to put in communication or block off communication between a supply side of the compressor and a high temperature end of the first regenerator;

a first suction side valve connected to the high temperature end of the first regenerator via a first joint point, the first joint point being an intermediate point between the supply side of the first supply side valve and the high temperature end of the first regenerator, the first suction side valve being configured to put in communication or block off communication between the high temperature end of the first regenerator and a suction side of the compressor;

a first self seal joint provided between the supply side of the compressor and a suction side of the first supply side valve;

a second self seal joint provided between a supply side of the first suction side valve and the suction side of the compressor;

a third self seal joint provided between the first joint point and the high temperature end of the first regenerator;

a first buffer provided so as to be connected the high temperature end of the first pulse tube;

a fifth self seal joint provided between the high temperature end of the first pulse tube and the first buffer; and a valve unit where the first supply side valve and the first suction side valve are mounted;

wherein the first buffer is mounted in the valve unit.

According to the embodiments of the present invention, it is possible to provide a cryogenic refrigerator and a regenerative refrigerator where a maintenance operation of a filter configured to remove wear dust can be done without performing an operation for increasing the temperature of the refrigerator to a normal temperature and an operation for substituting gas inside the refrigerator.

Additional objects and advantages of embodiments of the invention will be set forth in part in the description which follows, and in part will be obvious from the description, or may be learned by practice of the invention. The object and advantages of the embodiments of the invention will be realized and attained by means of the elements and combinations particularly pointed out in the appended claims.

It is to be understood that both the foregoing general description and the following detailed description are exemplary and explanatory only and are not restrictive of the invention as claimed.

DETAILED DESCRIPTION OF THE PREFERRED EMBODIMENTS

A description is given below, with reference to FIG. 1 through FIG. 28 of embodiments of the present invention.

(First Embodiment)

A pulse tube refrigerator of a first embodiment of the present invention is discussed with reference to FIG. 1.

Figure 1:
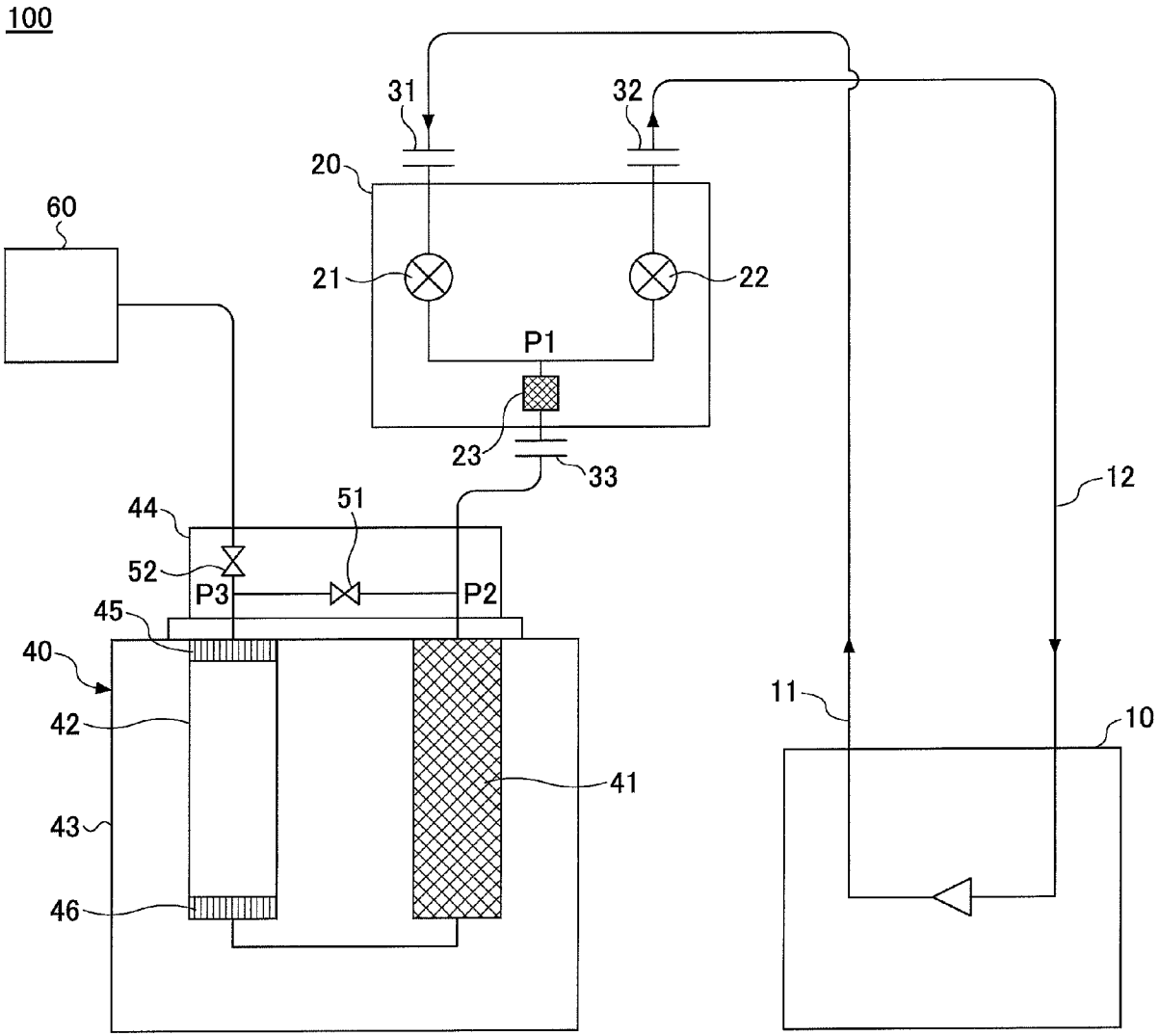
FIG. 1 is a schematic view of a structure of a pulse tube refrigerator of a first embodiment of the present invention.

FIG. 1 is a schematic view of a structure of the pulse tube refrigerator of the first embodiment of the present invention.

As shown in FIG. 1, the pulse tube refrigerator 100 of the first embodiment of the present invention includes a compressor 10, a valve unit 20, an expander 40, a first buffer 60, and others. The pulse tube refrigerator 100 is a single stage pulse tube refrigerator.

The compressor 10 includes a high pressure pipe 11 and a low pressure pipe 12. The high pressure pipe 11 is provided at a supply side. The lower pressure pipe 12 is provided at a suction side. The compressor 10 is configured to receive the coolant gas from the expander 40 via the low pressure pipe 12, suction the received coolant gas from the low pressure pipe 12, compress the suctioned coolant gas, jet the compressed coolant gas to the high pressure pipe 11 and supply the coolant gas to the expander 40 via the high pressure pipe 11.

The valve unit 20 includes a first supply side valve 21, a first suction side valve 22, a first filter 23, and others. The valve unit 20 is connected between the compressor 10 and the expander 40. By the valve unit 20, the high pressure pipe 11 at the supply side of the compressor 10 and the low pressure pipe 12 at the suction side of the compressor 10 are mutually connected to the expander 40.

By the first supply side valve 21, the high pressure pipe 11 at the supply side of the compressor 10 is in communication with or blocked off from the communication with the expander 40. By the first suction side valve 22, the low pressure pipe 12 at the suction side of the compressor 10 is in communication with or blocked off from the communication with the expander 40.

The expander 40 includes a first regenerator 41, a first pulse tube 42, a low temperature vessel 43, a flange/pipe unit 44, a first orifice 51, and a second orifice 52.

The first regenerator 41 is configured to store cooling generated by repeating adiabatic expansion of helium gas as the coolant gas. A high temperature end of the first regenerator 41 is connected to the flange/pipe unit 44. A low temperature end of the first regenerator 41 is connected to a low temperature end of the first pulse tube 42.

The first pulse tube 42 is configured to generate cooling by repeating adiabatic expansion of helium gas as the coolant gas supplied via the first regenerator 41. A high temperature end of the first pulse tube 42 is connected to the flange/pipe unit 44. A low temperature end of the first pulse tube 42 is connected to a low temperature end of the first pulse tube 42.

The first pulse tube 42 includes rectifiers 45 and 46 provided at a high temperature end and a low temperature end, respectively. The rectifiers 45 and 46 are configured to make flow of the coolant gas in the first pulse tube 42 stable.

The first regenerator 41 and the first pulse tube 42 connected to the flange/pipe unit 44 are mounted in the lower temperature vessel 43.

The flange/pipe unit 44 includes the first orifice 51, the second orifice 52, and others. In a state where the first regenerator 41 and the first pulse tube 42 are mounted in the low temperature vessel 43, the flange/pipe unit 44 works as a flange sealing the low temperature vessel 43 and a pipe unit connecting the first regenerator 41 and the first pulse tube 42 to the valve unit 20.

The first buffer 60 is connected to the flange/pipe unit 44. The first buffer 60 receives the coolant gas flowing out of the first pulse tube 42. The first buffer 60 has a function of a phase control mechanism configured to control a phase difference between the pressure change and the flow rate change of the coolant gas in the first pulse tube 42.

Next, the arrangement of pipes of the valve unit 20, the coolant gas in the flange/pipe unit 44, and the arrangement of pipes of a self seal (self-sealing) joint are discussed.

In the valve unit 20, the first filter 23 is provided between the supply side of the first supply side valve 21 and the high temperature end of the first regenerator 41. In addition, the first suction side valve 22 is provided so as to connect to the first filter 23 via a connecting point P1 which is an intermediate point between the supply side of the first supply side valve 21 and the first filter 23. Accordingly, the first filter 23 is also situated between the high temperature end of the first regenerator 41 and the suction side of the first suction side valve 22.

With this structure of the pipes, in a state where the first supply side valve 21 is opened and the first suction side valve 22 is closed, that is, the coolant gas is supplied from the high pressure pipe 11 to the high temperature end of the first regenerator 41, the first filter 23 can be provided between the first supply side valve 21 and the first regenerator 41.

In addition, in a state where the first supply side valve 21 is closed and the first suction side valve 22 is opened, that is, the coolant gas is suctioned from the high temperature end of the first cold storage pipe 41 to the low pressure pipe 12, the first filter 23 can be provided between the high temperature end of the first regenerator 41 and the first suction side valve 22.

Accordingly, as shown in FIG. 1, the valve unit 20 is connected to the compressor 10 at the suction side of the first supply side valve 21 and the supply side of the first suction side valve 22. The valve unit 20 is connected to the expander 40 via the first regenerator 41 of the first filter 23.

In the flange/pipe unit 44, the first orifice 51 is provided between a second connecting point P2 and the high temperature end of the first pulse tube 42. Here, the second connecting point P2 is an intermediate point between the first filter 23 and the high temperature end of the first regenerator 41.

In addition, in the flange/pipe unit 44, the second orifice 52 is provided between a third connecting point P3 and a first buffer 60. Here, the third connecting point P3 is an intermediate point between the first orifice 51 and the second pulse tube 42.

Accordingly, the flow amount of a part of the coolant gas flowing from the first filter 23 to the high temperature end of the first regenerator 41 is limited by the first orifice 51 so that the coolant gas flows to the high temperature end of the first pulse tube 42.

In addition, the flow amount of a part of the coolant gas flowing from the first filter 23 to the high temperature end of the first pulse tube 42 is limited by the second orifice 52 so that the coolant gas flows to the first buffer 60.

In the pulse tube refrigerator 100, a first self seal joint 31, a second self seal joint 32, and a third self seal joint 33 are provided for connecting the pipes to the valve unit 20.

The first self seal joint 31 is provided between the supply side of the compressor 10 and the suction side of the first suction side valve 21. In this example, the first self seal joint 31 is provided in a position where the high pressure pipe 11 situated at the supply side of the compressor 10 and the valve unit 20 where the first supply side valve 21 is received are connected to each other.

The second self seal joint 32 is provided between the supply side of the first suction side valve 22 and the suction side of the compressor 10. In this example, the second self seal joint 32 is provided in a position where the low pressure pipe 12 situated at the suction side of the compressor 10 and the valve unit 20 where the first suction side valve 22 is received are connected to each other.

The third self seal joint 33 is provided between the first regenerator 41 side of the first filter 23 and the high temperature end of the first regenerator 41. In this example, the third self seal joint 33 is provided between the valve unit 20 where the first filter 23 is received and the flange/pipe unit 44.

The self seal joint is a joint for a tube. The joint is formed by two members, a projecting half and a receiving half being fixed to head ends of two pipes. The projecting half and the receiving half each solely seals the head end of a pipe. The pipes can be put in communication by connecting the projecting half and the receiving half. When the self seal joint is used, even after two pipes are put in communication with each other, the head end of each pipe can be automatically sealed again by turning off the joint of two members. In other words, when the self seal joint is used, it is possible to perform attachment or detachment of two pipes without the coolant gas being released to the outside.

More specifically, as the pipe structure, for example, it is possible to use a structure where the projecting half or the receiving half can be fixed to, directly or via a short connecting tube, a head end of a tube having an external diameter of 6. 35 mm and an internal diameter of 4.35 mm made of Cu, SUS or resin.

There is no limitation to the first filter 23. For example, a column filter made of sintered metal, resin, or the like, a mesh filter made of resin, metal, or the like, or a felt filter can be used as the first filter 23. The mesh diameter of the column filter or the mesh diameter of the mesh filter may be, for example, 1 μm through 50 μm.

Next, operations for cooling the pulse tube refrigerator, operations for removing wear dust by the filter, and operations for performing maintenance operations of the filter without increasing the temperature of the cryogenic refrigerator, are discussed.

First, the operations for cooling the pulse tube refrigerator are discussed.

The pulse tube refrigerator 100 having the above-discussed structure repeats the operations for communicating through and blocking off with the first supply side valve 21 and the first suction side valve 22 provided in the valve unit 20. As a result of this, the high temperature end of the first regenerator 41 is switched to the high pressure pipe 11 or the low pressure pipe 12 so as to be in communication with the high pressure pipe 11 or the low pressure pipe 12.

Because of this, since the coolant gas is periodically supplied to/received from the first pulse tube 42 in communication with the low temperature end of the first regenerator 41, the low temperature end of the first regenerator 41 is cooled by repeating compression and adiabatic expansion of the coolant gas in the first pulse tube 42 and thereby storing the cooling generated by the adiabatic expansion in the first regenerator 41.

In addition, in the pulse tube refrigerator 100 of this example, the first regenerator 41 is switched to and put in communication with the high pressure pipe 11. The coolant gas flows from the first regenerator 41 to the high temperature end of the first pulse tube 42 via the first orifice 51 so that the flow of the coolant gas from the low temperature end of the first pulse tube 42 is prevented.

After this, when the pressure in the first pulse tube 42 becomes higher than the pressure in the first buffer 60, the coolant gas in the first pulse tube 42 passes through the second orifice 52 and flows into the first buffer 60. The coolant gas moves to the high temperature end of the first pulse tube 42.

Next, the first regenerator 41 is switched to and put in communication with the low pressure pipe 12. The coolant gas flows out of the high temperature end of the first pulse tube 42 via the first orifice 51 so that flow of the coolant gas from the low temperature end of the first pulse tube 42 is prevented.

After this, when the pressure in the first pulse tube 42 becomes lower than the pressure in the first buffer 60, the coolant gas in the first buffer 60 passes through the second orifice 52 and flows into the first pulse tube 42. The coolant gas moves to the low temperature end of the first pulse tube 42.

As a result of this, timings of the pressure change and flow rate change in the first pulse tube 42 are shifted so that the phase difference becomes large. Therefore, the work for generating cooling by the refrigerator when the compression/expansion of the coolant gas is repeated becomes large so that the cooling capacity are improved.

In the pulse tube refrigerator 100 of the embodiment of the present invention, helium (He) gas having pressure, for example, 0.5 MPa through 2.5 MPa is used as the coolant gas and compression and expansion of the coolant gas are repeated at a repeating rate of, for example, approximately 2 Hz, so that a cold temperature such as approximately 50 K can be obtained at the low temperature end of the first pulse tube 42.

Next, operations for removing the wear dust by the filter can be discussed.

As discussed above, the first supply side valve 21 and the first suction side valve 22 are switched between the communicating state and the blocking state at a rate of approximately 2 Hz.

As the first supply side valve 21 and the first suction side valve 22, known rotary valves can be used. The rotary valve includes a disk and a sealing member. The disk is rotatable and has a communicating hole for periodically switching between the communicating state and the blocking state. The sealing member is fixed so as to receive the disk while the disk is slid. On the other hand, due to sliding of the disk and the sealing member, the sealing member is worn so that wear dust is generated.

There is no limitation of the material of the disk. For example, an aluminum material having a sliding surface where an anodic treatment is applied can be used as the material of the disk. In addition, there is no limitation of the material of the sealing member. For example, a fluorocarbon resin material or a ceramic material can be used as the material of the sealing member.

If the aluminum material having the sliding surface where the anodic treatment is applied is used for the disk and the fluorocarbon resin material is used for the sealing member, a Young's modulus of the aluminum material having the sliding surface where the anodic treatment is applied, depending on a method of anodizing, is greater than the Young's modulus of the aluminum material which is 70 GPa. A Young's modulus of the fluorocarbon resin material is approximately 0.5 GPa through 1.0 GPa.

Hence, the fluorocarbon resin material forming the sealing member is worn so that the wear dust of the fluorocarbon resin is generated. The size of the wear dust, depending on the weight or the rotational speed of the disk, has no limitation and may be, for example, 1 μm through 50 μm.

The wear dust generated at the first supply side valve 21 is moved along a flow direction of the coolant gas. The wear dust moves from the supply side of the first supply side valve 21 to the high temperature end of the first regenerator 41.

As the regenerator material, for example, a copper mesh or a lead sphere is supplied inside the first regenerator 41. When the wear dust is stored in a crevice of the regenerator material, the contact area of the coolant gas and the regenerator material is reduced. As a result of this, capacity of the first regenerator 41 for storing cooling is degraded so that the cooling capacity of the pulse tube refrigerator 10 is degraded.

However, in a case where the first filter 23 is provided between the supply side of the first supply side valve 21 and the high temperature end of the first regenerator 41, the wear dust are removed by the first filter 23 so that the wear dust do not enter the first regenerator 41.

The wear dust generated at the first suction side valve 22 do not move to the first regenerator 41 side because of the opposite flow direction of the coolant gas. Even if parts of the wear dust move in the opposite direction, the wear dust is removed by the first filter 23. In addition, since the coolant gas flows in both directions at the first filter 23, the filter may not be clogged with the wear dust.

Next, the maintenance operations of the filter without increasing the temperature of the cryogenic refrigerator are discussed.

First, operations of the pulse tube refrigerator 100 are stopped.

Then, a joint of the first self seal joint 31 provided between the supply side of the compressor 10 and the suction side of the suction side valve 21 is disconnected. Furthermore, a joint of the second self seal joint 32 provided between the suction side of first suction side valve 22 and the suction side of the compressor 10 is disconnected. In addition, a joint of the third self seal joint 33 provided between the first regenerator 41 side of the first filter 23 and the high temperature end of the first regenerator 41 is disconnected.

As a result of this, without entry of the air or impurities to the compressor 10 and the expander 40, it is possible to separate only the valve unit 20 from the compressor 10 and the expander 40 in a state where the coolant gas is maintained.

Next, the valve unit 20 is disconnected so that the first filter 23 is taken out. Then, a new first filter 23 is installed and the valve unit 20 is reassembled.

After that, the atmosphere inside of the valve unit 20 is switched from the air to the coolant gas and the first self seal joint 31, the second self seal joint 32, and the third self seal joint 33 are joined. As a result of this, the valve unit 20 is connected to the compressor 10 and the expander 40. At this time, without entry of the air or impurities to the compressor 10 and the expander 40, it is possible to connect the valve unit 20 in a state where the coolant gas is maintained.

Here, in a case where the valve unit 20 is separated from the expander 40 without using the third self seal joint 33, if the air enters the expander 40 in a state where the expander 40 is cooled, vapor, nitride gas, oxide gas, or the like in the air is condensed and solidified in the pipe connecting the low temperature end of the first regenerator 41 and the low temperature end of the first pulse tube 42. As a result of this, the first regenerator 41 and the first pulse tube 42 are not in communication with each other and thereby operations of the expander 40 are not possible.

Accordingly, if the valve unit 20 is separated from the expander 40 without using the third self seal joint 33, the separation operations cannot be performed immediately after the operations of the pulse tube refrigerator 100 are stopped. Hence, the operator should wait until the temperature of the expander 40 is increased at the normal temperature. The time for increasing the temperature of the expander 40 at the normal temperature, depending on the entirety of the system using the pulse tube refrigerator 100, is, for example, 20 hours.

On the other hand, in a case where the valve unit 20 is separated from the expander 40 by using the third self seal joint 33, it is not necessary to increase the temperature of the expander 40 at the normal temperature. Accordingly, the maintenance operations of the first filter 23 can be performed for, for example, two hours. Thus, it is possible to reduce the time required for the maintenance operations.

In addition, in a case where the valve unit 20 and the compressor 10 are connected to each other without using the first self seal joint 31 and the second self seal joint 32, if the air enters the compressor 10, the impurities in the air enter inside the compressor 10 so that malfunction of the compressor 10 may be caused.

Furthermore, in a case where the valve unit 20 and the compressor 10 are connected to each other by using a normal valve or a normal joint instead of the first self seal joint 31 and the second self seal joint 32, the air may not enter the compressor 10. However, in this case compared to a case where the first self seal joint 31 and the second self seal joint 32 are used, it is necessary to perform the operations for turning off the connection of the joint and the opening and closing operations of the valve. Accordingly, it is necessary to perform complex operations as the operations for separating the valve unit 20 from the compressor 10.

On the other hand, in a case where the valve unit 20 is separated from the compressor 10 by using the first self seal joint 31 and the second self seal joint 32, it is possible to easily perform the maintenance operations without mixing the impurities in the compressor 10.

Thus, according to the pulse tube refrigerator of the first embodiment of the present invention, the filter configured to remove the wear dust generated at the valve is connected between the compressor and the expander by using the self seal joint. Therefore, it is possible to perform the maintenance operations of the filter without performing the operations for increasing the temperature of the pulse tube refrigerator and the operations for substituting the gas.

In this embodiment, as long as the first filter 23 is provided at the compressor side 10 compared to the third self seal joint 33, the first filter 23 may be arranged outside the valve unit 20.

(First Modified Example of the First Embodiment)

Next, a pulse tube refrigerator of a first modified example of the first embodiment of the present invention is discussed with reference to FIG. 2.

Figure 2:
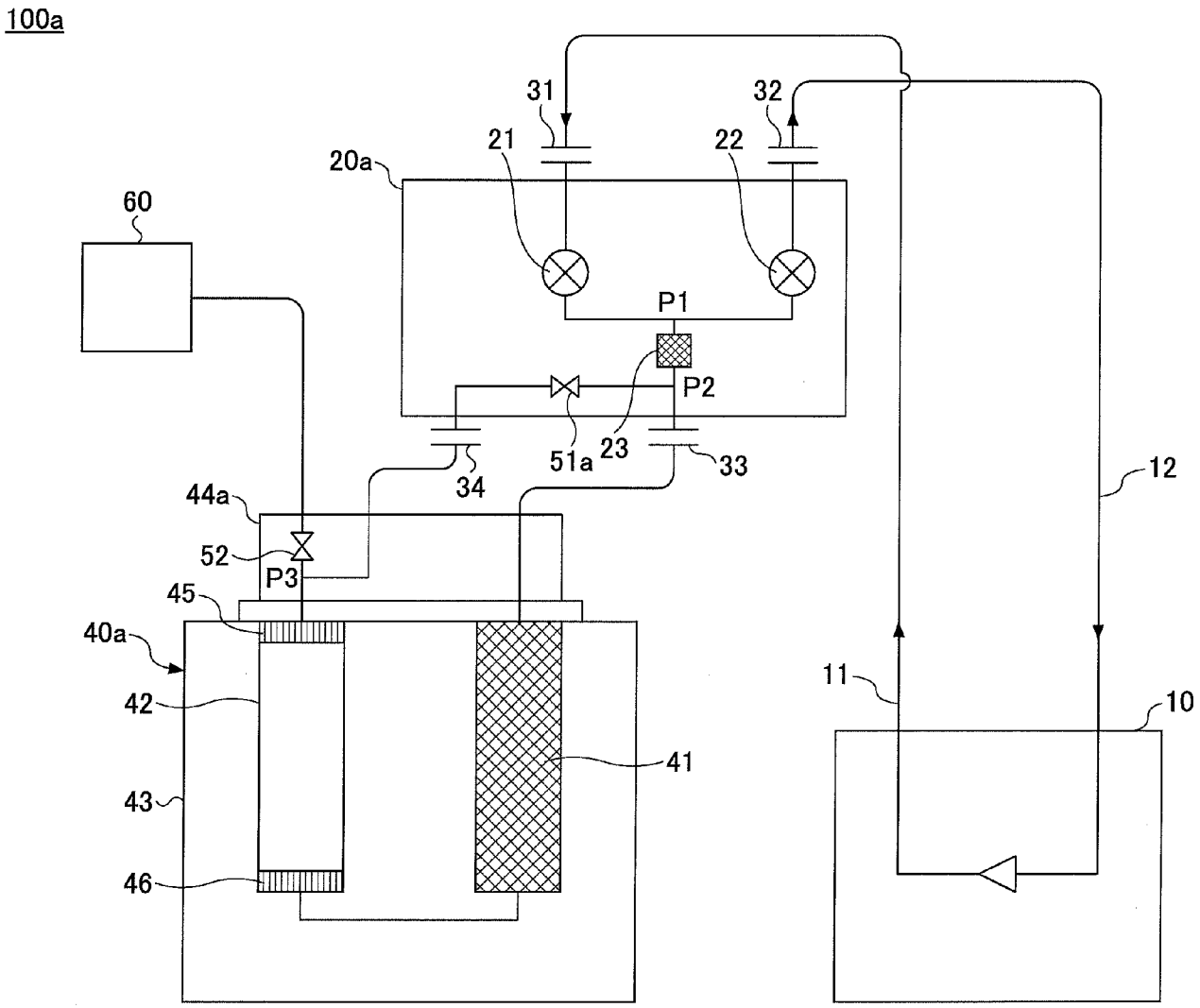
FIG. 2 is a schematic view of a structure of a pulse tube refrigerator of a first modified example of the first embodiment of the present invention.

FIG. 2 is a schematic view of a structure of a pulse tube refrigerator of the first modified example of the first embodiment of the present invention. In FIG. 2, parts that are the same as the parts shown in FIG. 1 are given the same reference numerals, and explanation thereof is omitted.

The pulse tube refrigerator of the first modified example of the first embodiment is different from the pulse tube refrigerator shown in FIG. 1 in that the first orifice is connected so that the first orifice can be separated from the expander in a body with the valve unit by using the self seal joint in the pulse tube refrigerator of the first modified example of the first embodiment.

In the first embodiment shown in FIG. 1, the first orifice is provided in the flange/pipe of the expander unit and therefore cannot be separated from the expander. On the other hand, in the pulse tube refrigerator 100*a* of the first modified example of the first embodiment shown in FIG. 2, a first orifice 51*a* is provided in a valve unit 20*a* and can be separated from an expander 40*a* by using a fourth self seal joint 34.

As shown in FIG. 2, a structure of the pulse tube refrigerator 100*a* of the first modified example is the same as that of the pulse tube refrigerator 100 shown in FIG. 1 except structures of the valve unit 20*a*, the fourth self seal joint 34*a*, and the flange/pipe unit 44*a*.

The valve unit 20*a*, unlike the valve unit 20 shown in FIG. 1, includes the first orifice 51*a*. The first orifice 51*a* is situated between the second joint point P2 which is an intermediate point between the first filter 23 and the third self seal joint 33 and the high temperature end of the first pulse tube 42.

Since the first orifice 51*a* is provided in the valve unit 20*a*, the second joint point P2 is also provided in the valve unit 20*a*. The functions of the first orifice 51*a* are the same as those of the first orifice 51 shown in FIG. 1. The first orifice 51*a* limits the flow amount of the coolant gas flowing from the first filter 23 to the high temperature end of the first pulse tube 42.

The fourth self seal joint 34 is provided between the first pulse tube 42 side of the first orifice 51*a* and the high temperature end of the first pulse tube 42. In this modified example, the fourth self seal unit 34 is provided between the valve unit 20*a* where the first orifice 51*a* is received and the flange/pipe unit 44*a*.

The flange/pipe unit 44*a*, as well as the flange/pipe unit 44 shown in FIG. 1, includes the second orifice 52. However, the flange/pipe unit 44*a*, unlike the flange/pipe unit 44 shown in FIG. 1, does not include the first orifice 51*a*. In the flange/pipe unit 44*a*, as well as the flange/pipe unit 44 shown in FIG. 1, the second orifice 52 is provided between the third joint point P3 which is an intermediate point between the fourth self seal joint 34 and the high temperature end of the first pulse tube 42 and the first buffer 60.

The operations for cooling the pulse tube refrigerator 100*a* and the operations for removing the wear dust by the filter in this modified example are the same as those in the example shown in FIG. 1. However, this modified example is different from the example shown in FIG. 1 in that the maintenance operations of the filter can be performed without increasing the temperature of the cryogenic refrigerator in this modified example.

The first orifice 51*a* is configured to limit the flow amount of the coolant gas flowing from the first filter 23 to the high temperature end of the first pulse tube 42. An orifice tube having a diameter of, for example, 0.01 mm through 2 mm can be used as the first orifice 51*a*.

Most of the wear dust generated at the first supply side valve 21 is removed when passing through the first filter 23. However, in a case where parts of the wear dust having diameters smaller than the first filter 23 are not removed but pass through, the wear dust may be accumulated in the vicinity of the first orifice 51*a*. Therefore, regular maintenance operations such as one operation for 10,000 hours may be required for the first orifice 51*a* in addition to the first filter 23.

In the maintenance operations of the pulse tube refrigerator, operations of the pulse tube refrigerator 100*a* are stopped, and joints of the first self seal joint 31, the second self seal joint 32, and the third self seal joint 33 are disconnected. In addition, the joint of the fourth self seal joint 34 is disconnected, and the valve unit 20*a* is separated from the compressor 10 and the expander 40*a*.

At this time, in this modified example as well as the example shown in FIG. 1, only the valve unit 20*a* can be separated without entry of the air or the impurities to the compressor 10 and the expander 40*a*.

Next, the valve unit 20*a* is disassembled so that the first filter 23 and the first orifice 51*a* are taken out. Then, a new first filter 23 and another first orifice 51*a* being clean are installed and the valve unit 20 is reassembled.

After that, the inside of the valve unit 20*a* is filled with the coolant gas and the first self seal joint 31, the second self seal joint 32, and the third self seal joint 33 are joined. As a result of this, the valve unit 20*a* is connected to the compressor 10 and the expander 40. At this time, in this modified example as well as the example shown in FIG. 1, without entry of the air or impurities to the compressor 10 and the expander 40, it is possible to connect the valve unit 20*a*.

Furthermore, by using the third self seal joint 33 and the fourth self seal joint 34, it is possible to perform the maintenance operations of the first filter 23 and the first orifice 51*a* without taking the time for increasing the temperature of the expander 40*a* at the normal temperature.

In addition, by using the first self seal joint 31 and the second self seal joint 32, it is possible to perform the maintenance operations of the first filter 23 and the first orifice 51*a* without entry of the impurities to the compressor 10.

Thus, according to the pulse tube refrigerator of the first modified example of the first embodiment of the present invention, the filter configured to remove the wear dust and the orifice where the wear dust may be accumulated are connected between the compressor and the expander by using the self seal joint.

Therefore, it is possible to perform the maintenance operations of the filter and the orifice without performing the operations for increasing the temperature of the pulse tube refrigerator at the normal temperature and the operations for substituting the gas.

In this modified example, as long as the first orifice 51*a* is provided at the compressor 10 side comparing to the fourth self seal joint 34, the first orifice 51*a* may be arranged outside the valve unit 20*a*.

(Second Modified Example of the First Embodiment)

Next, a pulse tube refrigerator of a second modified example of the first embodiment of the present invention is discussed with reference to FIG. 3.

Figure 3:
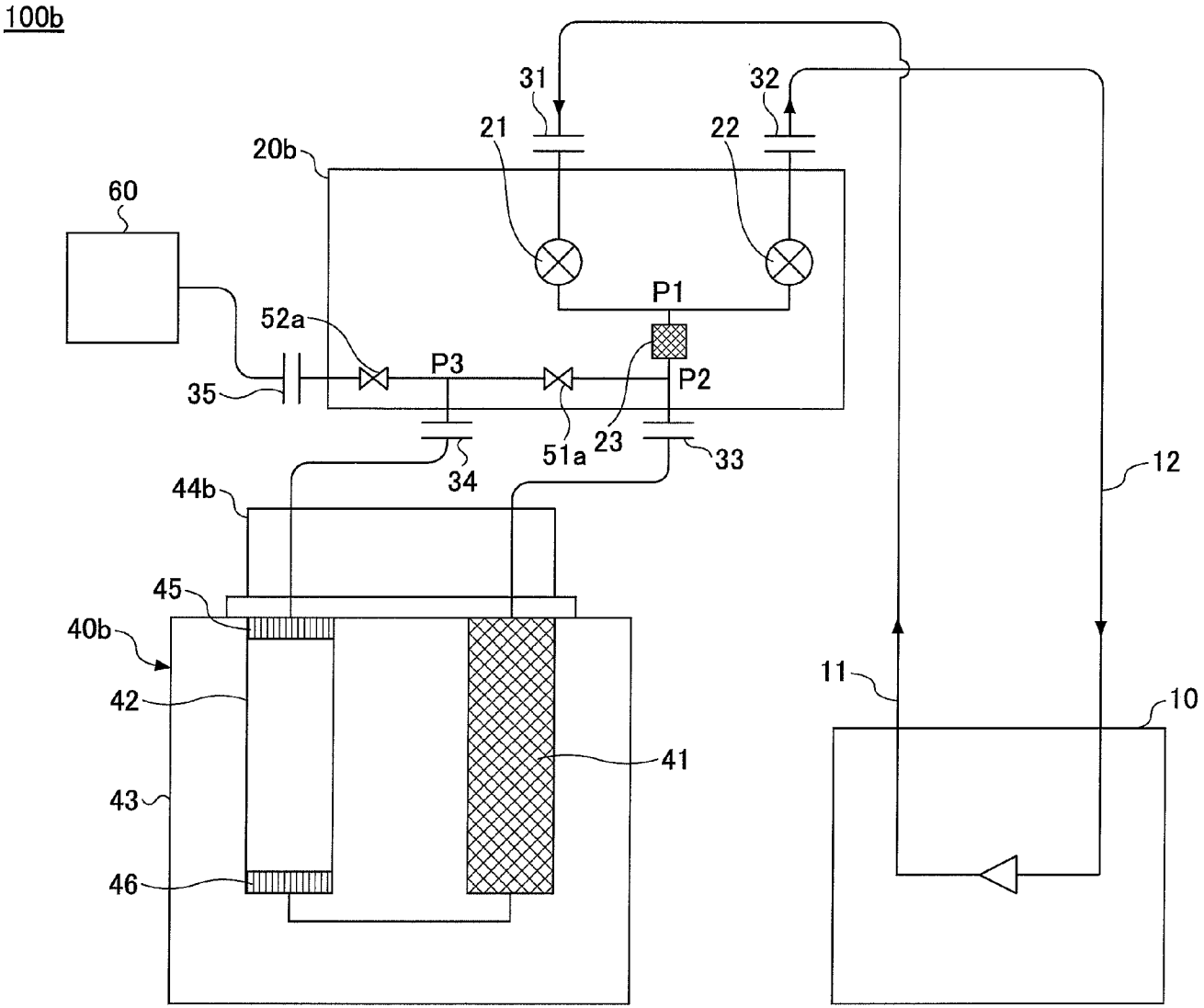
FIG. 3 is a schematic view of a structure of a pulse tube refrigerator of a second modified example of the first embodiment of the present invention.

FIG. 3 is a schematic view of a structure of a pulse tube refrigerator of the second modified example of the first embodiment of the present invention. In FIG. 3, parts that are the same as the parts shown in FIG. 1 and FIG. 2 are given the same reference numerals, and explanation thereof is omitted.

The pulse tube refrigerator of the second modified example of the first embodiment is different from the pulse tube refrigerator shown in FIG. 2 in that the second orifice is connected so that the second orifice can be separated from the expander and the first buffer in a body with the valve unit by using the self seal joint in the pulse tube refrigerator of the second modified example of the first embodiment.

In the first modified example of the first embodiment shown in FIG. 2, the second orifice is provided in the flange/pipe of the expander unit and therefore cannot be separated from the expander. On the other hand, in the pulse tube refrigerator 100*b* of the second modified example of the first embodiment shown in FIG. 3, a second orifice 52*a* is provided in a valve unit 20*b* and can be separated from the first buffer 60 by using a fifth self seal joint 35.

As shown in FIG. 3, a structure of the pulse tube refrigerator 100*b* of the second modified example is the same as that of the pulse tube refrigerator 100*a* shown in FIG. 2 except structures of the valve unit 20*b*, the fifth self seal joint 35, and the flange/pipe unit 44*b*.

The valve unit 20*b*, unlike the valve unit 20*a* shown in FIG. 2, includes the second orifice 52*a*. The second orifice 52*a* is situated between the third joint point P3 which is an intermediate point between the first orifice 51*a* and the fourth self seal joint 34 and the first buffer 60.

Since the second orifice 52*a* is provided in the valve unit 20*b*, the third joint point P3 is also provided in the valve unit 20*b*. The functions of the second orifice 52*a* are the same as those of the first orifice 51*a* shown in FIG. 2. The second orifice 52*a* limits the flow amount of a part of the coolant gas flowing from the first filter 23 to the high temperature end of the first pulse tube 42, the part flowing to the first buffer 60.

The fifth self seal joint 35 is provided between the first buffer 60 side of the second orifice 52*a* and the first buffer 60. In this modified example, the fifth self seal unit 35 is provided between the valve unit 20*b* where the second orifice 52*a* is received and the first buffer 60.

The flange/pipe unit 44*b*, as well as the flange/pipe unit 44 shown in FIG. 1, does not include the second orifice 52.

The operations for cooling the pulse tube refrigerator 100*b* and the operations for removing the wear dust by the filter in this modified example are the same as those in the first modified example shown in FIG. 2. However, the maintenance operations of the filter without increasing the temperature of the cryogenic refrigerator in this modified example are different those in the first modified example shown in FIG. 2 on the following points.

The second orifice 52*a* is configured to limit the flow amount of a part of the coolant gas flowing from the first filter 23 to the high temperature end of the first pulse tube 42, the part flowing to the first buffer 60. An orifice tube having a diameter of, for example, 0.01 mm through 2 mm can be used as the second orifice 52*a*.

Most of the wear dust generated at the first supply side valve 21 is removed when passing through the first filter 23. When passing through the first orifice 51*a*, a part of the wear dust is accumulated. In addition, a part of the wear dust may be accumulated in the vicinity of the second orifice 52*a*. Therefore, regular maintenance operations such as an operation one time for 10,000 hours may be required for the second orifice 52*a* in addition to the first orifice 51*a* and the first filter 23.

In the maintenance operations of the pulse tube refrigerator 100*b*, operations of the pulse tube refrigerator 100*b* are stopped, and joints of the first self seal joint 31, the second self seal joint 32, the third self seal joint 33, and the fourth self seal joint 34 are disconnected. In addition, the joint of the fifth self seal joint 35 is disconnected, and the valve unit 20*b* is separated from the compressor 10 and the expander 40*a*.

At this time, in this modified example as well as the example shown in FIG. 1, only the valve unit 20*b* can be separated without entry of the air or the impurities to the compressor 10 and the expander 40*b*.

Next, the valve unit 20*b* is disassembled so that the first filter 23, the first orifice 51*a* and the second orifice 52*a* are taken out. Then, a new first filter 23 and another first orifice 51*a* and another second orifice 52*a* being cleaned are installed and the valve unit 20*b* is reassembled.

After that, an inside of the valve unit 20*b* is refilled with the coolant gas and the first self seal joint 31, the second self seal joint 32, the third self seal joint 33, the fourth self seal joint 34, and the fifth self seal joint 35 are joined. As a result of this, the valve unit 20*b* is connected to the compressor 10 and the expander 40. At this time, in this modified example as well as the example shown in FIG. 1, without entry of the air or impurities to the compressor 10 and the expander 40*b*, it is possible to connect the valve unit 20*b*.

Furthermore, by using the third self seal joint 33, the fourth self seal joint 34, and the fifth self seal joint 35, it is possible to perform the maintenance operations of the first filter 23, the first orifice 51*a*, and the second orifice 52*a* without taking the time for increasing the temperature of the expander 40*b* at the normal temperature.

In addition, by using the first self seal joint 31 and the second self seal joint 32, it is possible to perform the maintenance operations of the first filter 23 and the first orifice 51*a* without entry of the impurities to the compressor 10.

Thus, according to the pulse tube refrigerator of the second modified example of the first embodiment of the present invention, the filter configured to remove the wear dust and the orifice where the wear dust may be accumulated are connected between the compressor and the expander by using the self seal joint.

Therefore, it is possible to perform the maintenance operations of the filter and the orifice without performing the operations for increasing the temperature of the pulse tube refrigerator at the normal temperature and the operations for substituting the gas.

In this modified example, as long as the second orifice 52*a* is provided at the compressor 10 side compared to the fifth self seal joint 35, the second orifice 52*a* may be arranged outside the valve unit 20*b*.

(Third Modified Example of the First Embodiment)

Next, a pulse tube refrigerator of a third modified example of the first embodiment of the present invention is discussed with reference to FIG. 4.

Figure 4:
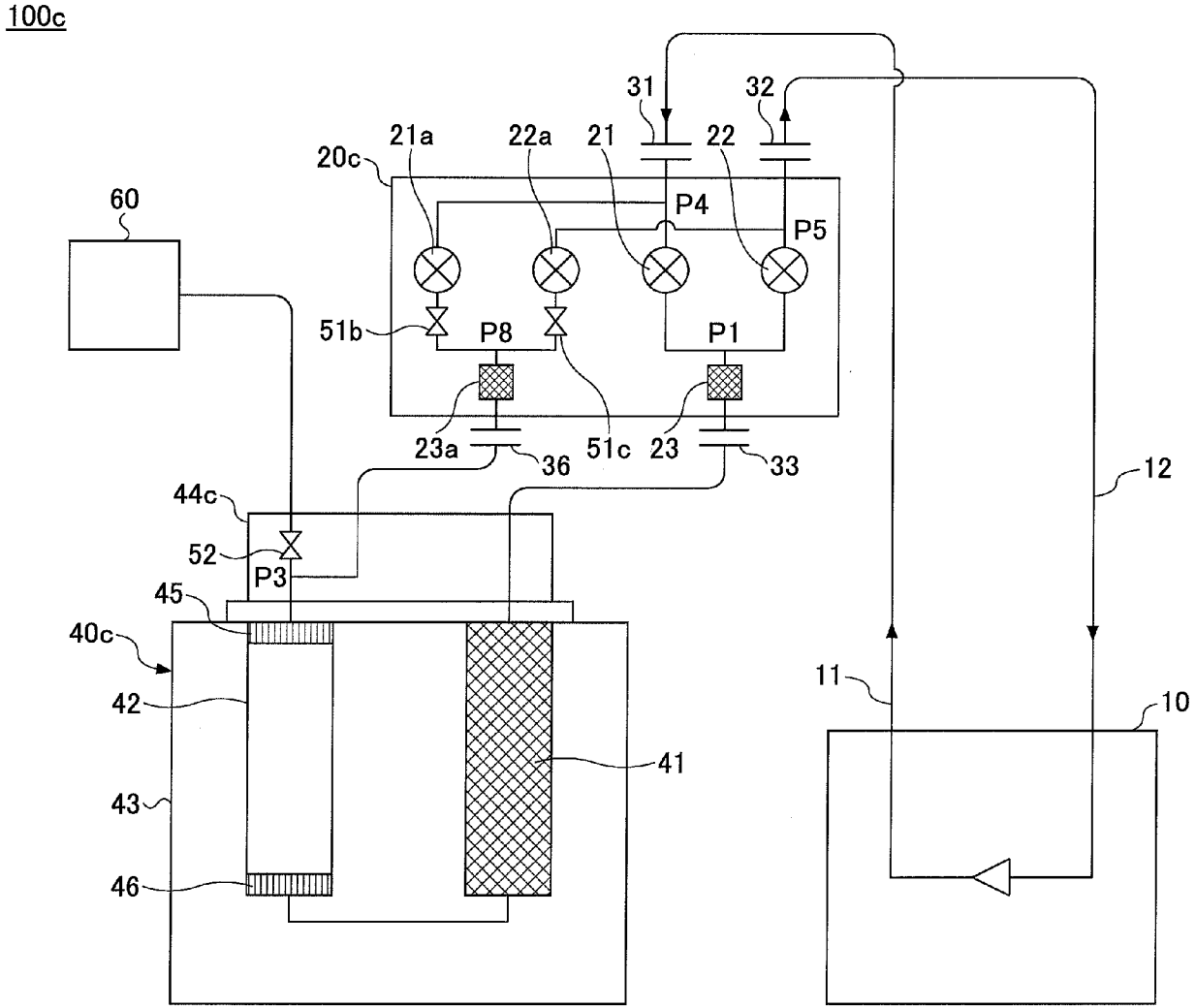
FIG. 4 is a schematic view of a structure of a pulse tube refrigerator of a third modified example of the first embodiment of the present invention.

FIG. 4 is a schematic view of a structure of a pulse tube refrigerator of the third modified example of the first embodiment of the present invention. In FIG. 4, parts that are the same as the parts shown in FIG. 1 through FIG. 3 are given the same reference numerals, and explanation thereof is omitted.

The pulse tube refrigerator of the third modified example is different from that shown in FIG. 1 in that the pulse tube refrigerator of the third modified example is 4-valve 1-tage type pulse tube refrigerator.

In the pulse tube refrigerator shown in FIG. 1, the high temperature end of the first pulse tube 42 is connected to the first supply side valve 21 and the first suction side valve 22 via the first orifice 31 and the first filter 23. On the other hand, in the pulse tube refrigerator 100*c* shown in FIG. 4, the high temperature end of the first pulse tube 42 is connected to the supply side and the suction side of the compressor 10 via the second supply side valve 21*a* different from the first supply side valve 21 and the second suction side valve 22*a* different from the first suction side valve 22.

As shown in FIG. 4, the structure of the pulse tube refrigerator 100*c* of the third modified example is the same as that of the pulse tube refrigerator 100 shown in FIG. 1 except structures of the valve unit 20*c*, a sixth self seal joint 36, and the flange/pipe unit 44*c*. The valve unit 20*c*, unlike the valve unit 20 shown in FIG. 1, includes the second supply side valve 21*a*, the second suction side valve 22*a*, the second filter 23*a*, and the first orifices 51*b* and 51*c*.

The second supply side valve 21*a* is connected to the supply side of the compressor 10 via a fourth joint point P4 which is an intermediate point between the suction side of the first suction side valve 21 and the first self seal joint 31, so as to put in communication or block off from communication the supply side of the compressor 10 and the high temperature end of the first pulse tube 42 with each other.

The second suction side valve 22*a* is connected to the suction side of the compressor 10 via a fifth joint point P5 which is an intermediate point between the supply side of the first suction side valve 22 and the second self seal joint 32, so as to put in communication or block off from communication the suction side of the compressor 10 and the high temperature end of the first pulse tube 42 with each other.

The second filter 23*a* is provided between the supply side of the second supply side valve 21*a* and the high temperature end of the first pulse tube 42.

In addition, in this modified example, the second suction side valve 22*a* is provided so as to connect to the second filter 23*a* via an eighth connecting point P8 which is an intermediate point between the supply side of the second supply side valve 21*a* and the second filter 23*a*. Accordingly, the second filter 23*a* is also situated between the high temperature end of the first pulse tube 42 and the suction side of the second suction side valve 22*a*.

With this structure of the pipes, in a state where the second supply side valve 21*a* is opened and the second suction side valve 22*a* is closed, that is, the coolant gas is supplied from the high pressure pipe 11 to the high temperature end of the first pulse tube 42, a filter can be provided between the second supply side valve 21*a* and the first pulse tube 42.

In addition, in a state where the second supply side valve 21*a* is closed and the second suction side valve 22*a* is opened, that is, the coolant gas is suctioned from the high temperature end of the first pulse tube 42 to the low pressure pipe 12, a filter can be provided between the high temperature end of the first pulse tube 42 and the second suction side valve 22*a*.

The first orifice 51*b* is provided between the eighth joint point P8 and the supply side of the second supply side valve 21*a*. The first orifice 51*c* is provided between the eighth joint point P8 and the suction side of the second suction side valve 22*a*.

Accordingly, the flow amount of the coolant gas flowing from the second supply side valve 21*a* to the high temperature end of the first pulse tube 42 is limited by the first orifice 51*b*. The flow amount of the coolant gas flowing from the high temperature end of the first pulse tube 42 to the second suction side valve 22*a* is limited by the first orifice 51*c*.

The sixth self seal joint 36 is provided between the first pulse tube 42 side of the second filter 23*a* and the high temperature end of the first pulse tube 42. In this modified example, the sixth self seal unit 36 is provided between the valve unit 20*c* where the second filter 23*a* is received and the flange/pipe unit 44*c*.

The flange/pipe unit 44*c*, as well as the flange/pipe unit 44 shown in FIG. 1, includes the second orifice 52. However, the flange/pipe unit 44*c*, unlike the flange/pipe unit 44 shown in FIG. 1, does not include the first orifice 51*a*. On this point, this modified example is the same as the first modified example of the first embodiment of the present invention.

Operations for cooling the pulse tube refrigerator 100*c*, operations for removing wear dust by the filter, and operations for performing maintenance operations of the filter without increasing the temperature of the cryogenic refrigerator of this modified example are different from those of the first embodiment of the present invention discussed with reference to FIG. 1 on the following points.

First, the operations for cooling the pulse tube refrigerator are discussed. Points different from the first embodiment of the present invention discussed with reference to FIG. 1 are mainly discussed.

In the pulse tube refrigerator 100*c* having the above-discussed structure, since the coolant gas is supplied/received from the high temperature end of the first pulse tube 42, the low temperature end of the first regenerator 41 is cooled by repeating compression and expansion of the coolant gas in the first pulse tube 42 and coolly storing the cooling generated by the adiabatic expansion in the first regenerator 41. This is the same as the first embodiment of the present invention discussed with reference to FIG. 1.

By using the first orifices 51*b* and 51*c*, the second orifice 52, and the first buffer 60, the coolant gas flows from the high temperature end of the first pulse tube 42 so that the phase difference between the pressure change and the flow rate change in the first pulse tube 42 is made large and the cooling capacity are improved. This is the same as the first embodiment of the present invention discussed with reference to FIG. 1.

However, in the pulse tube refrigerator 100*c* of this example, the high temperature end of the first pulse unit 42 is switched so as to be put in communication with the high pressure pipe 11 or the low pressure pipe 12 by repeating communicating operations or blocking operations of the second supply side valve 21*a* and the second suction side valve 11*a* received in the valve unit 20.

The timing for switching the second supply side valve 21*a* and the second suction side valve 22*a* can be shifted from the timing for switching the first supply side valve 21 and the first suction side valve 22. Accordingly, in this modified example as compared to the example discussed with reference to FIG. 1, the phase difference between the pressure change and the flow rate change in the first pulse tube 42 can be made greater so that the cooling capacity of the pulse tube refrigerator 100*c* can be improved.

For example, the timing for switching the second supply side valve 21*a* and the second suction side valve 22*a* can be shifted from the timing for switching the first supply side valve 21 and the first suction side valve 22, at intervals of 1 degree through 60 degrees.

In the pulse tube refrigerator 100*c*, helium (He) gas having pressure, for example, 0.5 MPa through 2.5 MPa is used as the coolant gas and compression and expansion of the coolant gas are repeated at a repeating rate of, for example, approximately 2 Hz, so that a cold temperature such as approximately 40 K which is lower than that of the first embodiment can be obtained at the low temperature end of the first pulse tube 42.

Next, operations for removing the wear dust by the filter can be discussed.

The operations for removing the wear dust generated at the first supply side valve 21 and the first suction side valve 22 by the first filter 23 are the same as those in the first embodiment of the present invention.

On the other hand, rotary valves are used as the second supply side valve 21*a* and the second suction side valve 22*a* as well as the first supply side valve 21 and the first suction side valve 22.

The wear dust generated at the second supply side valve 21*a* move along a flow direction of the coolant gas. The wear dust move from the supply side of the second supply side valve 21*a* into the first regenerator 41 via the high temperature end of the first pulse tube 42, the low temperature end of the first pulse tube 42, and the low temperature end of the first regenerator 41.

At this time, the abrasion powder may be accumulated at the rectifiers 45 and 46 so that the flow path may be clogged. In addition, the wear dust may be accumulated in a crevice of the regenerator material in the first regenerator 41 so that, in this example as well as the first embodiment, the cooling capacity of the pulse tube refrigerator 100 may be degraded.

However, in a case where the second filter 23*a* is provided between the supply side of the second supply side valve 21*a* and the high temperature end of the first pulse tube 42, the wear dust are removed by the second filter 23*a* so that the wear dust do not enter the first pulse tube 42.

The wear dust generated at the second suction side valve 22*a* do not move to the first pulse tube 42 side because of the opposite direction of the coolant gas flow. Even if parts of the wear dust move in the opposite direction, the wear dust is removed by the second filter 23*a*. In addition, since the coolant gas flows in both directions at the second filter 23*a*, the filter may not be clogged with the wear dust.

Next, the maintenance operations of the filter without increasing the temperature of the cryogenic refrigerator are discussed.

First, operations of the pulse tube refrigerator 100*c* are stopped. Then, joints of the first self seal joint 31, the second self seal joint 32, and the third self seal joint 33 are disconnected. In addition, the joint of the sixth self seal joint 36 is disconnected so that the valve unit 20*s* is separated from the compressor 10 and the expander 40*c*.

At this time, in this example as well as the first embodiment discussed with reference to FIG. 1, without entry of the air or impurities to the compressor 10 and the expander 40*c*, it is possible to separate only the valve unit 20 from the compressor 10 and the expander 40*c*.

Next, the valve unit 20*a* is disassembled so that the first filter 23, the second filter 23*a*, and the first orifices 51*b* and 51*c* are taken out. Then, a new first filter 23, a new second filter 23*a*, and new or other first orifices 51*b* and 51*c* being clean are installed and the valve unit 20*c* is reassembled.

After that, the inside of the valve unit 20*c* is refilled with the coolant gas and the first self seal joint 31, the second self seal joint 32, the third self seal joint 33, and the sixth self seal joint are joined. As a result of this, the valve unit 20*c* is connected to the compressor 10 and the expander 40*c*. At this time, in this modified example as well as the example shown in FIG. 1, without entry of the air or impurities to the compressor 10 and the expander 40*c*, it is possible to connect the valve unit 20*c*.

Furthermore, by using the third self seal joint 33 and the sixth self seal joint 36, it is possible to perform the maintenance operations of the first filter 23, the second filter 23*a*, and the first orifices 51*b* and 51*c* without taking time for increasing the temperature of the expander 40*c* at the normal temperature.

In addition, by using the first self seal joint 31 and the second self seal joint 32, it is possible to perform the maintenance operations of the first filter 23, the second filter 23*a*, and the first orifices 51*b* and 51*c* without entry of the impurities to the compressor 10.

Thus, according to the pulse tube refrigerator of the third modified example of the first embodiment of the present invention, the filter configured to remove the wear dust and the orifice where the wear dust may be accumulated are connected between the compressor and the expander by using the self seal joints.

Therefore, it is possible to perform the maintenance operations of the filter and the orifice without performing the operations for increasing the temperature of the pulse tube refrigerator at the normal temperature and the operations for substituting the gas.

In this modified example, as long as the second filter 23*a* and the first orifices 51*b* and 51*c* are provided at the compressor 10 side compared to the sixth self seal joint 34, the second filter 23*a* and the first orifices 51*b* and 51*c* may be arranged outside the valve unit 20*c*.

(Fourth Modified Example of the First Embodiment)

Next, a pulse tube refrigerator of a fourth modified example of the first embodiment of the present invention is discussed with reference to FIG. 5.

Figure 5:
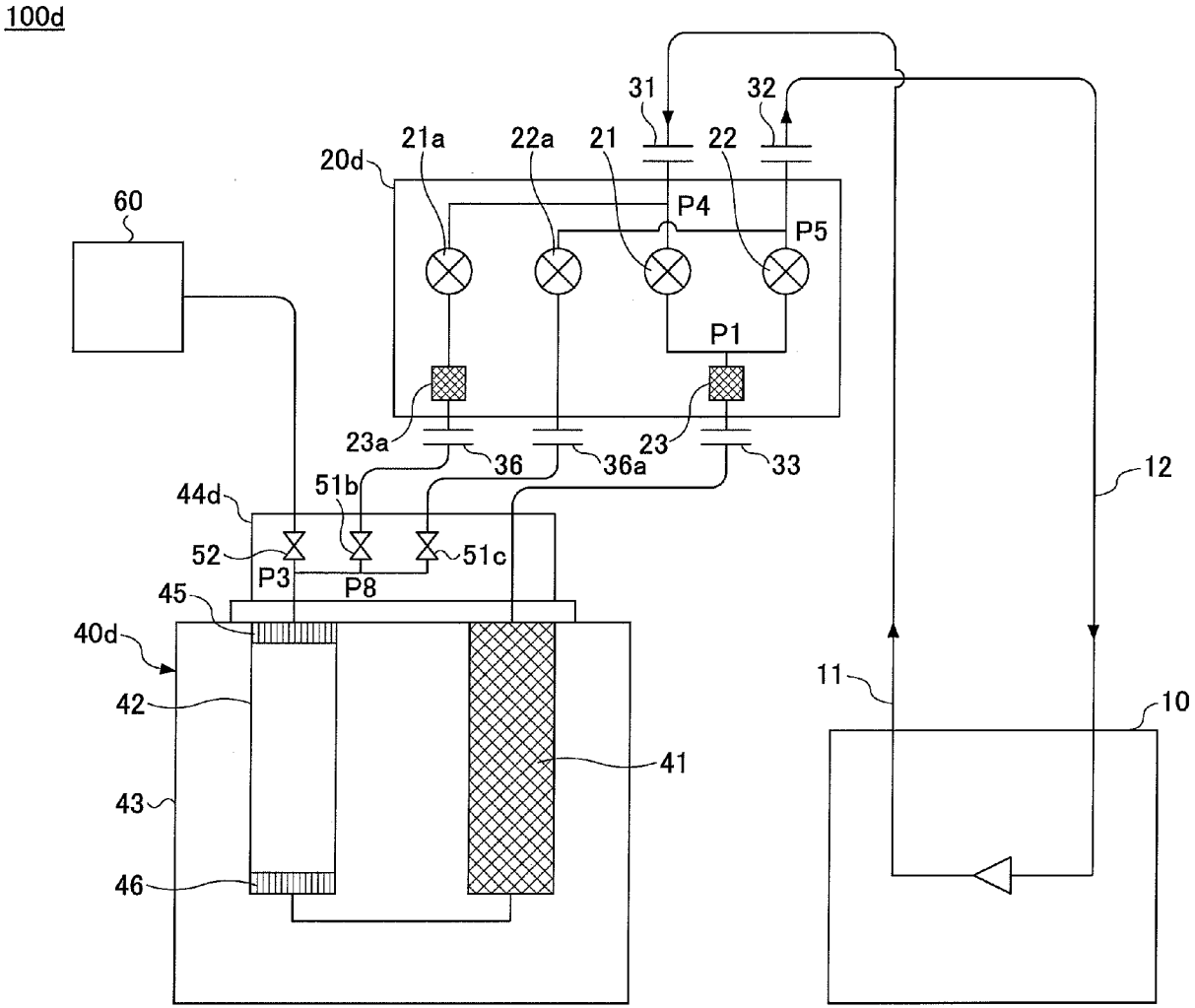
FIG. 5 is a schematic view of a structure of a pulse tube refrigerator of a fourth modified example of the first embodiment of the present invention.

FIG. 5 is a schematic view of a structure of a pulse tube refrigerator of the fourth modified example of the first embodiment of the present invention. In FIG. 5, parts that are the same as the parts shown in FIG. 1 through FIG. 4 are given the same reference numerals, and explanation thereof is omitted.

The pulse tube refrigerator of the fourth modified example is different from that of the third modified example in that the second filter is connected to only the second supply side valve in the fourth modified example.

In the third modified example of the first embodiment of the present invention, the second filter is switched to communicate with the second supply side valve or the second suction side valve. In the pulse tube refrigerator 100*d* of the fourth modified example, the second filter 23*a* is not connected to the second suction side valve 22*a* but only the supply side valve 21*a*.

As shown in FIG. 5, a structure of the pulse tube refrigerator 100*d* of the fourth modified example is the same as that of the pulse tube refrigerator 100*c* shown in FIG. 4 except structures of a valve unit 20*d*, sixth self seal joints 36 and 36*a*, and a flange/pipe unit 44*d*.

The valve unit 20*d* in this modified example unlike the third modified example does not include the first orifices 51*b* and 51*c*. Instead, the flange/pipe unit 44*d* includes the first orifices 51*b* and 51*c*. In addition, in this modified example, the eighth joint P8 and the first orifices 51*b* and 51*c* are provided in the flange/pipe unit 44*d*.

In this modified example unlike the third modified example, two sixth self seal joints 36 and 36*a* are provided. More specifically, the sixth self seal joint 36 is provided between the supply side of the second filter 23*a* and the suction side of the first orifice 51*b*. In addition, the sixth self seal joint 36*a* is provided between the supply side of the second orifice 51*c* and the suction side of the second suction side valve 22*a*.

The operations for cooling the pulse tube refrigerator 100*d*, the operations for removing the wear dust by the filter, and the maintenance operations of the filter without increasing the temperature of the cryogenic refrigerator in this modified example are the same as those in the third modified example.

In this modified example, the second filter 23*a* is provided between the supply side of the second supply side valve 21*a* and the compressor 10 side of the first orifice 51*b*. Accordingly, the likelihood of the wear dust generated at the second supply side valve 21*a* being accumulated at the first orifice 51*b* and the rectifiers 45 and 46 so that the flow path is clogged can be reduced.

In addition, while the direction of the coolant gas flowing through the second filter 23*a* in the third modified example is periodically reversed, the direction of the coolant gas flowing through the second filter 23*a* in this modified example is constant. Accordingly, in this modified example, the wear dust may be accumulated so that the pipes may be clogged. Hence, it is possible to achieve greater effect in this modified example than the third modified example where the wear dust can be removed by the second filter 23*a*.

Thus, according to the pulse tube refrigerator of the fourth modified example of the first embodiment of the present invention, the filter configured to remove the wear dust and the orifice where the wear dust may be accumulated are connected between the compressor and the expander by using the self seal joint.

Therefore, it is possible to perform the maintenance operations of the filter and the orifice without performing the operations for increasing the temperature of the pulse tube refrigerator at the normal temperature and the operations for substituting the gas.

In this modified example, as long as the second filter 23*a* is provided at the compressor 10 side compared to the sixth self seal joint 36, the second filter 23*a* may be arranged outside the valve unit 20*d*.

(Fifth Modified Example of the First Embodiment)

Next, a pulse tube refrigerator of a fifth modified example of the first embodiment of the present invention is discussed with reference to FIG. 6.

Figure 6:
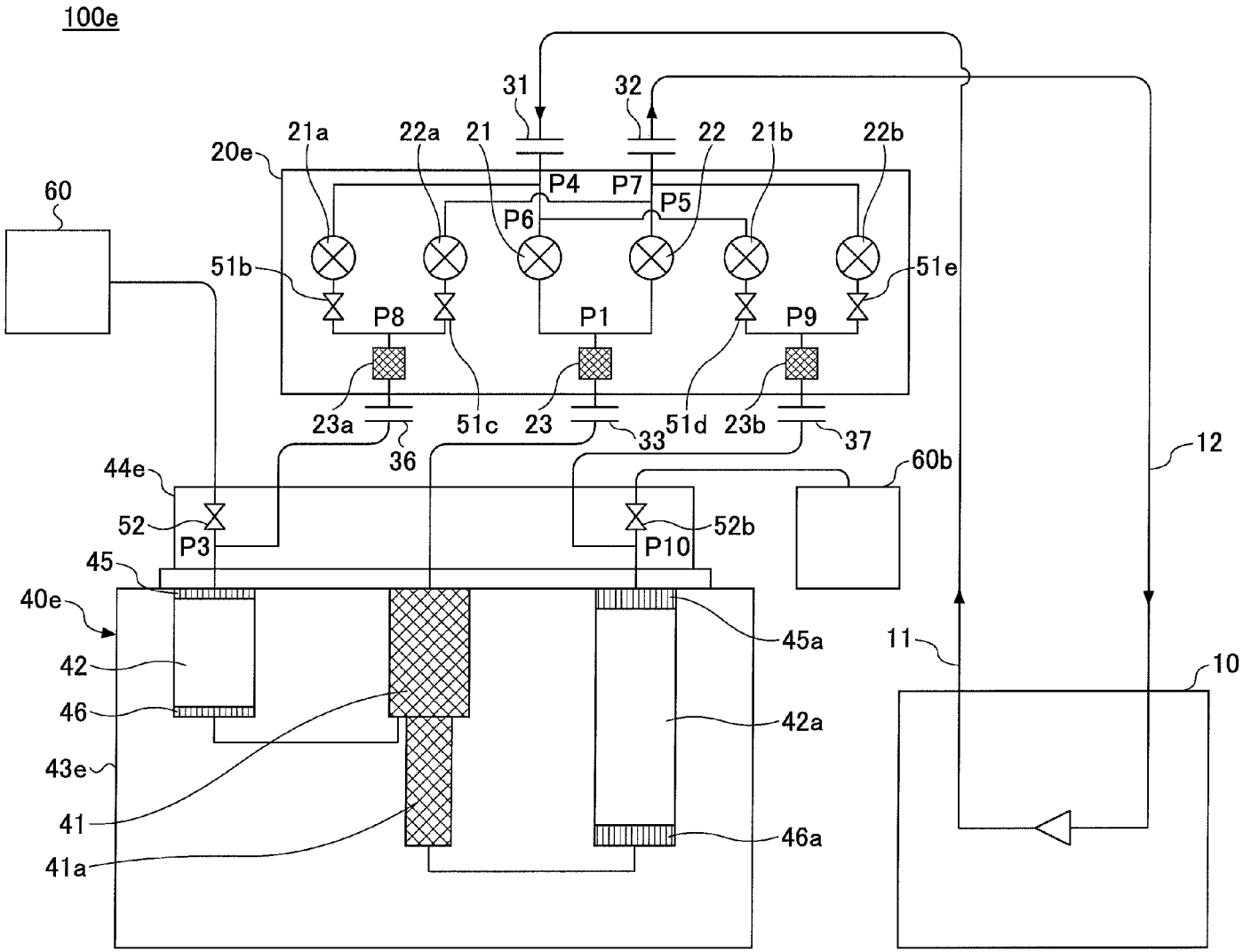
FIG. 6 is a schematic view of a structure of a pulse tube refrigerator of a fifth modified example of the first embodiment of the present invention.

FIG. 6 is a schematic view of a structure of a pulse tube refrigerator of the fifth modified example of the first embodiment of the present invention. In FIG. 6, parts that are the same as the parts shown in FIG. 1 through FIG. 5 are given the same reference numerals, and explanation thereof is omitted.

The pulse tube refrigerator of this modified example is different from that of the third modified example in that the pulse tube refrigerator of this modified example is a 4-valve 2-stage type pulse tube refrigerator.

In the third modified example of the first embodiment of the present invention, the pulse tube refrigerator includes one stage each of the regenerator and the pulse tube. On the other hand, a pulse tube refrigerator 100*e* of this modified example includes two stages of the regenerators and the pulse tubes.

As shown in FIG. 6, a structure of the pulse tube refrigerator 100*e* of this modified example is the same as that of the third modified example except structures of an expander 40*e*, a valve unit 20*e*, and a seventh self seal joint 37.

The expander 40*e* includes a first regenerator 41, a second regenerator 41*a*, a first pulse tube 42, a second pulse tube 42*a*, a low temperature vessel 43*e*, a flange/pipe unit 44*e*, and second orifices 52 and 52*b*.

The second regenerator 41*a*, as well as the first regenerator 41, is configured to store cooling generated by repeating adiabatic expansion of helium (He) gas as the coolant gas. A high temperature end of the second regenerator 41*a* is connected to a low temperature end of the first regenerator 41. A low temperature end of the second regenerator 41*a* is connected to a low temperature end of the second pulse tube 42*a*.

The second pulse tube 42*a*, as well as the first pulse tube 42, is configured to generate cooling by repeating adiabatic expansion of helium (He) gas as the coolant gas supplied via the second regenerator 41*a*. A high temperature end of the second pulse tube 42*a* is connected to the flange/pipe unit 44*e*. A low temperature end of the second pulse tube 42*a* is connected to a low temperature end of the second regenerator 41*a*.

The second pulse tube 42*a*, as well as the first pulse tube 42, has rectifiers 45*a* and 46*a* provided at the high temperature end and the low temperature end, respectively. The rectifiers 45*a* and 46*a*, as well as the rectifiers 45 and 46, are configured to make flow of the coolant gas in the second pulse tube 42*a* stable.

The first regenerator 41 connected to the flange/pipe unit 44*e*, the first pulse tube 42, the second pulse tube 42*a*; and the second regenerator 41*a* connected to the flange/pipe unit 44*e* via the first regenerator 41 are provided in the low temperature vessel 43*e*.

In addition, the flange/pipe unit 44*e* includes the second orifices 52 and 52*b*.

Furthermore, the first buffer 60 and the second buffer 60*b* are connected to the second orifices 52 and 52*b*, respectively, provided in the flange/pipe unit 44*e*. The first buffer 60 and the second buffer 60*b* have a function of a phase control mechanism configured to control a phase difference between the pressure change and the flow rate change of the coolant gas in the first pulse tube 42 and the second pulse tube 42*a*.

The valve unit 20*c* of this modified example unlike the third modified example includes a third supply side valve 21*b*, a third suction side valve 22*b*, a third filter 23*b*, and first orifices 51*d* and 51*e*.

The third supply side valve 21*b* is connected to the supply side of the compressor 10 via a sixth joint point P6 which is an intermediate point between the suction side of the first supply side valve 21 and the first self seal joint 31. The third supply side valve 21*b* is configured to allow communication or block communication between the supply side of the compressor 10 and the high temperature end of the second pulse tube 42*a*.

The third suction side valve 22*b* is connected to the suction side of the compressor 10 via a seventh joint point P7 which is an intermediate point between the supply side of the first suction side valve 22 and the second self seal joint 32. The third suction side valve 22*b* is configured to allow communication or block communication between the suction side of the compressor 10 and the high temperature end of the second pulse tube 42*a*.

The third filter 23*b* is provided between the supply side of the third supply side valve 21*b* and the high temperature end of the second pulse tube 42*a*.

Furthermore, the third suction side valve 22*b* is connected to the third filter 23*b* via a ninth joint point P9 which is an intermediate point between the supply side of the third supply side valve 21*b* and the third filter 23*b*. Accordingly, the third filter 23*b* is situated between the high temperature end of the second pulse tube 42*a* and the suction side of the third suction side valve 22*b*. Accordingly, the third filter 23*b* is situated between the high temperature end of the second pulse tube 42*a* and the suction side of the third suction side valve 22*b*.

With this structure of the pipes, in a state where the third supply side valve 21*b* is opened and the third suction side valve 22*b* is closed, that is, the coolant gas is supplied from the high pressure pipe 11 to the high temperature end of the second pulse tube 42*a*, a filter can be provided between the third supply side valve 21*b* and the second pulse tube 42*a*.

In addition, in a state where the third supply side valve 21*b* is closed and the third suction side valve 22*b* is opened, that is, the coolant gas is suctioned from the high temperature end of the second pulse tube 42*a* to the low pressure pipe 12, a filter can be provided between the high temperature end of the second pulse tube 42*a* and the third suction side valve 22*b*.

The first orifice 51*d* is provided between the ninth joint point P9 and the supply side of the third supply side valve 21*b*. The first orifice 51*e* is provided between the ninth joint point P9 and the suction side of the third suction side valve 22*b*.

Accordingly, the flow amount of the coolant gas flowing from the third supply side valve 21*b* to the high temperature end of the second pulse tube 42*a* is limited by the first orifice 51*d*.

The flow amount of the coolant gas flowing from the high temperature end of the second pulse tube 42*a* to the third suction side valve 22*b* is limited by the first orifice 51*e*.

In the flange/pipe unit 44*e*, the second orifice 52*b* is provided between a tenth joint point P10 which is an intermediate point between the third filter 23*b* and the high temperature end of the second pulse tube 42*a*. Accordingly, a flow amount of a part of the cooling gas flowing from the third filter 23*b* to the high temperature end of the second pulse tube 42*a* is limited by the second orifice 52*b* and the part of the coolant gas flows out to the second buffer 60*b*.

The seventh self seal joint 37 is provided between the second pulse tube 42*a* side of the third filter 23*b* and the high temperature end of the second pulse tube 42*a*. In this modified example, the seventh self seal unit 37 is provided between the valve unit 20*e* where the third filter 23*b* is received and the flange/pipe unit 44*e*.

Operations for cooling the pulse tube refrigerator 100*e*, operations for removing wear dust by the filter, and operations for performing maintenance operations of the filter without increasing the temperature of the cryogenic refrigerator of this modified example are different from those of the third modified example on the following points.

First, the operations for cooling the pulse tube refrigerator are discussed. Points different from the third modified example are mainly discussed.

In the pulse tube refrigerator 100*e* having the above-discussed structure, since the coolant gas is supplied/received from the high temperature end of the first pulse tube 42, the low temperature end of the first regenerator 41 is cooled by repeating compression and expansion of the coolant gas in the first pulse tube 42 and coolly storing the cooling generated by the adiabatic expansion in the first regenerator 41. By using the first orifices 51*b* and 51*c*, the second orifice 52, the first buffer 60, the second supply side valve 21*a*, and the second suction side valve 22*a*, the phase difference between the pressure change and the flow rate change in the first pulse tube 42 is made large so that the cooling capacity can be improved. These are the same as the third modified example of the first embodiment.

As a result this, it is possible to achieve low temperature having approximately 40 K at the low temperature end of the first regenerator 41.

Furthermore, the pulse tube refrigerator used in this modified example is a two-stage type pulse tube refrigerator. Therefore, the coolant gas is supplied/received from the high temperature end of the second regenerator 41*a* connected to the low temperature end of the first regenerator 41 having a low temperature such as approximately 40 K; and cooling generated by adiabatic expansion of the coolant gas in the second pulse tube 42*a* is stored in the second regenerator 41*a* so that the low temperature end of the second regenerator 41*a* is cooled.

In addition, in this modified example as well as the third modified example, by using the first orifices 51*d* and 51*e*, the second orifice 52*b*, the second buffer 60*b*, the third supply side valve 21*b*, and the third suction side valve 22*b*, the phase difference between the pressure change and the flow rate change in the second pulse tube 42*a* is made large. Work for generating cooling by the cryogenic refrigerator at the time when the compression and expansion of the coolant gas is repeated can be made large so that the cooling capacity can be improved.

As a result this, it is possible to achieve low temperature of approximately 4 K at the low temperature end of the second regenerator 41*a*.

Next, operations for removing the wear dust by the filter are discussed. Points different from the third modified example are mainly discussed.

The operations for removing the wear dust generated at the first supply side valve 21, the first suction side valve 22, the second supply side valve 21*a*, and the second suction side valve 22*a* by the first filter 23 and the second filter 23*a* are the same as those in the third modified example of the first embodiment of the present invention.

On the other hand, the third filter 23*b* is provided between the supply side of the third supply side valve 21*b* and the high temperature end of the second pulse tube 42*a*. The wear dust is removed by the third filter 23*b* so as to be prevented from entering to the second pulse tube 42*a*.

Most of the wear dust generated at the third supply side valve 22*b* does not move to the second pulse tube 42*a* side because the flow direction of the coolant gas is opposite. Even if a part of the wear dust move in the above-mentioned opposite direction, the abrasion powder is removed by the third filter 23*b*. In addition, since the coolant gas flows in both directions at the third filter 23*b*, the wear dust may not clog the filter.

Next, the maintenance operations of the filter without increasing the temperature of the cryogenic refrigerator are discussed. Points different from the third modified example are mainly discussed.

First, operations of the pulse tube refrigerator 100*e* are stopped. Then, joints of the first self seal joint 31, the second self seal joint 32, the third self seal joint 33, and the sixth self seal joint are disconnected. In addition, the joint of the seventh self seal joint 37 is disconnected so that the valve unit 20*e* is separated from the compressor 10 and the expander 40*e*.

At this time, in this example as well as the third modified example of the first embodiment, without entry of the air or impurities to the compressor 10 and the expander 40*e*, it is possible to separate only the valve unit 20 from the compressor 10 and the expander 40*e*.

Next, the valve unit 20*e* is disassembled so that the first filter 23, the second filter 23*a*, the third filter 23*b*, and the first orifices 51*b*, 51*c*, 51*d*, and 51*e* are taken out. Then, these components are replaced with new or cleaned other components and the valve unit 20*c* is reassembled.

After that, the inside of the valve unit 20*e* is refilled with the coolant gas and the first self seal joint 31, the second self seal joint 32, the third self seal joint 33, the sixth self seal joint 36, and the seventh self seal joint 37 are joined. As a result of this, the valve unit 20*e* is connected to the compressor 10 and the expander 40*e*. At this time, in this modified example as well as third modified example, without entry of the air or impurities to the compressor 10 and the expander 40*e*, it is possible to connect the valve unit 20*e*.

Furthermore, in this modified example as well as the third modified example, it is possible to perform the maintenance operations of the first filter 23, the second filter 23*a*, the third filter 23*b*, the first orifices 51*b*, 51*c*, 51*d*, and 51*e* without taking time for increasing the temperature of the expander 40*e* at the normal temperature and entry of the impurities to the compressor 10.

Thus, according to the 2-stage type pulse tube refrigerator of this modified example, the filters configured to remove the wear dust and the orifice where the wear dust may be accumulated are connected between the compressor and the expander by using the self seal joints.

Therefore, it is possible to perform the maintenance operations of the filter and the orifice without performing the operations for increasing the temperature of the pulse tube refrigerator at the normal temperature and the operations for replacing the gas.

In this modified example, as long as the third filter 23*b* and the first orifices 51*d* and 51*e* are provided at the compressor 10 side compared to the seventh self seal joint 37, the third filter 23*b* and the first orifices 51*d* and 51*e* may be arranged outside the valve unit 20*c*.

(Sixth Modified Example of the First Embodiment)

Next, a pulse tube refrigerator of a sixth modified example of the first embodiment of the present invention is discussed with reference to FIG. 7.

Figure 7:
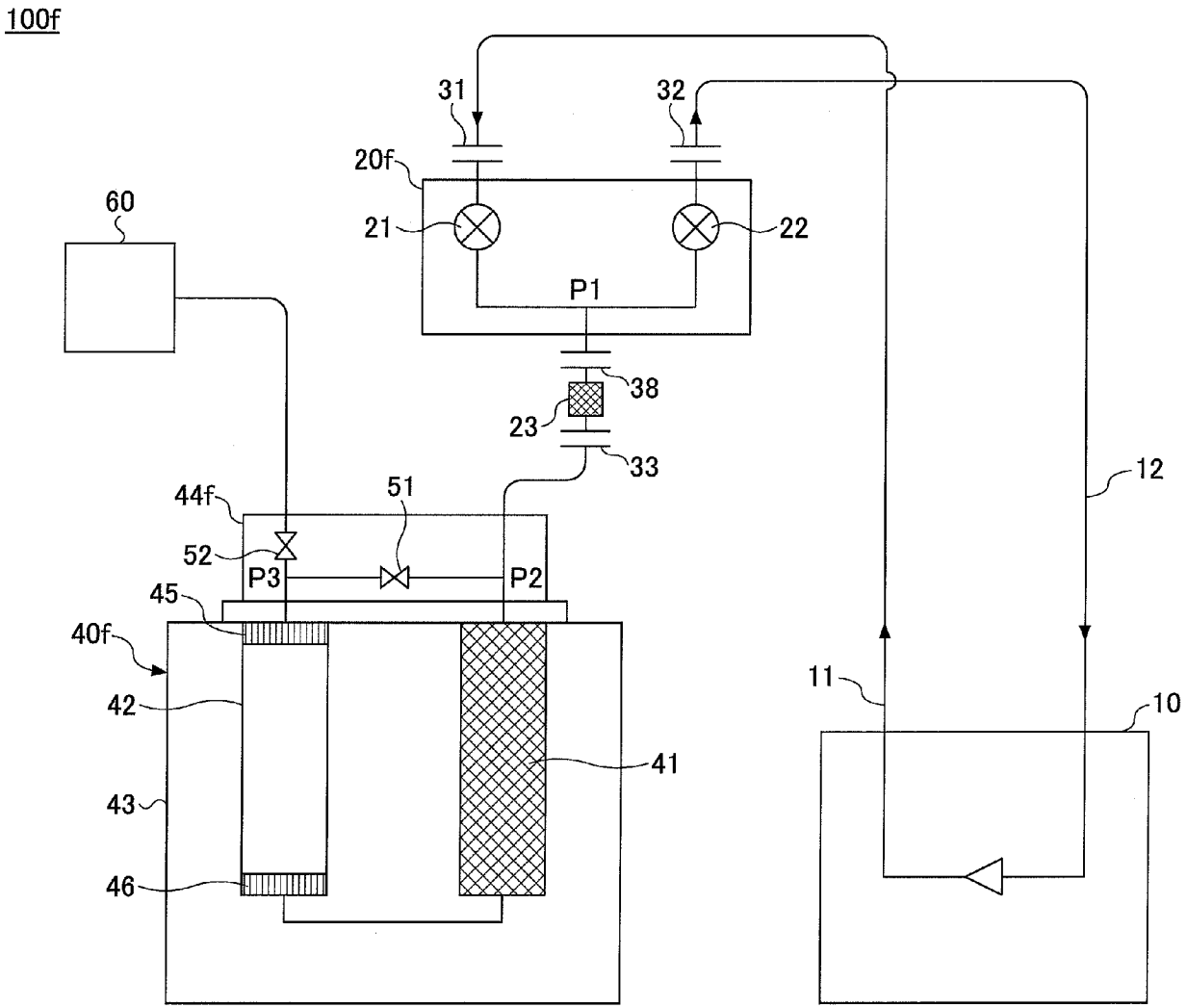
FIG. 7 is a schematic view of a structure of a pulse tube refrigerator of a sixth modified example of the first embodiment of the present invention.

FIG. 7 is a schematic view of a structure of a pulse tube refrigerator of the sixth modified example of the first embodiment of the present invention. In FIG. 7, parts that are the same as the parts shown in FIG. 1 through FIG. 6 are given the same reference numerals, and explanation thereof is omitted.

The pulse tube refrigerator of this modified example is different from that of the first embodiment discussed with reference to FIG. 1 in that the first filter is connected to the valve unit which can be separated by the self seal joint.

In the first embodiment discussed with reference to FIG. 1, the first filter cannot be separated from the valve unit by using the self seal joint. In the pulse tube refrigerator 100*f* of this modified example, the first filter 23 is provided outside the valve unit 20*f* and is connected to the valve unit 20*f* by using the eighth self seal joint 38 by which the first filter 23 can be separated from the valve unit 20*f*.

As shown in FIG. 7, the structure of the pulse tube refrigerator 100*f* of this modified example is the same as that of the pulse tube refrigerator 100 shown in FIG. 1 except structures of a valve unit 20*f* and the eighth self seal joint 38.

The valve unit 20*f* in this modified example unlike the first embodiment discussed with reference to FIG. 1 does not include the first filter 23. The first filter 23 is provided outside the valve unit 20*f*.

The eighth self seal joint 38 is provided between the first joint point P1 and the compressor 10 side of the first filter 23. In this modified example, the eighth self seal joint 38 is provided between the valve unit 20*f* and the compressor 10 side of the first filter 23.

The operations for cooling the pulse tube refrigerator 100*f* and the operations for removing the wear dust by the filter in this modified example are the same as those in the first embodiment discussed with reference to FIG. 1. However, the maintenance operations of the filter without increasing the temperature of the cryogenic refrigerator in this example are different from those of the first embodiment discussed with reference to FIG. 1.

First, operations of the pulse tube refrigerator 100*f* are stopped.

Then, joints of the first self seal joint 31, the second self seal joint 32, and the third self seal joint 33 are disconnected. In addition, the joint of the eighth self seal joint 38 is disconnected so that the valve unit 20*f* is separated from the compressor 10 and the expander 40*c*.

After that, without disassembling the valve unit 20*f*, only the first filter 23 is exchanged for new one. The inside of the first filter is filled with the coolant gas and the first self seal joint 31, the second self seal joint 32, the third self seal joint 33, and the eighth self seal joint 38 are joined. As a result of this, the valve unit 20*f* and the first filter 23 are connected to the compressor 10 and the expander 40*f*.

Therefore, only the first filter 23 is separated and operations for disassembling and reassembling the valve unit 20*f* and for gas substitution are not necessary. Time for maintenance operations of the filter can be further reduced.

The first filter may be provided with the eighth self seal joint 38 inside the valve unit 20*f*.

(Seventh Modified Example of the First Embodiment)

Next, a pulse tube refrigerator of a seventh modified example of the first embodiment of the present invention is discussed with reference to FIG. 8.

Figure 8:
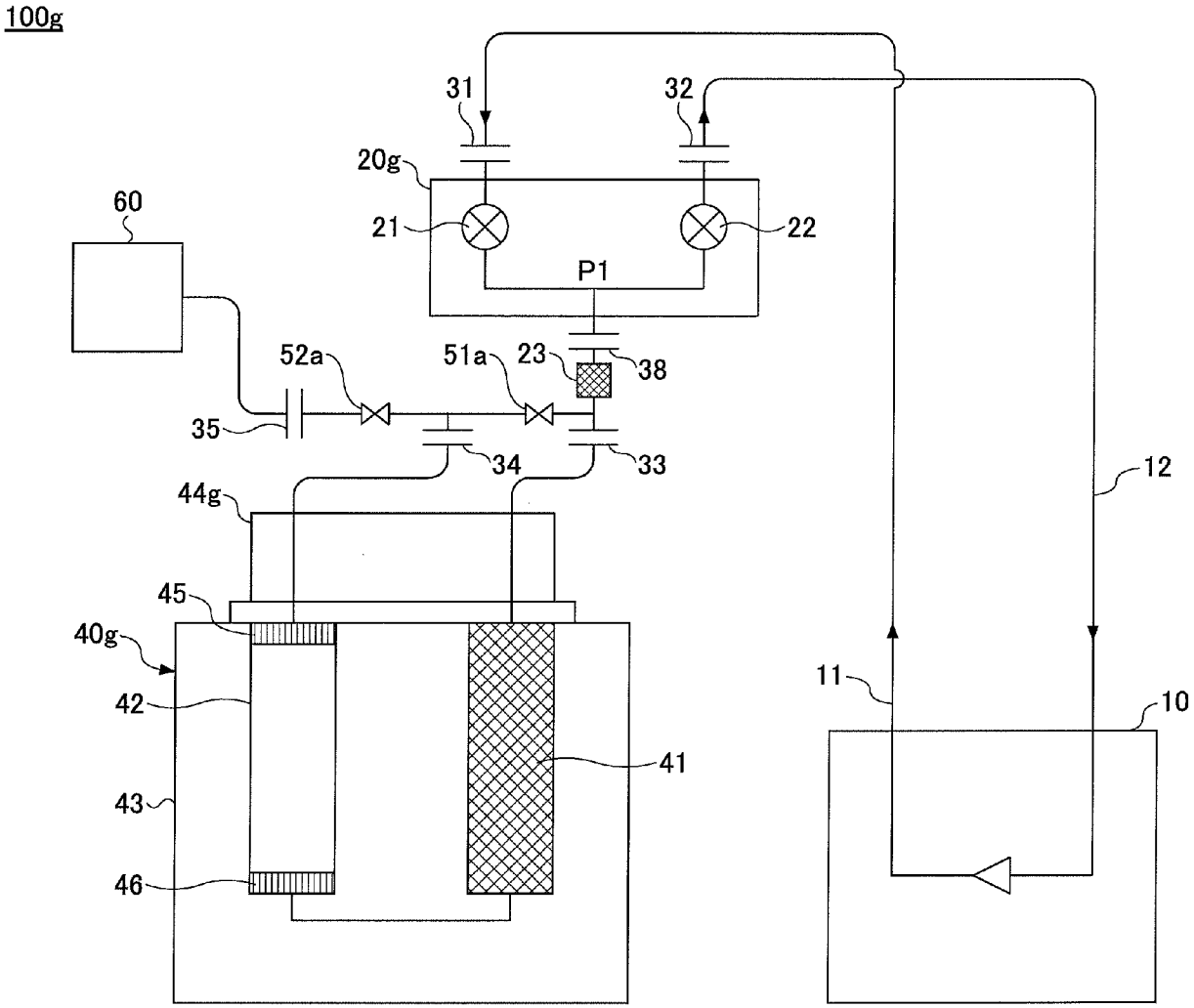
FIG. 8 is a schematic view of a structure of a pulse tube refrigerator of a seventh modified example of the first embodiment of the present invention.

FIG. 8 is a schematic view of a structure of a pulse tube refrigerator of the seventh modified example of the first embodiment of the present invention. In FIG. 8, parts that are the same as the parts shown in FIG. 1 through FIG. 7 are given the same reference numerals, and explanation thereof is omitted.

The pulse tube refrigerator of this modified example is different from that of the second modified example in that the first filter, the first orifice, and the second orifice are connected to the valve unit by the self seal joint in a state where the first filter, the first orifice, and the second orifice can be separated from the valve unit.

In the second modified example, the first filter, the first orifice, and the second orifice cannot be connected to the valve unit by the self seal joint. On the other hand, in the pulse tube refrigerator 100*g* shown in FIG. 8, the first filter 23, the first orifice 51*a*, and the second orifice 52*a* are provided outside the valve unit 20*g* and are connected to the valve unit

20*g* in a state where the first filter 23, the first orifice 51*a*, and the second orifice 52*a* can be separated from the valve unit 20*g* by using the eighth self seal joint 38.

As shown in FIG. 8, the structure of the pulse tube refrigerator 100*g* of this modified example is the same as that of the second modified example except structures of a valve unit 20*g* and the eighth self seal joint 38.

The first filter 23, the first orifice 51*a*, and the second orifice 52*a* are not included inside of the valve unit 20*g* of this modified example unlike the second modified example. The first filter 23, the first orifice 51*a*, and the second orifice 52*a* are provided outside the valve unit 20*g*.

In this modified example as well as the sixth modified example, the eighth self seal joint 38 is provided between the first joint point P1 and the compressor 10 side of the first filter 23 and between the valve unit 20*g* and the compressor side 10 of the first filter 23.

The operations for cooling the pulse tube refrigerator 100*g* and the operations for removing the wear dust by the filter in this modified example are the same as those in the second modified example. However, the maintenance operations of the filter without increasing the temperature of the cryogenic refrigerator in this modified example are different those in the second modified example on the following points.

First, operations of the pulse tube refrigerator 100*g* are stopped.

Then, a joint of the first self seal joint 31, the second self seal joint 32, the third self seal joint 33, the fourth self seal joint 34, and the fifth self seal joint 35 are disconnected. In addition, the joint of the eighth self seal joint 38 is disconnected so that the valve unit 20*g* and the first filter 23, and the first orifice 51*a* and the second orifice 52*a* are independently separated from the compressor 10 and the expander 40*g*.

After that, without disassembling the valve unit 20, the first filter 23, the first orifice 51*a*, and the second orifice 52*a* are exchanged for new ones. Substitution with the coolant gas is made and the first self seal joint 31, the second self seal joint 32, the third self seal joint 33, the fourth self seal joint 34, the fifth self seal joint 35, and the eighth self seal joint 38 are joined. As a result of this, the valve unit 20*g* is connected to the compressor 10 and the expander 40*g*.

Therefore, only the first filter 23, the first orifice 51*a*, and the second orifice 52*a* are separated. Hence, operations for disassembling and reassembling the valve unit 20*f* and for gas substitution are not necessary. Time for maintenance operations of the filter can be further reduced.

In this modified example, the first filter 23, the first orifice 51*a*, and the second orifice 52*a* may be provided with the eighth self seal joint 38 inside the valve unit 20*g*.

(Eighth Modified Example of the First Embodiment)

Next, a pulse tube refrigerator of an eighth modified example of the first embodiment of the present invention is discussed with reference to FIG. 9.

Figure 9:
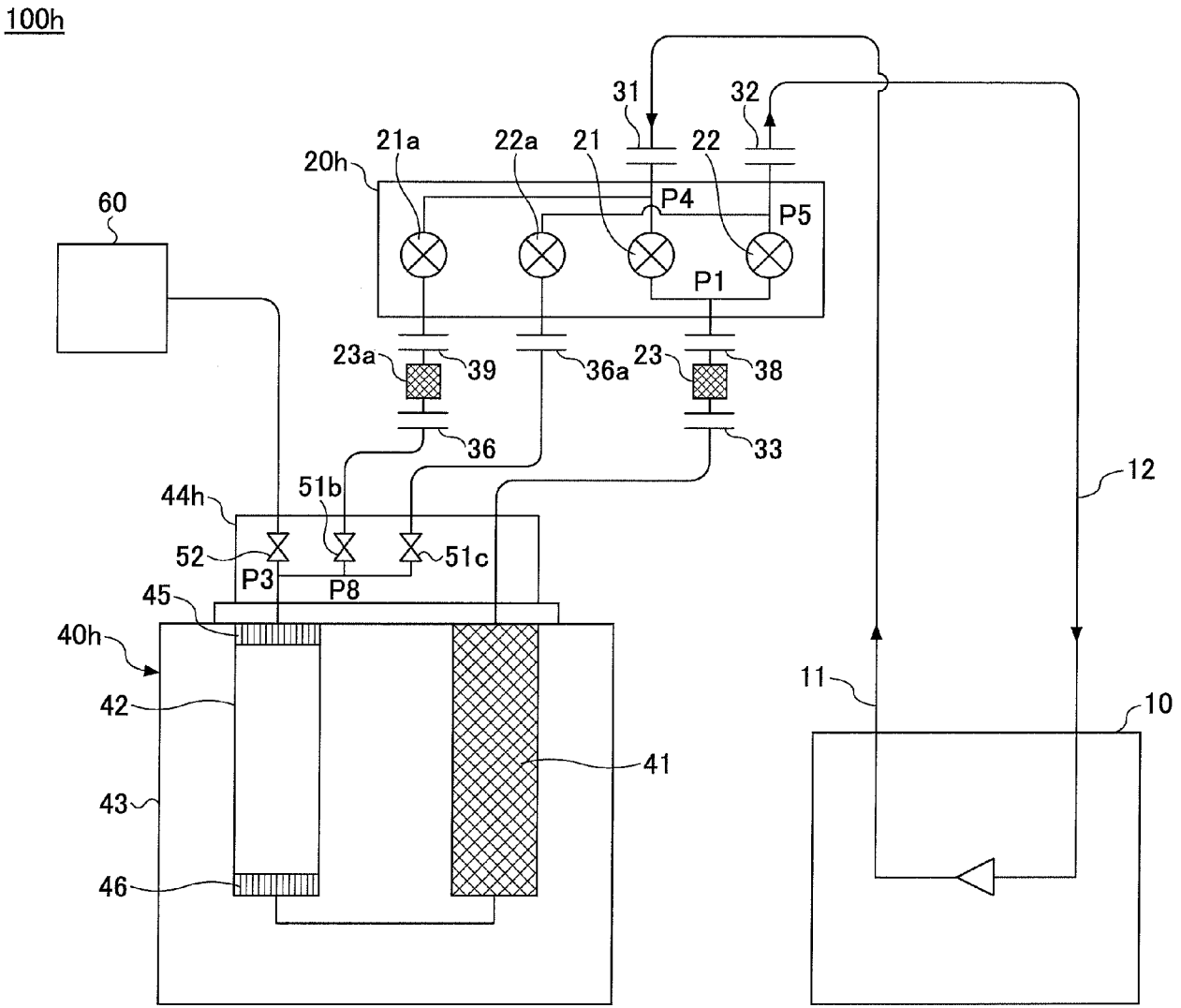
FIG. 9 is a schematic view of a structure of a pulse tube refrigerator of an eighth modified example of the first embodiment of the present invention.

FIG. 9 is a schematic view of the structure of a pulse tube refrigerator of the eighth modified example of the first embodiment of the present invention. In FIG. 9, parts that are the same as the parts shown in FIG. 1 through FIG. 8 are given the same reference numerals, and explanation thereof is omitted.

The pulse tube refrigerator of this modified example is different from that of the fourth modified example in that the first filter and the second filter are connected to the valve unit by using the self seal joints in a state where the first filter and the second filter can be separated from the valve unit.

In the fourth modified example, the first filter and the second filter cannot be separated from the valve unit by using the self seal joint. On the other hand, in the pulse tube refrigerator 100*h* of this modified example, a first filter 23 and the second filter 23*a* are provided outside the valve unit 20*h* and are connected to the valve unit 20*h* by using the eighth and ninth self seal joints 38 and 39 in a state where the first filter 23 and the second filter 23*a* can be separated from the valve unit 20*h*.

As shown in FIG. 7, the structure of the pulse tube refrigerator 100*h* of this modified example is the same as that of the fourth modified example except for structures of the valve unit 20*h*, the eighth self seal joint 38, and the ninth self seal joint 39.

The valve unit 20*h* of this modified example unlike the first embodiment does not include the first filter 23 and the second filter 23*a*. The first filter 23 and the second filter 23*a* are provided outside the valve unit 20*h*.

The eighth self seal unit 38 is provided between the first joint P1 and the compressor 10 side of the first filter 23 and between the valve unit 20*h* and the compressor 10 side of the first filter 23. This is the same as the sixth modified example of the first embodiment. In addition, the ninth self seal joint 39 is provided between the supply side of the second supply side valve 21*a* and the suction side of the second filter 23*a*.

The operations for cooling the pulse tube refrigerator 100*h* and the operations for removing the wear dust by the filter in this modified example are the same as those in the fourth modified example. However, the maintenance operations of the filter without increasing the temperature of the cryogenic refrigerator in this modified example are different from those in the fourth modified example.

In the maintenance operations of the pulse tube refrigerator 100*h*, operations of the pulse tube refrigerator 100*h* are stopped, and joints of the first self seal joint 31, the second self seal joint 32, the third self seal joint 33, and the sixth self seal joints 36 and 36*a* are disconnected. In addition, the joints of the eighth self seal joint 38 and the ninth self seal joint 39 are disconnected, and the valve unit 20*h*, the first filter 23, and the second filter 23*a* are independently separated from the compressor 10 and the expander 40*h*.

After that, without disassembling the valve unit 20*h*, the first filter 23 and the second filter 23*a* are exchanged for new ones and substitution of the coolant gas is made. The first self seal joint 31, the second self seal joint 32, the third self seal joint 33, the sixth self seal joints 36 and 36*a*, the eighth self seal joint 38, and the ninth self seal joint 39 are joined. As a result of this, the valve unit 20*h* is connected to the compressor 10 and the expander 40*h*.

Therefore, only the first filter 23, the first orifice 51*a*, and the second orifice 52*a* are separated. Hence, operations for disassembling and assembling the valve unit 20*h* and for gas substitution are not necessary. Time for maintenance operations of the filter can be further reduced.

In this modified example, the first filter 23 and the second filter 23*a* may be provided with the eighth self seal joint 38 and the ninth self seal joint 39 inside the valve unit 20*h*.

(Second Embodiment)

Next, a regenerative refrigerator of a second embodiment of the present invention is discussed with reference to FIG. 10.

Figure 10:
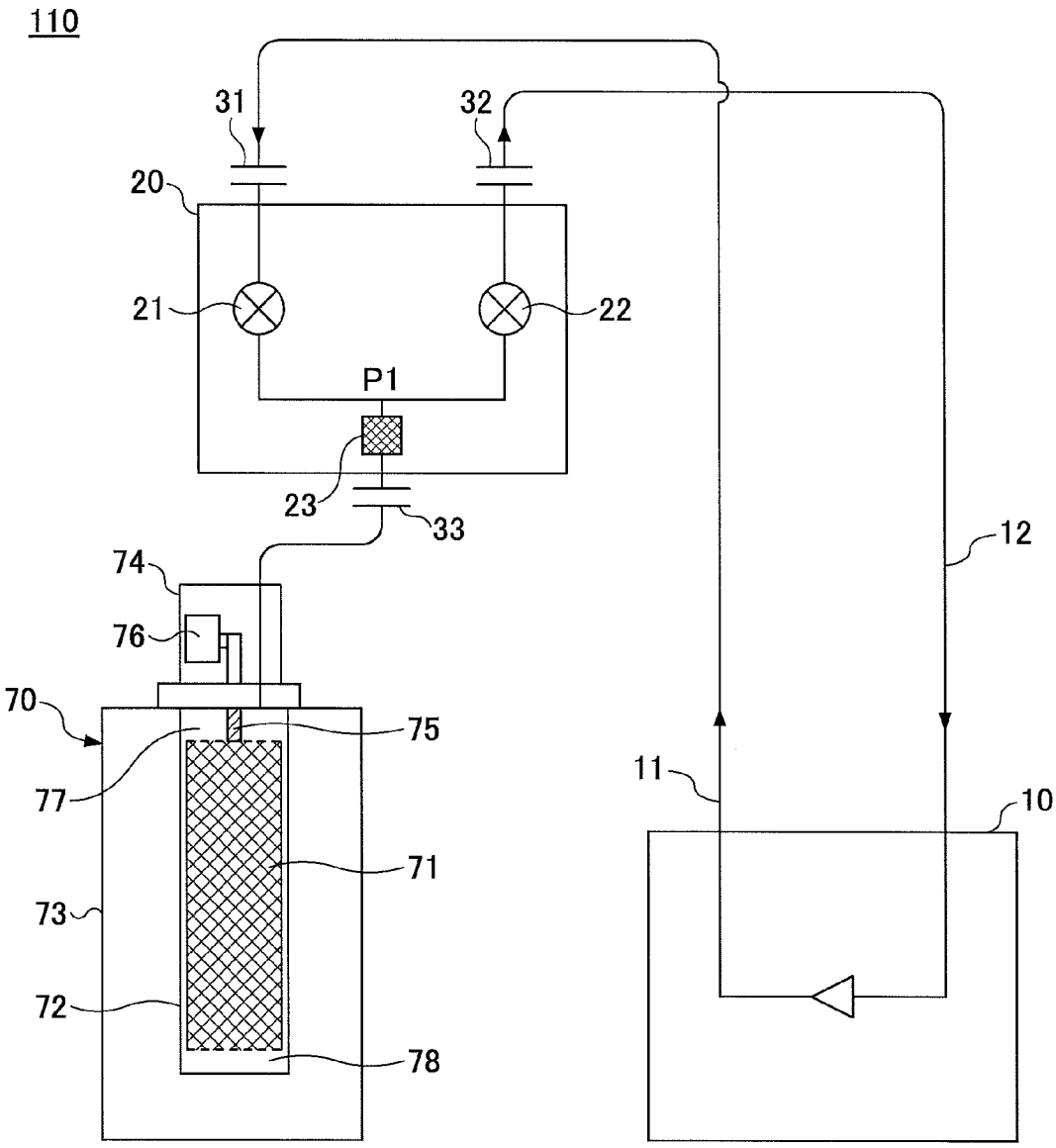
FIG. 10 is a schematic view of a structure of a regenerative refrigerator of a second embodiment of the present invention.

FIG. 10 is a schematic view of a structure of the regenerative refrigerator of the second embodiment of the present invention. In FIG. 10, parts that are the same as the parts shown in FIG. 1 through FIG. 9 are given the same reference numerals, and explanation thereof is omitted.

As shown in FIG. 10, the pulse tube refrigerator 110 of the second embodiment of the present invention includes the compressor 10, the valve unit 20, an expander 70, and others.

The cold storage type cryogenic cooler 110 is a single stage GM (Gifford-McMahon) cryogenic refrigerator.

The structure of the compressor 10 of this embodiment is the same as that of the first embodiment. In other words, the compressor 10 includes a high pressure pipe 11 and a low pressure pipe 12. The high pressure pipe 11 is provided at a supply side. The lower pressure pipe 12 is provided at a suction side. The compressor 10 is configured to receive the coolant gas from the expander 40 via the low pressure pipe 12 and supply the coolant gas to the expander 70 via the high pressure pipe 11 after the coolant gas is compressed.

The valve unit 20 of this embodiment is the same as that of the first embodiment. In other words, the valve unit 20 includes a supply side valve 21, a first filter 23, and a suction side valve 22.

By the supply side valve 21, the supply side of the compressor 10 and the high temperature end of the regenerator 71 are in communication with or blocked off from communication with each other. The first filter 23 is provided between the supply side of the supply side valve 21 and the high temperature end of the regenerator 71. The suction side valve 22 is connected to the first filter 23 via the joint point P1 which is an intermediate point between the supply side of the supply side valve 21 and the first filter 23. By the suction side valve 22, the high temperature end of the regenerator 71 and the suction side of the compressor 10 are in communication with or blocked off from each other.

The valve unit 20 is connected between the compressor 10 and the expander 70. By the valve unit 20, the high pressure pipe 11 and the low pressure pipe 12 are mutually connected to the expander 70.

The expander 70 includes the regenerator 71, a cylinder 72, a low temperature vessel 73, and a flange/power house unit 74.

The regenerator 71 is configured to store cooling generated by repeating adiabatic expansion of helium gas as coolant gas. In addition, since the regenerator 71 is used for the GM cryogenic refrigerator, the regenerator works as a displacer. The high temperature end of the regenerator 71 is connected to a motor 76 of the flange/pipe unit 74 by using a connection member 75 so as to be inserted in the cylinder 72.

A high temperature end of the cylinder 72 is connected to the flange/power house unit 74. The cylinder 72 is provided in the low temperature vessel 73. The cylinder 72 is used for adiabatic expansion of the coolant gas.

A space 77 is formed between the high temperature end of the cylinder 72 and the high temperature end of the regenerator 71. An expansion space 78 is formed between the low temperature end of the cylinder 72 and the low temperature end of the regenerator 71. The space 77 is in communication with the expansion space 78 via the inside of the regenerator 71. Furthermore, the space 77 is connected to the third filter 23 via the pipe in the flange/power house unit 74.

The first self seal joint 31 is provided between the supply side of the compressor 10 and the suction side of the suction side valve 21. In this example, the first self seal joint 31 is provided in a position where the high pressure pipe 11 situated at the supply side of the compressor 10 and the valve unit 20 where the supply side valve 21 is provided are connected to each other.

The second self seal joint 32 is provided between the supply side of the suction side valve 22 and the suction side of the compressor 10. In this example, the second self seal joint 32 is provided in a position where the low pressure pipe 12 situated at the suction side of the compressor 10 and the valve unit 20 where the suction side valve 22 is provided are connected to each other.

The third self seal joint 33 is provided between the regenerator 71 side of the first filter 23 and the high temperature end of the regenerator 71. In this example, the third self seal joint 33 is provided between the valve unit 20 where the first filter 23 is provided and the flange/power house unit 74.

Next, operations for cooling the regenerative refrigerator 110, operations for removing wear dust by the filter, and operations for performing maintenance operations of the filter without increasing the temperature of the cryogenic refrigerator, are discussed.

First, the operations for cooling the regenerative refrigerator 110 are discussed.

The regenerative refrigerator 110 having the above-discussed structure repeats the operations for communicating and blocking off between the supply side valve 21 and the suction side valve 22 provided in the valve unit 20. As a result of this, the space 77 and the expansion space 78 are switched to communicate with the high pressure pipe 11 or the low pressure pipe 12 so that the pressure change is generated.

In addition, the regenerator 71 is moved upward and downward via the connection member 75 by using the motor 76. As a result of this, volume change is generated in the space 77 and the expansion space 78 and thereby adiabatic expansion of the coolant gas is generated in the space 77 and the expansion space 78. Cooling generated at this time is stored in the regenerator 71 so that the low temperature end of the regenerator 71 is cooled.

Furthermore, in the second embodiment as well as the first embodiment, it is possible to perform the operations for removing the wear dust by the filter and the maintenance operations of the filter without increasing the temperature. In other words, it is possible to perform the maintenance operations of the filter 23 without taking the time for increasing the temperature of the expander 70 at the normal temperature and without entry of the impurities to the compressor 10.

Thus, according to the regenerative refrigerator of the second embodiment, the filter configured to remove the wear dust is connected between the compressor and the expander by using the self seal joints.

Therefore, in this case as well as the pulse tube refrigerator, it is possible to perform the maintenance operations of the filter without performing the operations for increasing the temperature of the cold storage cryogenic refrigerator at the normal temperature and the operations for substituting the gas.

In this modified example, as long as the first filter 23 is provided at the compressor 10 side compared to the third self seal joint 33, the first filter 23 may be arranged outside the valve unit 20.

(Third Embodiment)

Next, a pulse tube refrigerator of a third embodiment of the present invention is discussed with reference to FIG. 11.

Figure 11:
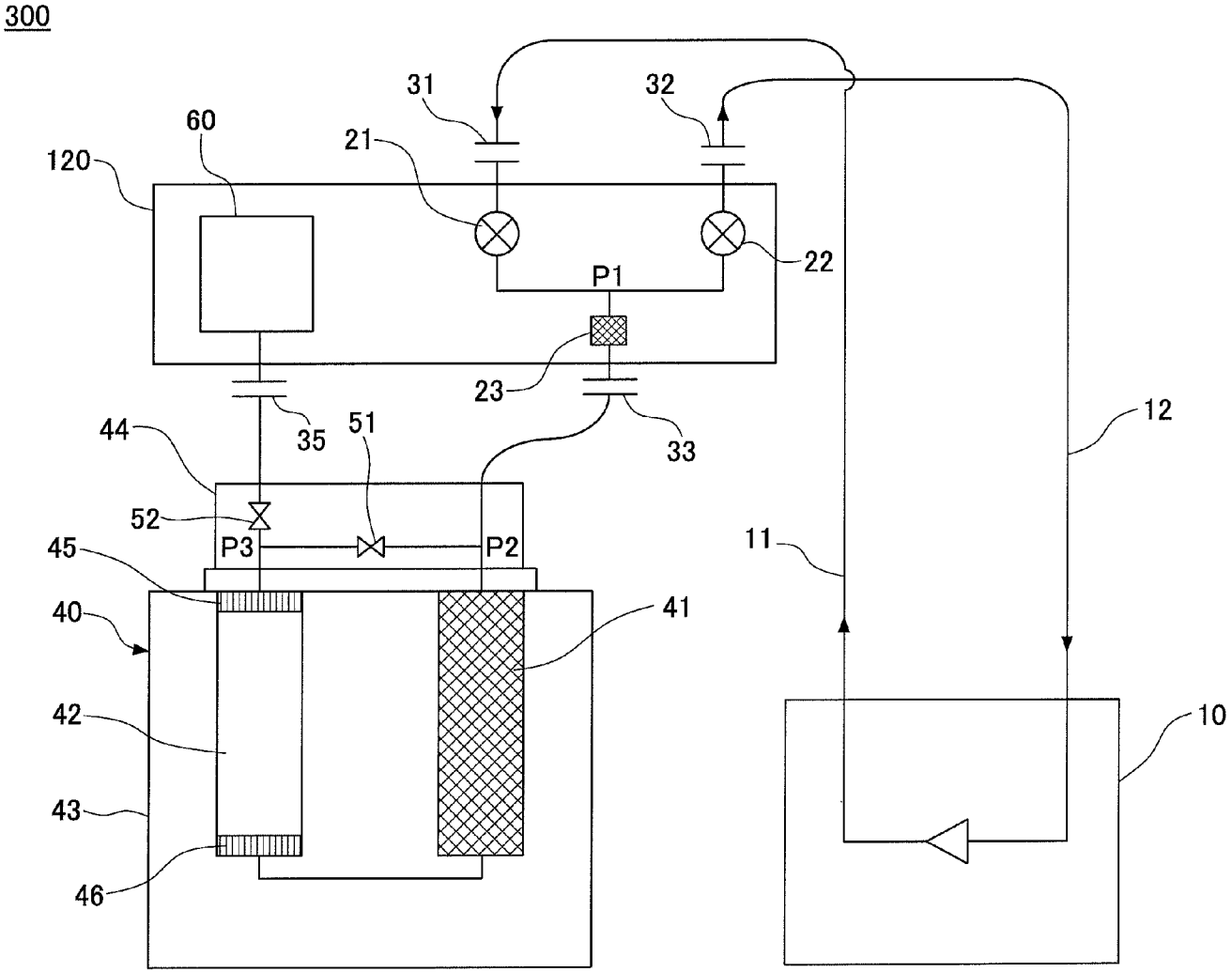
FIG. 11 is a schematic view of a structure of a pulse tube refrigerator of a third embodiment of the present invention.

FIG. 11 is a schematic view of a structure of a pulse tube refrigerator of the third embodiment of the present invention. In FIG. 11, parts that are the same as the parts shown in FIG. 1 through FIG. 10 are given the same reference numerals, and explanation thereof is omitted.

The pulse tube refrigerator of the third embodiment is different from that of the first embodiment in that a first buffer is mounted in the valve unit in the pulse tube refrigerator of the third embodiment.

In the first embodiment, the first buffer is separated from a part other than the first buffer including the valve unit of the pulse tube refrigerator. On the other hand, in the pulse tube refrigerator 300 of the third embodiment shown in FIG. 11, the first buffer is mounted in the valve unit and unified.

The pulse tube refrigerator 300 is a single stage pulse tube refrigerator and includes the compressor 10, the valve unit 120, an expander 40, and others.

The structure of the compressor 10 of this embodiment is the same as that of the first embodiment. In other words, the compressor 10 includes a high pressure pipe 11 and a low pressure pipe 12. The high pressure pipe 11 is provided at a supply side. The lower pressure pipe 12 is provided at a suction side. The compressor 10 is configured to receive the coolant gas from the expander 40 via the low pressure pipe 12 and supply the coolant gas to the expander 40 via the high pressure pipe 11 after the coolant gas is compressed.

The structure of the expander 40 of this embodiment is the same as that of the first embodiment. In other words, the expander 40 includes a first regenerator 41, a first pulse tube 42, a low temperature vessel 43, a flange/pipe unit 44, a first orifice 51, and a second orifice 52.

On the other hand, the valve unit 120 of this embodiment is different from that of the first embodiment. The valve unit 120 includes a supply side valve 21, a first filter 23, and a suction side valve 22.

By the supply side valve 21, the supply side of the compressor 10 and the high temperature end of the regenerator 41 are in communication with or blocked off from each other.

The first filter 23 is provided between the supply side of the supply side valve 21 and the high temperature end of the first regenerator 41.

The suction side valve 22 is connected to the first filter 23 via the joint point P1 which is an intermediate point between the supply side of the supply side valve 21 and the first filter 23. By the suction side valve 22, the high temperature end of the first regenerator 41 and the suction side of the compressor 10 are communication with or blocked off from each other.

In addition, the coolant gas flows between the first pulse tube 42 and the first buffer 60. The first buffer 60 is configured to control the phase difference of the pressure change and flow rate change of the coolant gas in the first pulse tube 42.

The valve unit 120 use the first self seal joint 31, the second self seal joint 32, the third self seal joint 33, and the fifth self seal unit 35. The valve unit 120 is connected to the compressor 10 and the expander 40 in a state where the valve unit 120 can be separated from the compressor 10 and the expander 40. The first buffer 60 mounted in the valve unit 120 is connected to the flange/pipe unit 44 in a state where the first buffer 60 can be separated from the flange/pipe unit 44 via the fifth self seal joint 35.

Furthermore, in the third embodiment as well as the first embodiment, it is possible to perform the operations for cooling the pulse tube refrigerator 300, the operations for removing the wear dust by the filter and the maintenance operations of the first filter 23 without increasing the temperature.

In addition, the pulse tube refrigerator 300 of the third embodiment has a structure where the first buffer 60 is mounted in the valve unit 120 and unified.

Although there is no limitation of the volume of the first buffer 60, the first buffer 60 may have a volume of, for example, 0.5 L through 1.0 L. Therefore, in this structure compared to a structure where the first buffer 60 is unified with the flange/pipe unit 44 of the expander 40, it is possible to miniaturize the expander 40 and reduce the height of the expander 40.

In addition, it is possible to make an area of the pulse tube refrigerator 300 of this embodiment small compared to the pulse tube refrigerator of the first embodiment where the first buffer and the expander are separated.

More specifically, in a case where the first buffer 60 is provided so as to be separated from the valve unit 20 of the first embodiment, the first buffer 60 having an area of 300 mm×150 mm and the valve unit 20 having an area of 300 mm×150 mm are provided in parallel. Accordingly, it is necessary to have an area of 600 mm×150 mm in total. On the other hand, in a case where the first buffer 60 is mounted so as to be stacked above the valve unit 120, necessary area is only 300 mm×150 mm and therefore it is possible to make the area small.

Thus, according to the pulse tube refrigerator of the third embodiment, it is possible to perform the maintenance operations of the filter without performing the operations for increasing the temperature of the pulse tube refrigerator at the normal temperature and the operations for substituting the gas. In addition, it is possible to miniaturize the pulse tube refrigerator.

(First Modified Example of the Third Embodiment)

Next, a pulse tube refrigerator of a first modified example of the third embodiment of the present invention is discussed with reference to FIG. 12.

Figure 12:
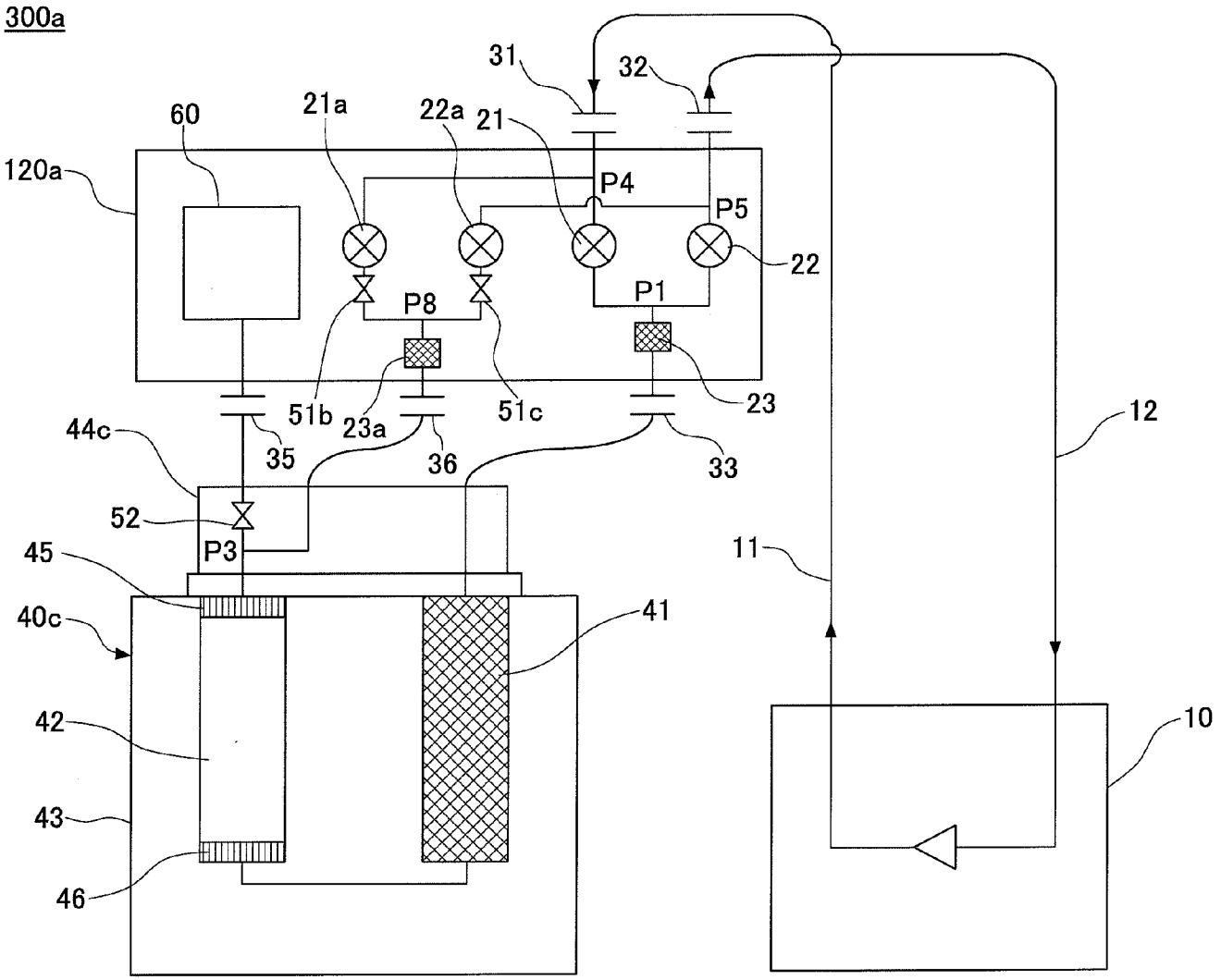
FIG. 12 is a schematic view of a structure of a pulse tube refrigerator of a first modified example of the third embodiment of the present invention.

FIG. 12 is a schematic view of a structure of a pulse tube refrigerator of the first modified example of the third embodiment of the present invention. In FIG. 12, parts that are the same as the parts shown in FIG. 1 through FIG. 11 are given the same reference numerals, and explanation thereof is omitted.

The pulse tube refrigerator of this modified example is different from that of the third embodiment shown in FIG. 11; it is a 4-valve 1-stage type pulse tube refrigerator.

In the pulse tube refrigerator shown in FIG. 11, the high temperature end of the first pulse tube is connected to the first supply side valve and the first suction side valve. On the other hand, in the pulse tube refrigerator 300*a* shown in FIG. 12, the high temperature end of the first pulse tube 42 is connected to the second supply side valve 21*a* and the second suction valve 22*a*.

In other words, the pulse tube refrigerator 300*a* of this modified example has a structure corresponding to a structure where the first buffer is mounted in the valve unit of the pulse tube refrigerator 100*c* of the third modified example of the first embodiment. Accordingly, the valve unit 120*a* of this modified example has a structure where the first buffer 60 is mounted in the valve unit 20*c* of the third modified example of the first embodiment. The first buffer 60 is connected to the flange/pipe unit 44C in a state where the first buffer 60 can be separated from the flange/pipe unit 44C via the fifth self seal joint 35 provided between the valve unit 120*a* and the expander 40*c*.

The expander forming the pulse tube refrigerator 300*a* of this modified example is the same as the expander 40*c* forming the pulse tube refrigerator 100*c* of the third modified example of the first embodiment.

The pulse tube refrigerator 300*a* of this modified example, as well as the above-discussed pulse tube refrigerator 300 of the third modified example, has a structure where the first buffer 60 is mounted in the valve unit 120*a* and unified. Accordingly, it is possible to perform the maintenance operations of the filter without performing the operations for increasing the temperature of the pulse tube refrigerator at the normal temperature and the operations for substituting the gas. In addition, it is possible to miniaturize the pulse tube refrigerator.

(Second Modified Example of the Third Embodiment)

Next, a pulse tube refrigerator of a second modified example of the third embodiment of the present invention is discussed with reference to FIG. 13.

Figure 13:
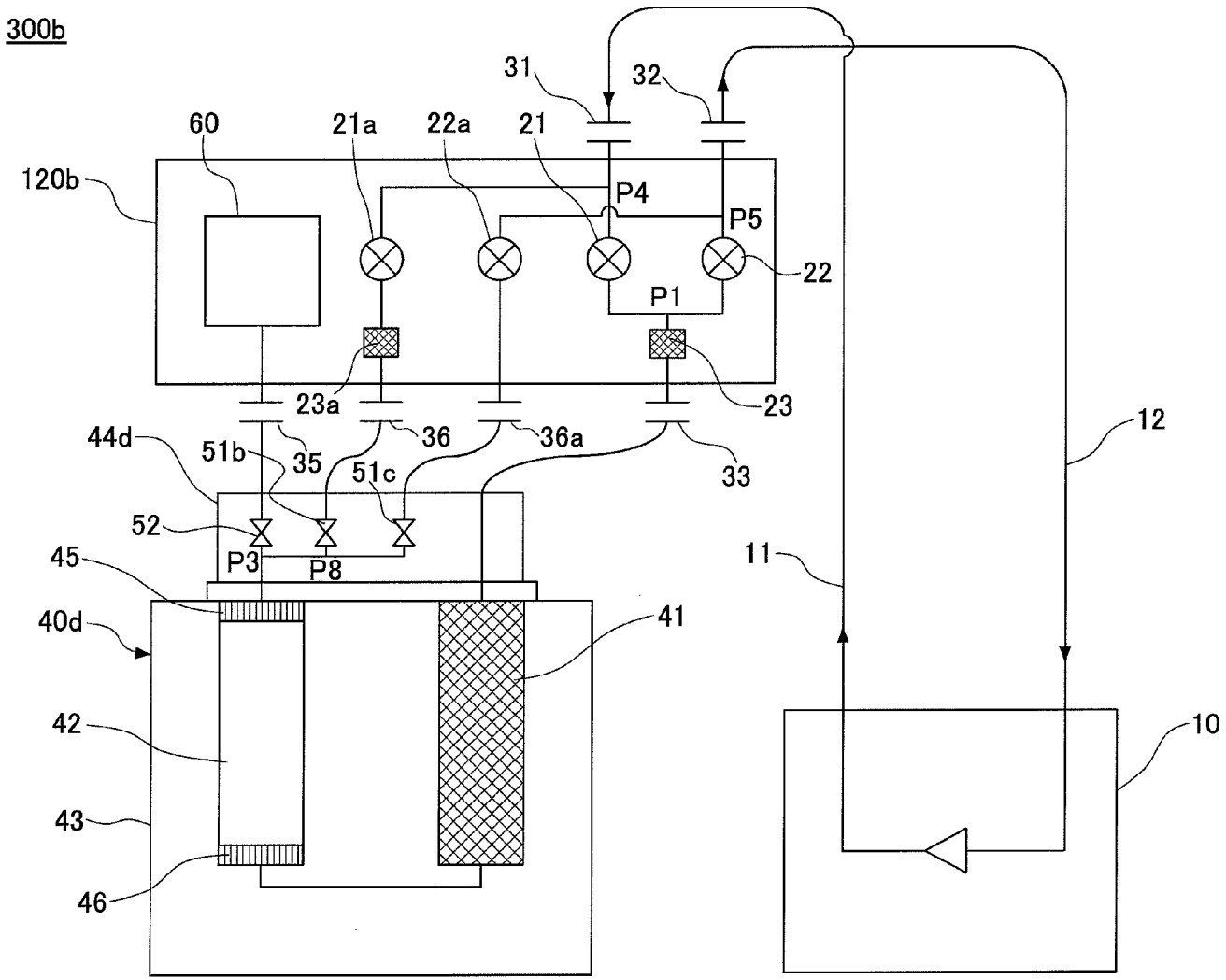
FIG. 13 is a schematic view of a structure of a pulse tube refrigerator of a second modified example of the third embodiment of the present invention.

FIG. 13 is a schematic view of a structure of a pulse tube refrigerator of the second modified example of the third embodiment of the present invention. In FIG. 13, parts that are the same as the parts shown in FIG. 1 through FIG. 12 are given the same reference numerals, and explanation thereof is omitted.

The pulse tube refrigerator of the this modified example is different from that of the first modified example of the third embodiment in that the second filter is connected to only the second supply side valve in this modified example.

In the first modified example of the third embodiment of the present invention, the second filter is switched to communicate with the second supply side valve or the second suction side valve. In the pulse tube refrigerator 300*d* of this modified example, the second filter 23*a* is not connected to the second suction side valve 22*a* but only to the second supply side valve 21*a*.

In other words, the pulse tube refrigerator 300*b* of this modified example has a structure corresponding to a structure where the first buffer is mounted in the valve unit of the pulse tube refrigerator 100*d* of the fourth modified example of the first embodiment. Accordingly, the valve unit 120*b* of this modified example has a structure where the first buffer 60 is mounted in the valve unit 20*d* of the fourth modified example of the first embodiment. The first buffer 60 is connected to the flange/pipe unit 44 in a state where the first buffer 60 can be separated from the flange/pipe unit 44 via the fifth self seal joint 35 provided between the valve unit 120*b* and the expander 44*d*.

The expander 40*d* forming the pulse tube refrigerator 300*b* of this modified example is the same as the expander 40*d* forming the pulse tube refrigerator 100*d* of the fourth modified example of the first embodiment.

The pulse tube refrigerator 300*b* of this modified example, as well as the pulse tube refrigerator 300 of the third modified example, has a structure where the first buffer 60 is mounted in the valve unit 120*b* and unified. Accordingly, it is possible to perform the maintenance operations of the filter without performing the operations for increasing the temperature of the pulse tube refrigerator at the normal temperature and the operations for substituting the gas. In addition, it is possible to miniaturize the pulse tube refrigerator.

(Third Modified Example of the Third Embodiment)

Next, a pulse tube refrigerator of a third modified example of the third embodiment of the present invention is discussed with reference to FIG. 14.

Figure 14:
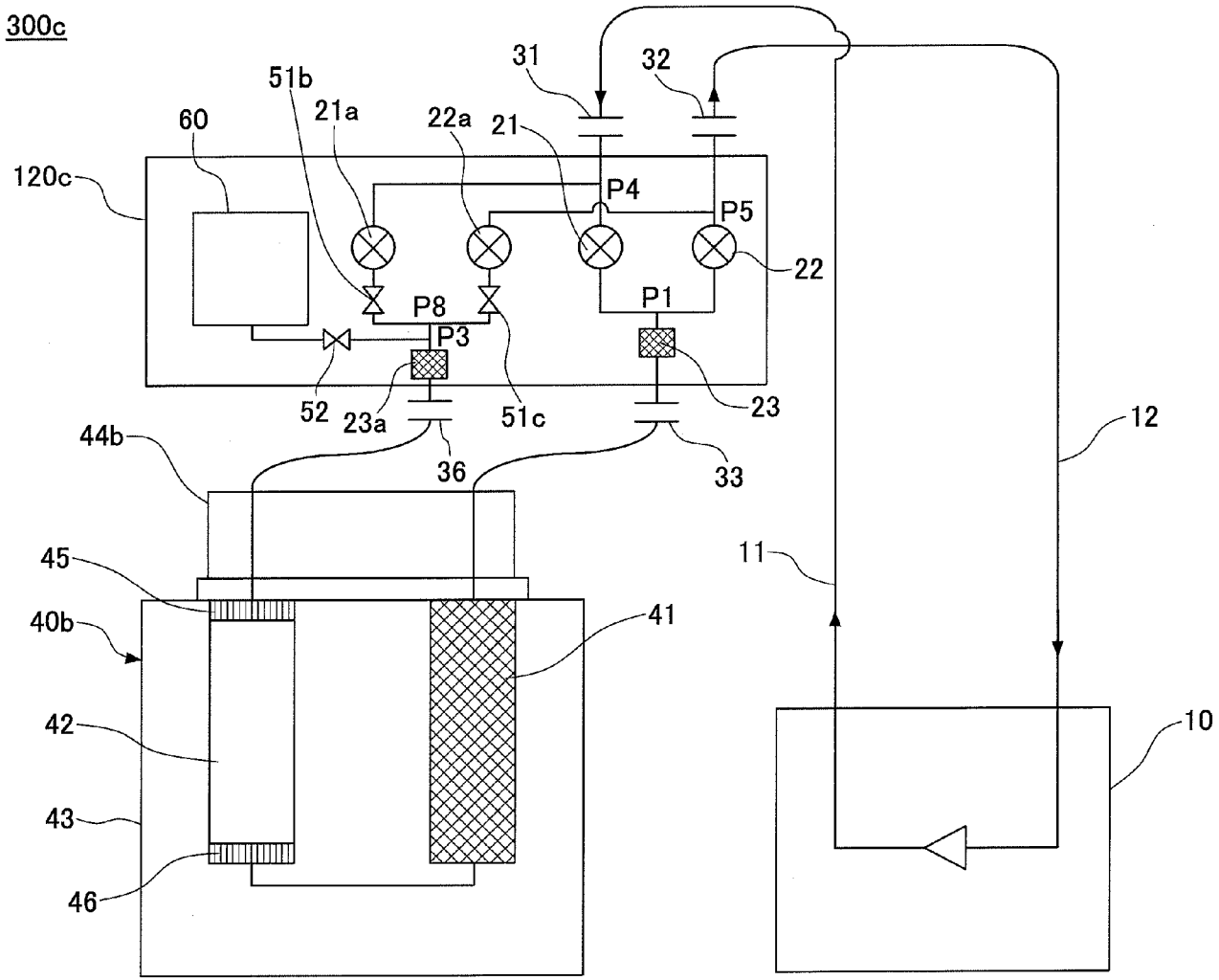
FIG. 14 is a schematic view of a structure of a pulse tube refrigerator of a third modified example of the third embodiment of the present invention.

FIG. 14 is a schematic view of a structure of a pulse tube refrigerator of the third modified example of the third embodiment of the present invention. In FIG. 14, parts that are the same as the parts shown in FIG. 1 through FIG. 13 are given the same reference numerals, and explanation thereof is omitted.

The pulse tube refrigerator of this modified example is different from the pulse tube refrigerator of the first modified example of the third embodiment in that a third joint point is situated inside the valve unit in the pulse tube refrigerator of this modified example.

In the first modified example of the third embodiment, the third joint point is situated inside the flange/pipe unit 44. On the other hand, in the pulse tube refrigerator 300*c* of this modified example, as shown in FIG. 14, the third joint point P3 is situated in the valve unit 120*c*.

More specifically, the first buffer 60 is joined at the third joint point P3 which is an intermediate point between the supply side of the second supply side valve 21*a* and the second filter 23*a*. The first buffer 60 is mounted inside the valve unit 120*c* with the second orifice 52 provided between the third joint point P3 and the first buffer 60.

As shown in FIG. 14, the structure of an expander forming the pulse tube refrigerator 300*c* of this modified example is the same as that of the expander 40*b* forming the pulse tube refrigerator 100*b* of the second modified example of the first embodiment.

The pulse tube refrigerator 300*c* of this modified example, as well as the pulse tube refrigerator 300 of the third modified example, has a structure where the first buffer 60 is mounted in the valve unit 120*c* and unified. Accordingly, it is possible to perform the maintenance operations of the filter without performing the operations for increasing the temperature of the pulse tube refrigerator at the normal temperature and the operations for substituting the gas. In addition, it is possible to miniaturize the pulse tube refrigerator.

In this modified example, the third joint point P3 is provided between the eighth joint point P8 and the compression apparatus 10 side of the second filter 23*a*. The third joint point P3 may be provided between the high temperature end of the first pulse tube 42 of the second filter 23*a* and the compressor 10 side of the sixth seal joint 36. In this case, the first buffer may be joined at the third joint point P3.

(Fourth Modified Example of the Third Embodiment)

Next, a pulse tube refrigerator of a fourth modified example of the third embodiment of the present invention is discussed with reference to FIG. 15.

Figure 15:
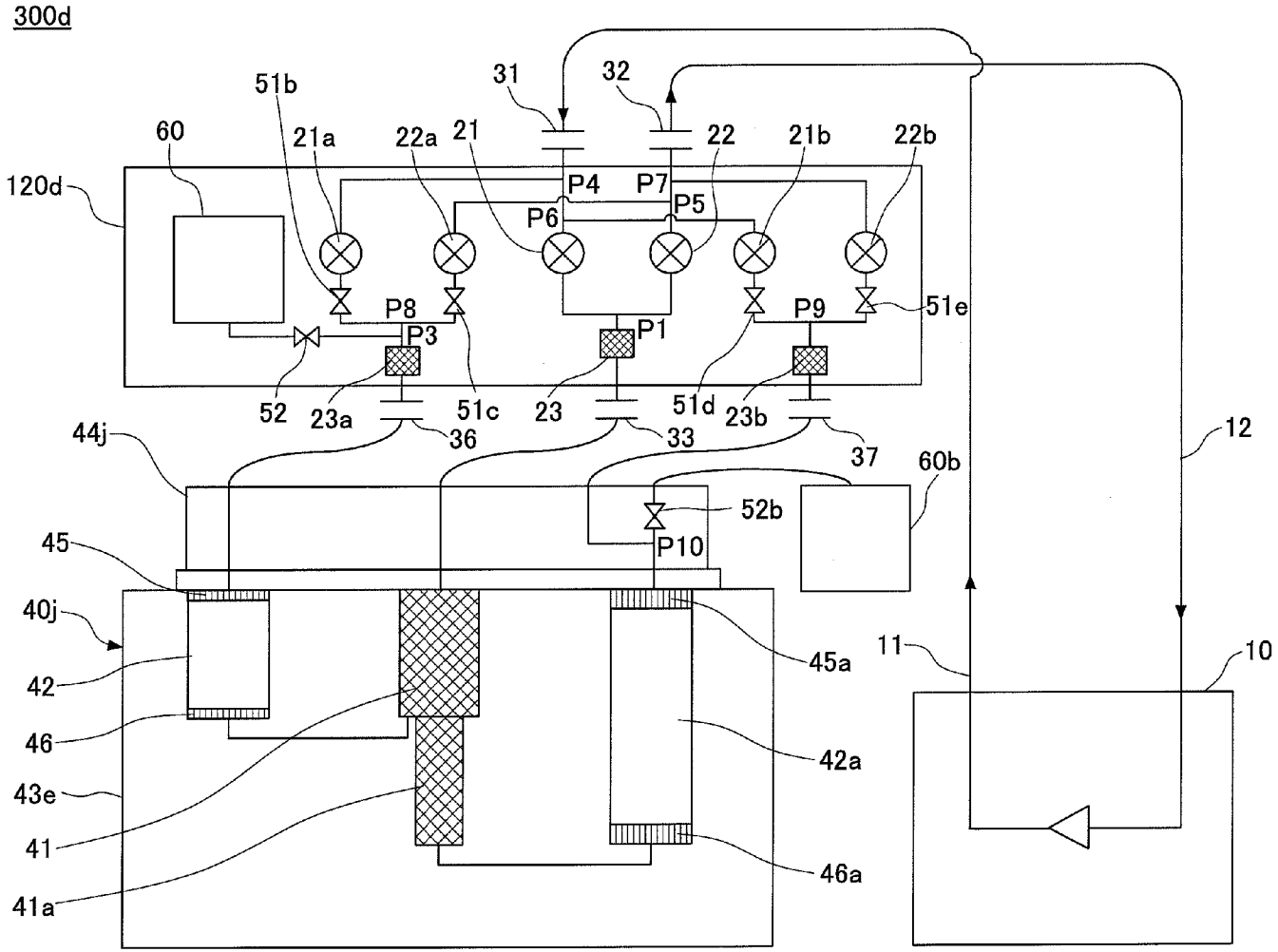
FIG. 15 is a schematic view of a structure of a pulse tube refrigerator of a fourth modified example of the third embodiment of the present invention.

FIG. 15 is a schematic view of a structure of a pulse tube refrigerator of the fourth modified example of the third embodiment of the present invention. In FIG. 15, parts that are the same as the parts shown in FIG. 1 through FIG. 14 are given the same reference numerals, and explanation thereof is omitted.

The pulse tube refrigerator of this modified example is different from the pulse tube refrigerator of the third modified example of the third embodiment in that the pulse tube refrigerator of this modified example is a 4-valve 2-stage type pulse tube refrigerator.

In the third modified example of the third embodiment of the present invention, the pulse tube refrigerator includes one stage of each of the regenerators and the pulse tubes. On the other hand, a pulse tube refrigerator 300*d* of this modified example includes two stages of each of the regenerators and the pulse tubes.

More specifically, the first buffer 60 is provided so as to be joined at the third joint point P3 being an intermediate point between the supply side of the second supply side valve 21*a* and the second filter 23*a*. The first buffer 60 with the second orifice 52 provided between the third joint point P3 and the first buffer 60 are mounted inside the valve unit 120*d*.

The pulse tube refrigerator 300*d* of this modified example, as well as the pulse tube refrigerator 300 of the third modified example, has a structure where the first buffer 60 is mounted in the valve unit 120*d* and unified. Accordingly, it is possible to perform the maintenance operations of the filter without performing the operations for increasing the temperature of the pulse tube refrigerator at the normal temperature and the operations for substituting the gas. In addition, it is possible to miniaturize the pulse tube refrigerator.

(Fifth Modified Example of the Third Embodiment)

Next, a pulse tube refrigerator of a fifth modified example of the third embodiment of the present invention is discussed with reference to FIG. 16.

Figure 16:
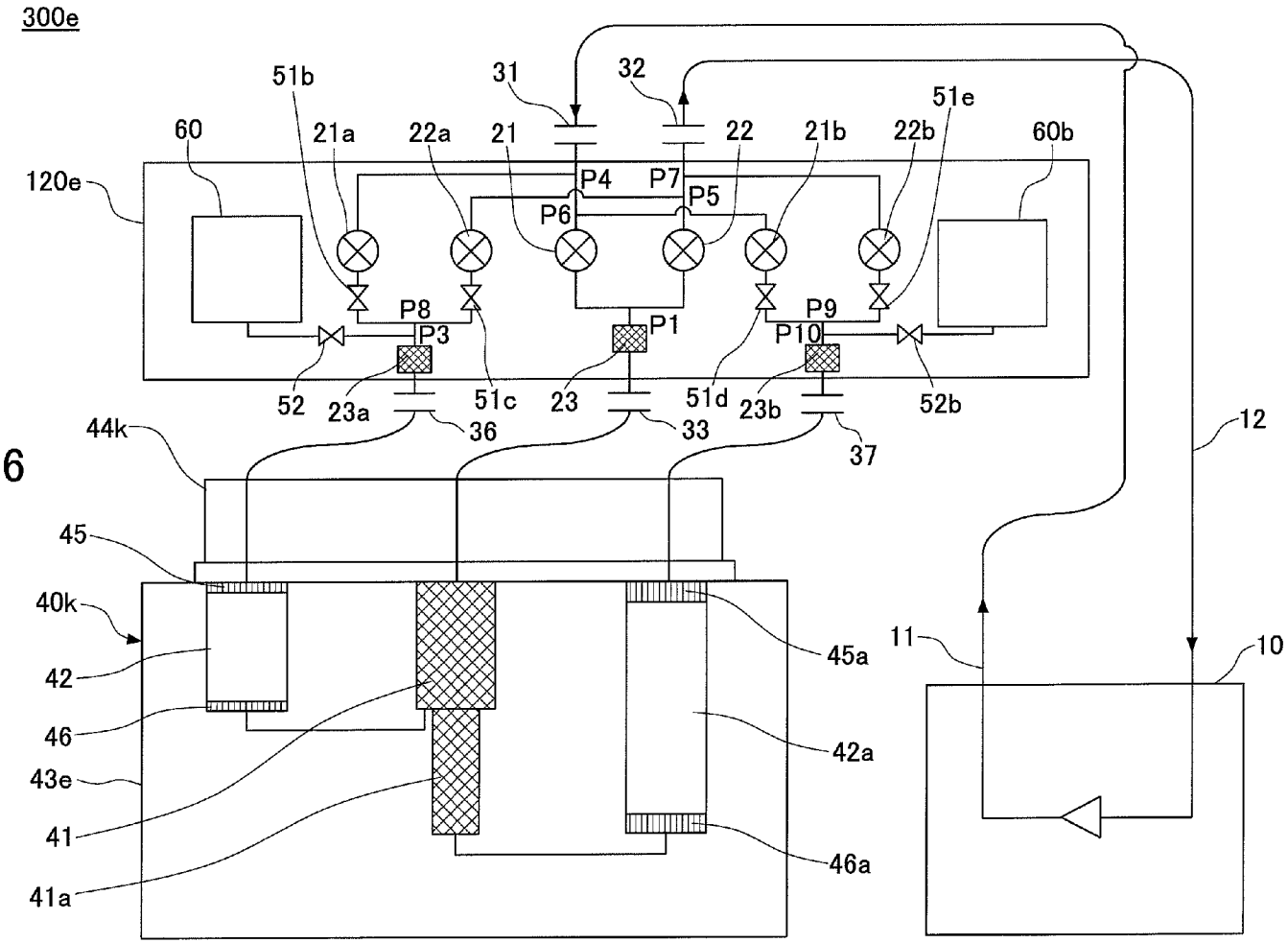
FIG. 16 is a schematic view of a structure of a pulse tube refrigerator of a fifth modified example of the third embodiment of the present invention.

FIG. 16 is a schematic view of a structure of a pulse tube refrigerator of the fifth modified example of the third embodiment of the present invention. In FIG. 16, parts that are the same as the parts shown in FIG. 1 through FIG. 15 are given the same reference numerals, and explanation thereof is omitted.

The pulse tube refrigerator of this modified example is different from the pulse tube refrigerator of the fourth modified example of the third embodiment in that the second buffer is also mounted in the valve unit in this modified example.

In the fourth modified example of the third embodiment, the second buffer corresponding to the second pulse tube is situated outside the valve unit. On the other hand, as shown in FIG. 16, in the pulse tube refrigerator 300*e* of this modified example, the second buffer 60*b* corresponding to the second pulse tube 42*a* is mounted in the valve unit 120*e*.

More specifically, the first buffer 60 is provided so as to be joined at the third joint point P3 being an intermediate point between the supply side of the second supply side valve 21*a* and the second filter 23*a*. The first buffer 60 and the second orifice 52 provided between the third joint point P3 and the first buffer 60 are mounted inside the valve unit 120*d*.

Similarly, the second buffer 60*b* is provided so as to be joined at the tenth joint point P10 being an intermediate point between the supply side of the third supply side valve 21*b* and the third filter 23*b*. The second buffer 60*b* with the second orifice 52*b* provided between the tenth joint point P10 and the second buffer 60*b* are mounted inside the valve unit 120*e*.

The pulse tube refrigerator 300*e* of this modified example has a structure where the first buffer 60 and the second buffer 60*b* are mounted in the valve unit 120*e* and unified. Accordingly, it is possible to perform the maintenance operations of the filter without performing the operations for increasing the temperature of the pulse tube refrigerator at the normal temperature and the operations for substituting the gas. In addition, it is possible to miniaturize the pulse tube refrigerator.

(Sixth Modified Example of the Third Embodiment)

Next, a pulse tube refrigerator of a sixth modified example of the third embodiment of the present invention is discussed with reference to FIG. 17.

Figure 17:
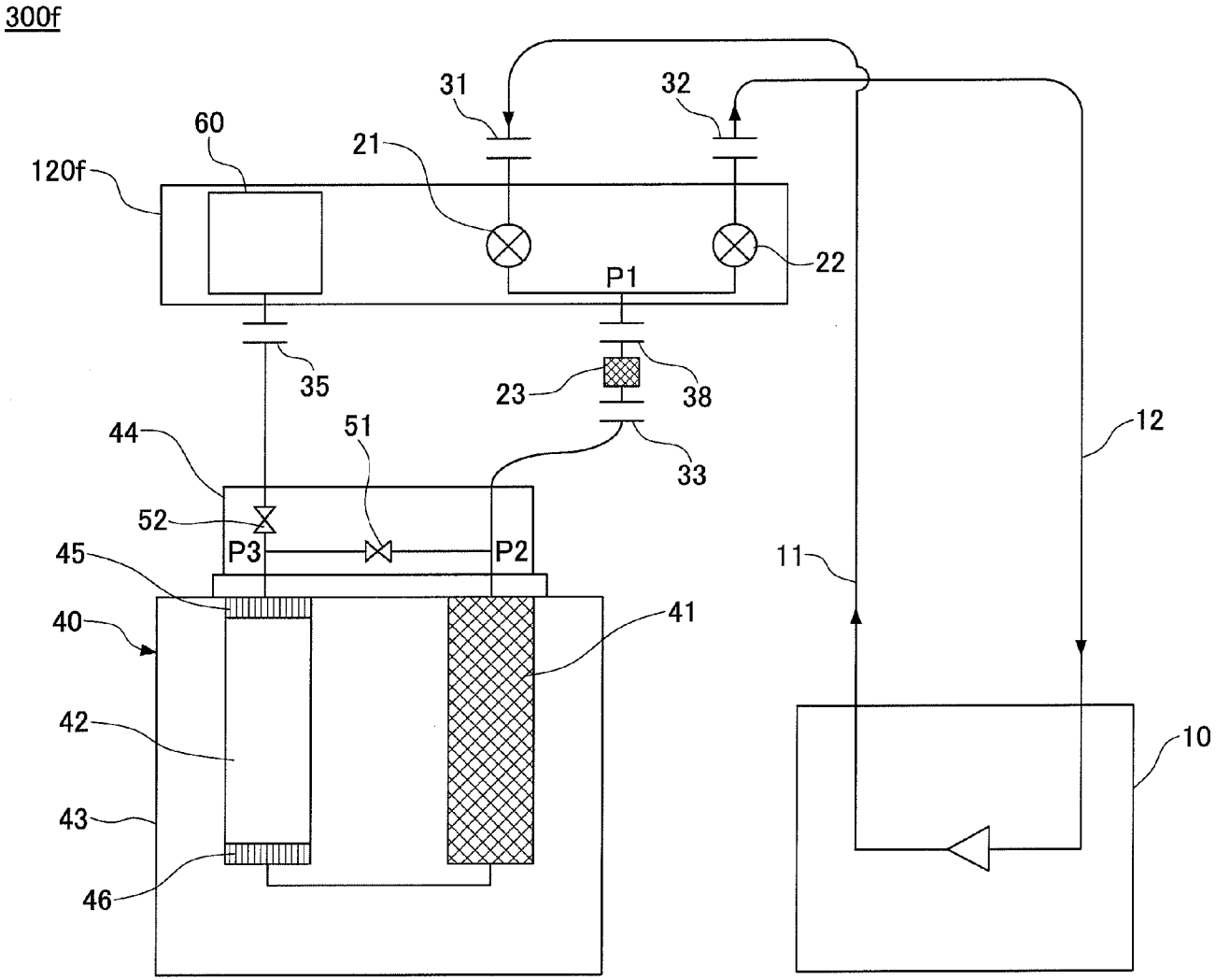
FIG. 17 is a schematic view of a structure of a pulse tube refrigerator of a sixth modified example of the third embodiment of the present invention.

FIG. 17 is a schematic view of a structure of a pulse tube refrigerator of the sixth modified example of the third embodiment of the present invention. In FIG. 17, parts that are the same as the parts shown in FIG. 1 through FIG. 16 are given the same reference numerals, and explanation thereof is omitted.

The pulse tube refrigerator of this modified example is different from the pulse tube refrigerator of the third embodiment in that the pulse tube refrigerator of this modified example has a structure where the first filter is connected to the valve unit in a state where the first filter can be separated from the valve unit by the self seal joint.

In the third modified example of the third embodiment of the present invention, the first filter cannot be separated from the valve unit by the self seal joint. On the other hand, in the pulse tube refrigerator 300*f* of this modified example as shown in FIG. 17, the first filter 23 is provided outside the valve unit 120*f*. The first filter 23 is connected to the valve unit 120*f* in a state where the first filter 23 can be separated from the valve unit 120*f* by the self seal joint 38.

The structure of the pulse tube refrigerator 300*f* of this modified example is the same as that of the third embodiment except for the structure of the valve unit 120*f* and the eighth self seal joint 38.

The valve unit 120*f* of this modified example unlike the third embodiment does not include the first filter 23. In this modified example, the first filter 23 is provided outside the valve unit 120*f*.

The third self seal joint 38 is provided between the first joint point P1 and the compressor side 10 side of the first filter 23. In this modified example, the eighth self seal joint 38 is provided between the valve unit 120*f* and the compressor side 10 side of the first filter 23.

In the pulse tube refrigerator 300*f* of this modified example, by only separating the first filter 23, operations for disassembling and reassembling the valve unit 120*f* and for gas substitution are not necessary. Time for maintenance operations of the filter can be further reduced. In addition, it is possible to miniaturize the pulse tube refrigerator by mounting the first buffer 60 in the valve unit 120*f*.

(Seventh Modified Example of the Third Embodiment)

Next, a pulse tube refrigerator of a seventh modified example of the third embodiment of the present invention is discussed with reference to FIG. 18.

Figure 18:
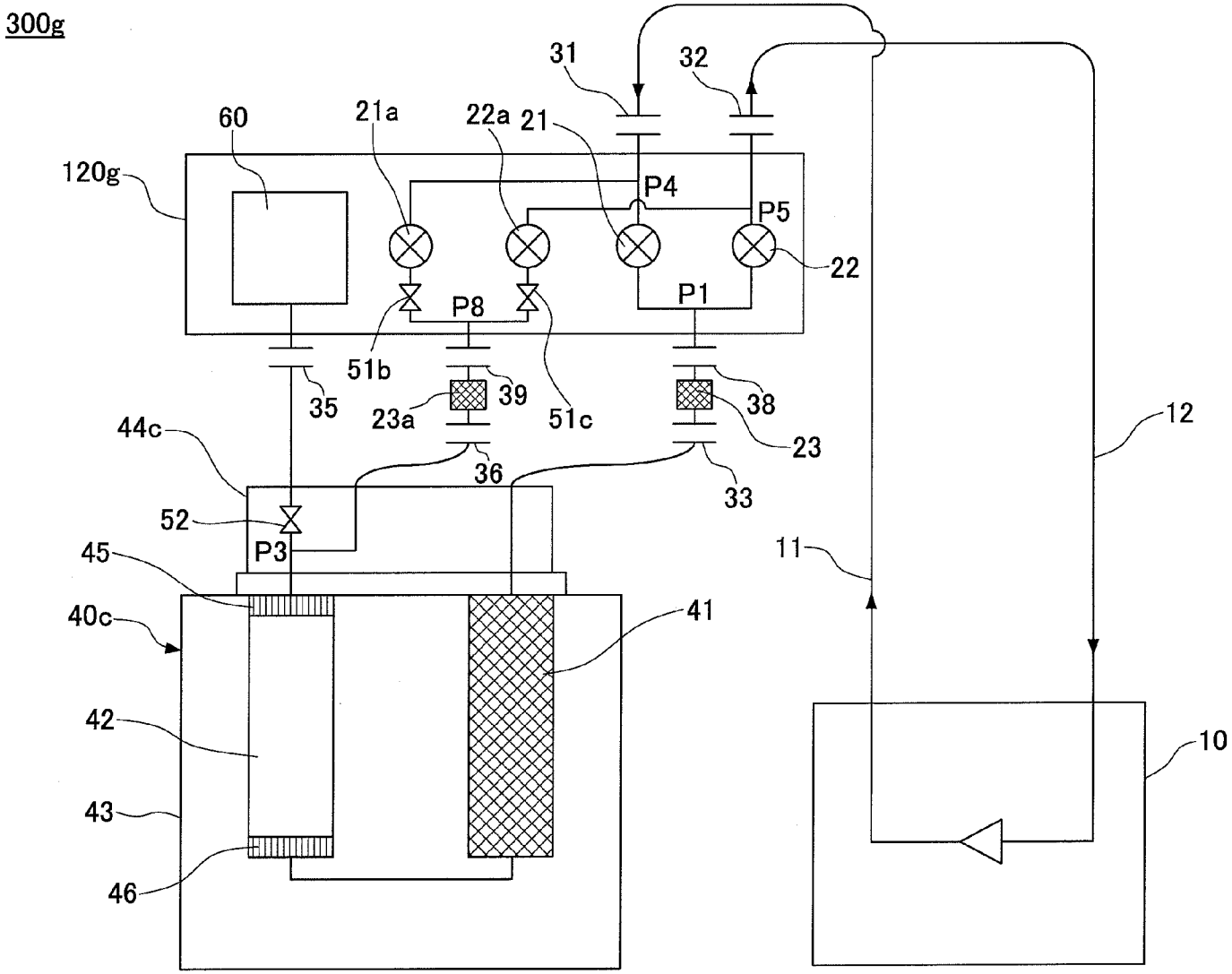
FIG. 18 is a schematic view of a structure of a pulse tube refrigerator of a seventh modified example of the third embodiment of the present invention.

FIG. 18 is a schematic view of a structure of a pulse tube refrigerator of the seventh modified example of the third embodiment of the present invention. In FIG. 18, parts that are the same as the parts shown in FIG. 1 through FIG. 17 are given the same reference numerals, and explanation thereof is omitted.

The pulse tube refrigerator of this modified example is different from the pulse tube refrigerator of the first modified example of the third embodiment in that the first filter and the second filter are connected to the valve unit in a state where the first filter and the second filter can be separated from the valve unit by the self seal joints.

In the first modified example of the third embodiment, the first filter and the second filter are stored in the valve unit. On the other hand, as shown in FIG. 18, in the pulse tube refrigerator 300*g* of this modified example, the first filter 23 and the second filter 23*a* are provided outside the valve unit 120*g*. The first filter 23 and the second filter 23*a* are connected to the valve unit 120*g* in a state where the first filter 23 and the second filter 23*a* can be separated from the valve unit 120*g* by the eighth self seal joint 38 and the ninth self seal joint 39, respectively.

As shown in FIG. 18, the structure of the pulse tube refrigerator 300*g* of this modified example is the same as that of the first modified example of the third embodiment except for structures of the valve unit 120*g*, the eighth self seal joint 38, and the ninth self seal joint 39.

The valve unit 120*g* of this modified example unlike the first modified example of the third embodiment does not include the first filter 23 and the second filter 23*a*. The first filter 23 and the second filter 23*a* are provided outside the valve unit 120*g*.

The eighth self seal joint 38 of this modified example as well as the sixth modified example of the third embodiment is provided between the first joint point P1 and the compressor side 10 of the first filter 23 and between the valve unit 120*g* and the compressor side 10 of the first filter 23. In addition, the ninth self seal joint 39 is provided between the eighth joint point P8 and the compressor side 10 of the second filter 23*a*.

In the pulse tube refrigerator 300*g* of this modified example, by only separating the first filter 23 and the second filter 23*a*, operations for disassembling and reassembling the valve unit 120*g* and for gas substitution are not necessary. Time for maintenance operations of the filter can be further reduced. In addition, it is possible to miniaturize the pulse tube refrigerator by mounting the first buffer 60 in the valve unit 120*g*.

(Eighth Modified Example of the Third Embodiment)

Next, a pulse tube refrigerator of an eighth modified example of the third embodiment of the present invention is discussed with reference to FIG. 19.

Figure 19:
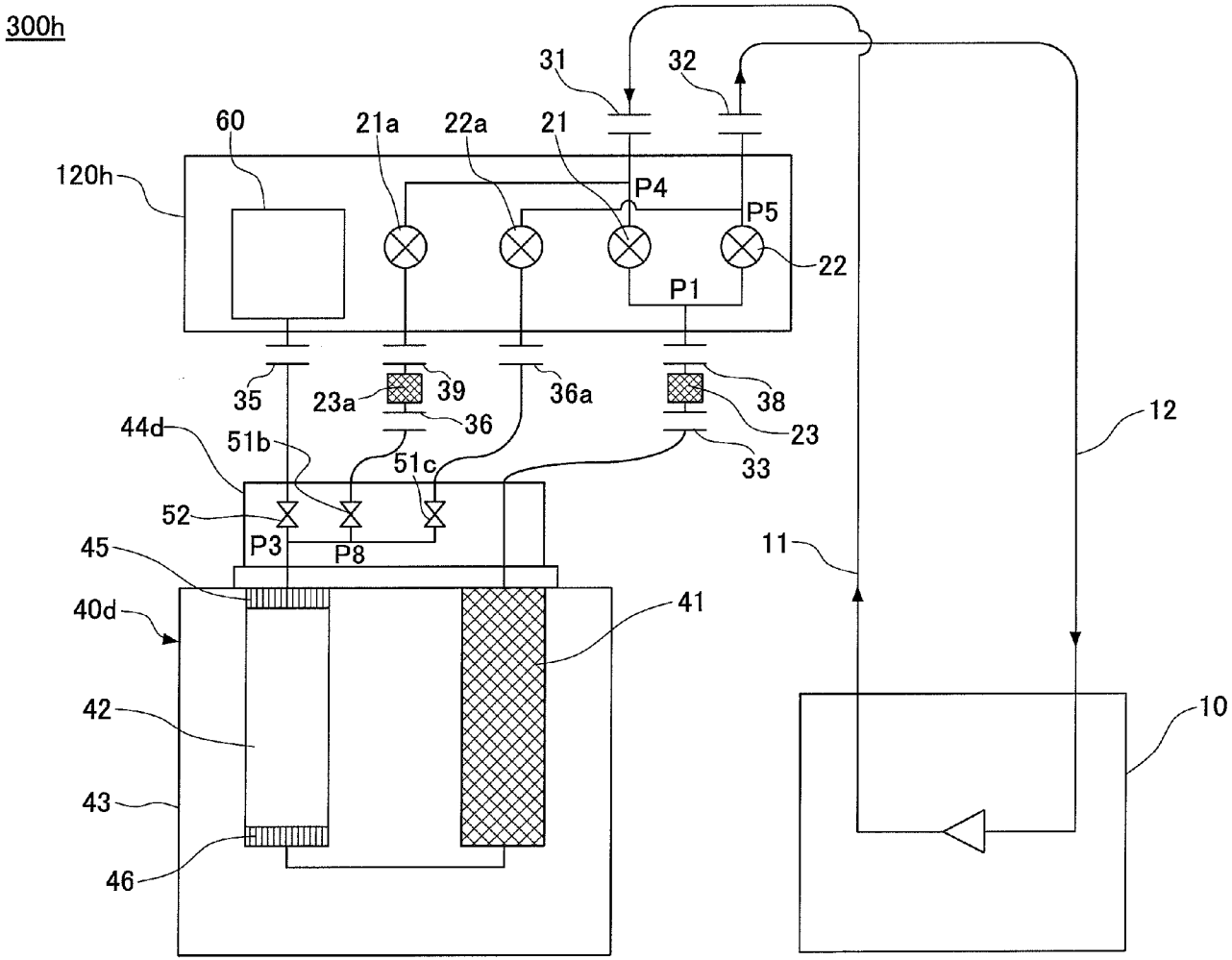
FIG. 19 is a schematic view of a structure of a pulse tube refrigerator of an eighth modified example of the third embodiment of the present invention.

FIG. 19 is a schematic view of a structure of a pulse tube refrigerator of the eighth modified example of the third embodiment of the present invention. In FIG. 19, parts that are the same as the parts shown in FIG. 1 through FIG. 18 are given the same reference numerals, and explanation thereof is omitted.

The pulse tube refrigerator of this modified example is different from the pulse tube refrigerator of the second modified example of the third embodiment in that the first filter and the second filter are connected to the valve unit in a state where the first filter and the second filter can be separated from the valve unit by the self seal joint.

In the second modified example of the third embodiment, the first filter and the second filter cannot be separated from the valve unit by the self seal joint. On the other hand, as shown in FIG. 19, in the pulse tube refrigerator 300*h* of this modified example, the first filter 23 and the second filter 23*a* are provided outside the valve unit 120*h*. The first filter 23 and the second filter 23*a* are connected to the valve unit 120*h* in a state where the first filter 23 and the second filter 23*b* can be separated from the valve unit 120*h* by the eighth self seal joint 38 and the ninth self seal joint 39, respectively.

As shown in FIG. 19, the structure of the pulse tube refrigerator 300*h* of this modified example is the same as that of the second modified example of the third embodiment except for the structures of the valve unit 120*h*, the eighth self seal joint 38, and the ninth self seal joint 39.

The valve unit 120*h* of this modified example unlike the second modified example of the third embodiment does not include the first filter 23 and the second filter 23*a*. The first filter 23 and the second filter 23*a* are provided outside the valve unit 120*h*.

The eighth self seal joint 38 of this modified example as well as the sixth modified example of the third embodiment is provided between the first joint point P1 and the compressor side 10 of the first filter 23 and between the valve unit 120*h* and the compressor side 10 of the first filter 23. In addition, the ninth self seal joint 39 of this modified example as well as the seventh modified example of the third embodiment is provided between the supply side of the second supply side valve 21*a* and the suction side of the second filter 23*a*.

In the pulse tube refrigerator 300*h* of this modified example, by only separating the first filter 23 and the second filter 23*a*, operations for disassembling and reassembling the valve unit 120*g* and for gas substitution are not necessary. Time for maintenance operations of the filter can be further reduced. In addition, it is possible to miniaturize the pulse tube refrigerator by mounting the first buffer 60 in the valve unit 120*h*.

(Ninth Modified Example of the Third Embodiment)

Next, a pulse tube refrigerator of a ninth modified example of the third embodiment of the present invention is discussed with reference to FIG. 20.

Figure 20:
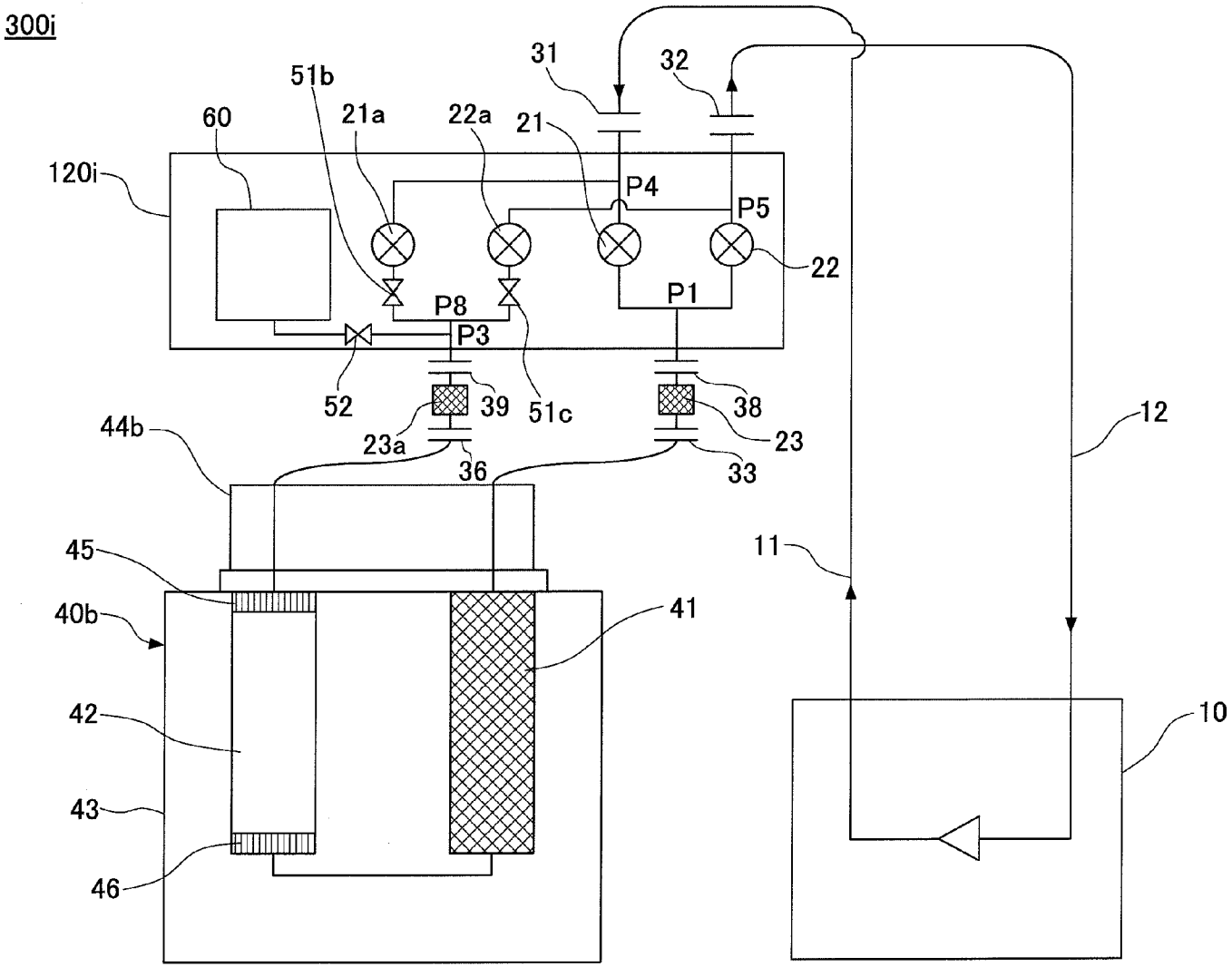
FIG. 20 is a schematic view of a structure of a pulse tube refrigerator of a ninth modified example of the third embodiment of the present invention.

FIG. 20 is a schematic view of a structure of a pulse tube refrigerator of the ninth modified example of the third embodiment of the present invention. In FIG. 20, parts that are the same as the parts shown in FIG. 1 through FIG. 19 are given the same reference numerals, and explanation thereof is omitted.

The pulse tube refrigerator of this modified example is different from the pulse tube refrigerator of the third modified example of the third embodiment in that the first filter and the second filter are connected to the valve unit in a state where the first filter and the second filter can be separated from the valve unit by the self seal joints.

In the third modified example of the third embodiment, the first filter and the second filter cannot be separated from the valve unit by the self seal joints. On the other hand, as shown in FIG. 20, in the pulse tube refrigerator 300*i* of this modified example, the first filter 23 and the second filter 23*a* are provided outside the valve unit 120*i*. The first filter 23 and the second filter 23*a* are connected to the valve unit 120*i* in a state where the first filter 23 and the second filter 23*b* can be separated from the valve unit 120*i* by the eighth self seal joint 38 and the ninth self seal joint 39, respectively.

As shown in FIG. 20, the structure of the pulse tube refrigerator 300*i* of this modified example is the same as that of the third modified example of the third embodiment except for the structures of the valve unit 120*i*, the eighth self seal joint 38, and the ninth self seal joint 39.

The valve unit 120*i* of this modified example unlike the third modified example of the third embodiment does not include the first filter 23 and the second filter 23*a*. The first filter 23 and the second filter 23*a* are provided outside the valve unit 120*i*.

The eighth self seal joint 38 of this modified example as well as the sixth modified example of the third embodiment is provided between the first joint point P1 and the compressor side 10 of the first filter 23 and between the valve unit 120*i* and the compressor side 10 of the first filter 23. In addition, the ninth self seal joint 39 is provided between the third joint point P3 and the suction side of the second filter 23*a*.

In the pulse tube refrigerator 300*i* of this modified example, by only separating the first filter 23 and the second filter 23*a*, operations for disassembling and reassembling the valve unit 120*i* and for gas substitution are not necessary. Time for maintenance operations of the filter can be further reduced. In addition, it is possible to miniaturize the pulse tube refrigerator by mounting the first buffer 60 in the valve unit 120*i*.

(Tenth Modified Example of the Third Embodiment)

Next, a pulse tube refrigerator of a tenth modified example of the third embodiment of the present invention is discussed with reference to FIG. 21.

Figure 21:
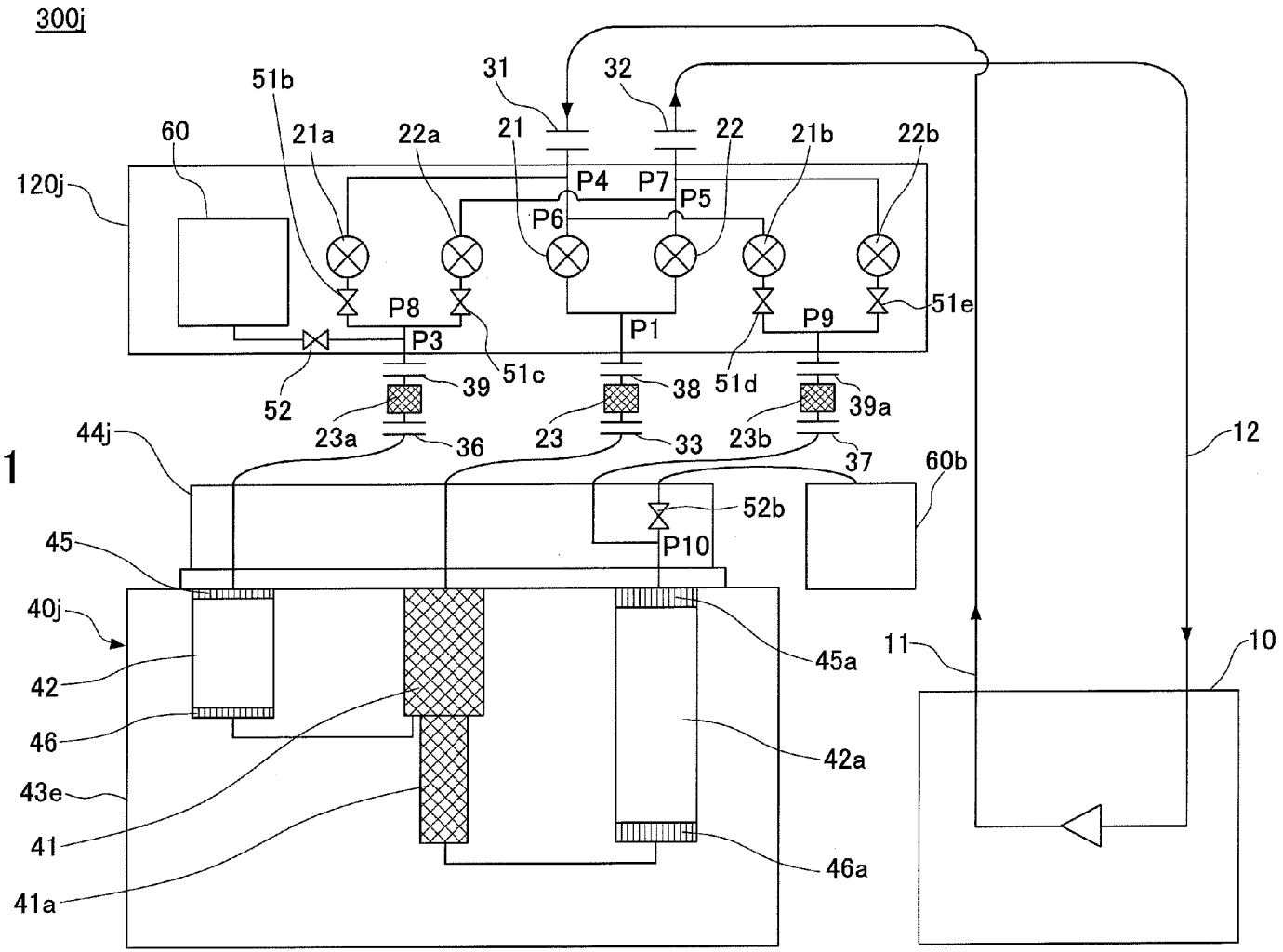
FIG. 21 is a schematic view of a structure of a pulse tube refrigerator of a tenth modified example of the third embodiment of the present invention.

FIG. 21 is a schematic view of a structure of a pulse tube refrigerator of the tenth modified example of the third embodiment of the present invention. In FIG. 21, parts that are the same as the parts shown in FIG. 1 through FIG. 20 are given the same reference numerals, and explanation thereof is omitted.

The pulse tube refrigerator of this modified example is different from the pulse tube refrigerator of the fourth modified example of the third embodiment in that the first filter, the second filter, and the third filter are connected to the valve unit in a state where the first filter, the second filter and the third filter can be separated from the valve unit by the self seal joints.

In the fourth modified example of the third embodiment, the first filter, the second filter, and the third filter cannot be separated from the valve unit by the self seal joint. On the other hand, as shown in FIG. 21, in the pulse tube refrigerator 300*j* of this modified example, the first filter 23, the second filter 23*a*, and the third filter 23*b* are provided outside the valve unit 120*j*. The first filter 23, the second filter 23*a*, and the third filter 23*b* are connected to the valve unit 120*j* in a state where the first filter 23, the second filter 23*a*, and the third filter 23*b* can be separated from the valve unit 120*j* by the eighth self seal joint 38, the ninth self seal joint 39, and the tenth self seal joint 39*a*, respectively.

As shown in FIG. 21, the structure of the pulse tube refrigerator 300*j* of this modified example is the same as that of the fourth modified example of the third embodiment except for the structures of the eighth self seal joint 38, the ninth self seal joint 39, and the tenth self seal joint 39*a*.

The valve unit 120*j* of this modified example unlike the fourth modified example of the third embodiment does not include the eighth self seal joint 38, the ninth self seal joint 39, and the tenth self seal joint 39*a*. The eighth self seal joint 38, the ninth self seal joint 39, and the tenth self seal joint 39*a* are provided outside the valve unit 120*i*.

The eighth self seal joint 38 of this modified example as well as the sixth modified example of the third embodiment is provided between the first joint point P1 and the compressor side 10 of the first filter 23 and between the valve unit 120*j* and the compressor side 10 of the first filter 23. In addition, the ninth self seal joint 39 is provided between the third joint point P3 and the suction side of the second filter 23*a*. Furthermore, the tenth self seal joint 39*a* is provided between the ninth joint point P9 and the compressor side 10 of the third filter 23*b*.

In the pulse tube refrigerator 300*j* of this modified example, by only separating the first filter 23, the second filter 23*a*, and the third filter 23*b*, operations for disassembling and reassembling the valve unit 120*j* and for gas substitution are not necessary. Time for maintenance operations of the filter can be further reduced. In addition, it is possible to miniaturize the pulse tube refrigerator by mounting the first buffer 60 in the valve unit 120*j*.

(Eleventh Modified Example of the Third Embodiment)

Next, a pulse tube refrigerator of an eleventh modified example of the third embodiment of the present invention is discussed with reference to FIG. 22.

Figure 22:
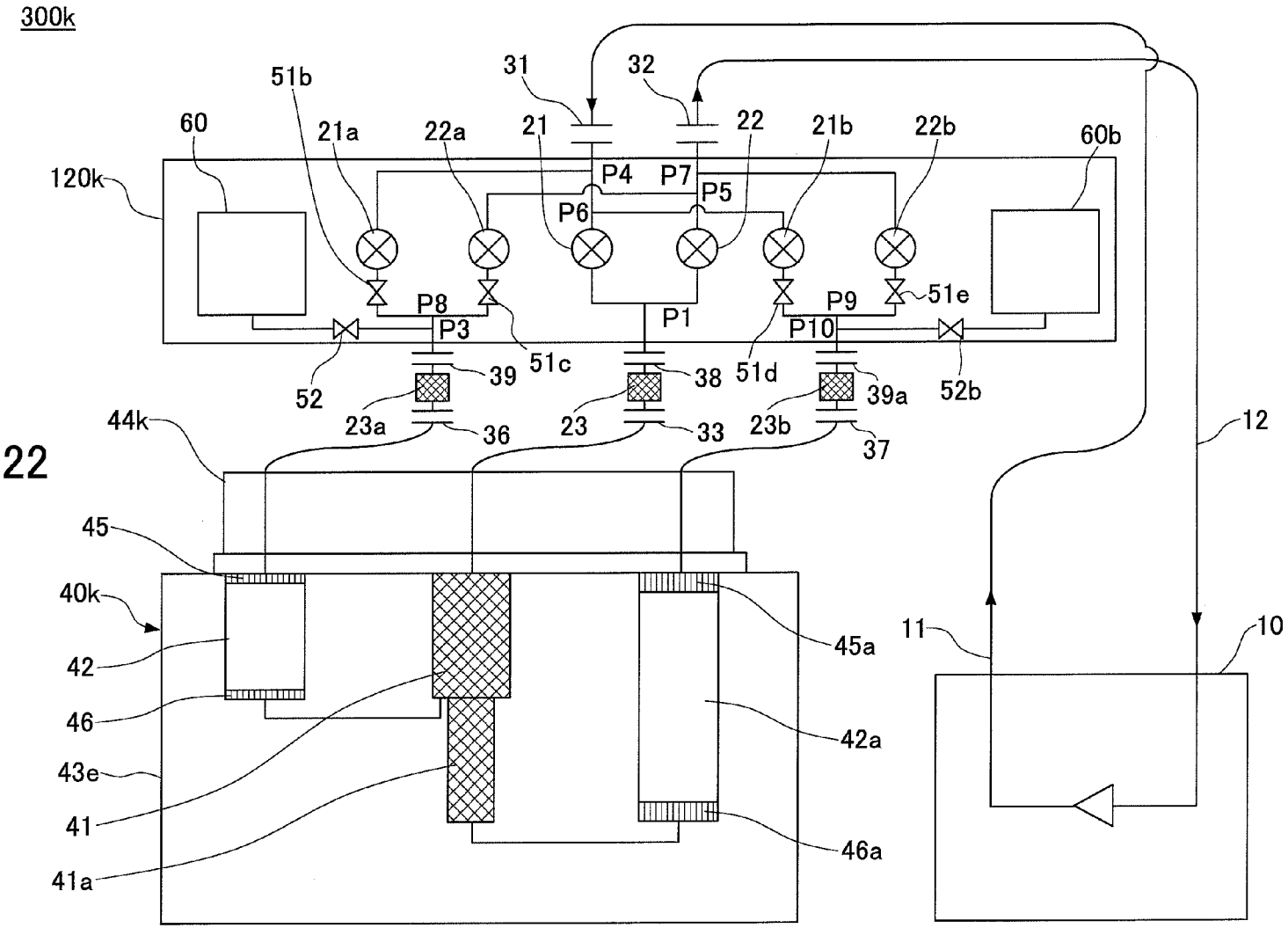
FIG. 22 is a schematic view of a structure of a pulse tube refrigerator of an eleventh modified example of the third embodiment of the present invention.

FIG. 22 is a schematic view of a structure of a pulse tube refrigerator of the eleventh modified example of the third embodiment of the present invention. In FIG. 22, parts that are the same as the parts shown in FIG. 1 through FIG. 21 are given the same reference numerals, and explanation thereof is omitted.

The pulse tube refrigerator of this modified example is different from the pulse tube refrigerator of the fifth modified example of the third embodiment in that the first filter, the second filter, and the third filter are connected to the valve unit in a state where the first filter, the second filter, and the third filter can be separated from the valve unit by the self seal joints.

In the fifth modified example of the third embodiment, the first filter, the second filter, and the third filter cannot be separated from the valve unit by the self seal joint. On the other hand, as shown in FIG. 22, in the pulse tube refrigerator 300*k* of this modified example, the first filter 23, the second filter 23*a*, and the second filter 23*b* are provided outside the valve unit 120*k*. The first filter 23, the second filter 23*a*, and the third filter 23*b* are connected to the valve unit 120*k* in a state where the first filter 23, the second filter 23*a*, and the third filter 23*b* can be separated from the valve unit 120*k* by the eighth self seal joint 38, the ninth self seal joint 39 and the tenth self seal joint 39*a*, respectively.

As shown in FIG. 22, the structure of the pulse tube refrigerator 300*k* of this modified example is the same as that of the fifth modified example of the third embodiment except for the structures of the eighth self seal joint 38, the ninth self seal joint 39, and the tenth self seal joint 39*a*.

The valve unit 120*k* of this modified example unlike the fifth modified example of the third embodiment does not include the eighth self seal joint 38, the ninth self seal joint 39, and the tenth self seal joint 39*a*. The eighth self seal joint 38, the ninth self seal joint 39, and the tenth self seal joint 39*a* are provided outside the valve unit 120*k*.

The eighth self seal joint 38 is provided between the first joint point P1 and the compressor side 10 of the first filter 23. In addition, the ninth self seal joint 39 is provided between the third joint point P3 and the compressor 10 side of the second filter 23*a*. Furthermore, the tenth self seal joint 39*a* is provided between the ninth joint point P9 and the compressor 10 side of the third filter 23*b*. These structures are the same as those of the tenth modified example of the third embodiment of the present invention.

In the pulse tube refrigerator 300*k* of this modified example, by only separating the first filter 23, the second filter 23*a*, and the third filter 23*b*, operations for disassembling and reassembling the valve unit 120*k* and for gas substitution are not necessary. Time for maintenance operations of the filter can be further reduced. In addition, it is possible to miniaturize the pulse tube refrigerator by mounting the first buffer 60 in the valve unit 120*k*.

(Twelfth Modified Example of the Third Embodiment)

Next, a pulse tube refrigerator of a twelfth modified example of the third embodiment of the present invention is discussed with reference to FIG. 23.

Figure 23:
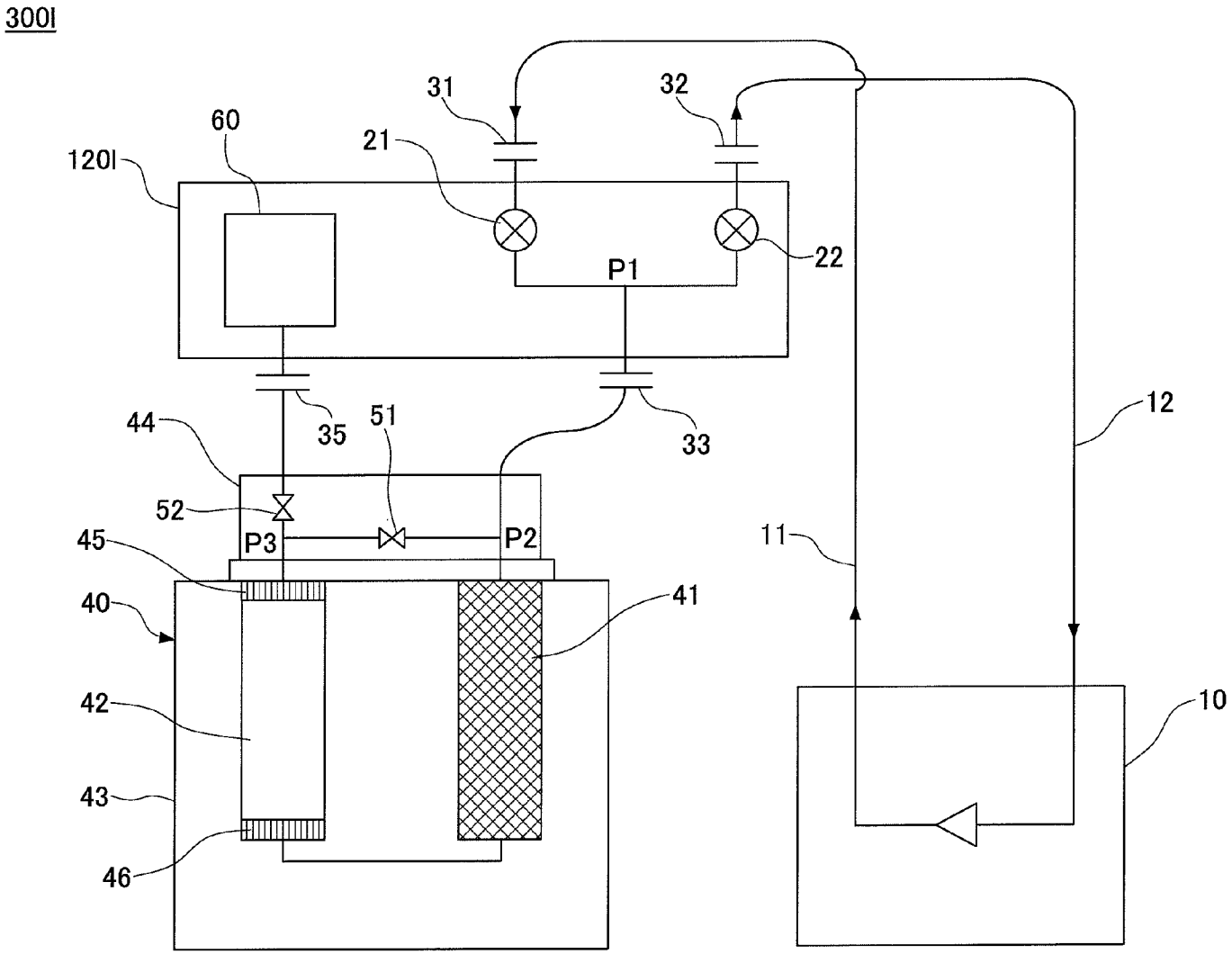
FIG. 23 is a schematic view of a structure of a pulse tube refrigerator of a twelfth modified example of the third embodiment of the present invention.

FIG. 23 is a schematic view of a structure of a pulse tube refrigerator of the twelfth modified example of the third embodiment of the present invention. In FIG. 23, parts that are the same as the parts shown in FIG. 1 through FIG. 22 are given the same reference numerals, and explanation thereof is omitted.

The pulse tube refrigerator of this modified example is different from the pulse tube refrigerator of the third embodiment in that the pulse tube refrigerator of this modified example does not include the first filter.

In the third embodiment, the first filter is provided in the pulse tube refrigerator. On the other hand, as shown in FIG. 23, the pulse tube refrigerator 300*l* of this modified example does not include the first filter 23.

As shown in FIG. 23, the structure of the pulse tube refrigerator 300*l* of this modified example is the same as that of the third embodiment except for the structure of the valve unit 120*l*.

The valve unit 120*l* of this modified example unlike the third embodiment does not include the first filter 23. Therefore, the first supply side valve 21 and the first suction side valve 22 mounted in the valve unit 120*l* are connected to the expander 40 in a state where the first supply side valve 21 and the first suction side valve 22 can be separated from the expander 40 by the third self seal joint 33.

The pulse tube refrigerator 300*l* of this modified example does not include the first filter. Therefore, it is difficult to completely remove the wear dust generated at the first supply side valve 21 and the first suction side valve 22 before the wear dust reach the regenerator or the pulse tube included in the expander.

However, the valve unit 120*l* is connected to the compressor 10 and the expander 40 in a state where the valve unit 120*l* can be easily separated from the compressor 10 and the expander 40 by using the first self seal joint 31, the second self seal joint 32, the third self seal joint 33, and the fifth self seal joint 35. At the time of separation, it is not necessary to increase the temperature of the first regenerator 41 and the first pulse tube 42 of the expander 40 at the normal temperature. Accordingly, even in the cooling operations, it is possible to easily perform the maintenance operations where the valve unit 120*l* is frequently separated from the compressor 10 and the expander 40 so that the wear dust in the vicinities of the first supply side valve 21 and the first suction side valve 22 are removed.

In addition, in the pulse tube refrigerator 300*l* of this modified example, the first buffer 60 is mounted in the valve unit 120 and unified. Accordingly, it is possible to make the size and height of the expander 40 small and low. Hence, it is possible to make the area where the pulse tube refrigerator 300*l* sits to be small.

Thus, according to the pulse tube refrigerator 300*l*, it is possible to easily perform the maintenance operations where the wear dust are removed and the pulse tube refrigerator can be miniaturized.

(Thirteenth Modified Example of the Third Embodiment)

Next, a pulse tube refrigerator of a thirteenth modified example of the third embodiment of the present invention is discussed with reference to FIG. 24.

Figure 24:
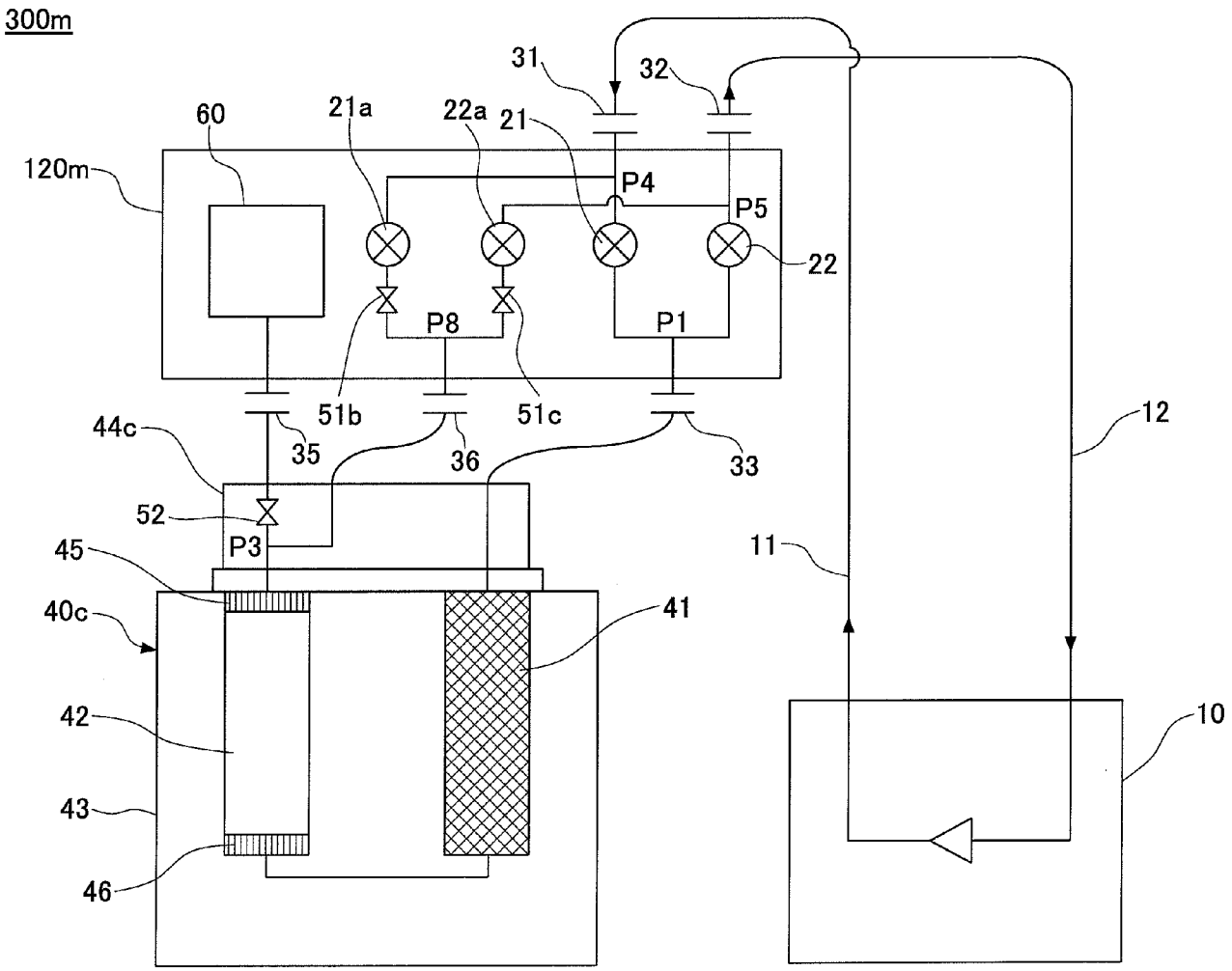
FIG. 24 is a schematic view of a structure of a pulse tube refrigerator of a thirteenth modified example of the third embodiment of the present invention.

FIG. 24 is a schematic view of a structure of a pulse tube refrigerator of the thirteenth modified example of the third embodiment of the present invention. In FIG. 24, parts that are the same as the parts shown in FIG. 1 through FIG. 23 are given the same reference numerals, and explanation thereof is omitted.

The pulse tube refrigerator of this modified example is different from the pulse tube refrigerator of the first modified example of the third embodiment in that the pulse tube refrigerator of this modified example does not include the first filter and the second filter.

In the first modified example of the third embodiment, the first filter and the second filter are provided in the pulse tube refrigerator. On the other hand, as shown in FIG. 24, the pulse tube refrigerator 300*m* of this modified example does not include the first filter and the second filter.

As shown in FIG. 24, the structure of the pulse tube refrigerator 300*m* of this modified example is the same as that of the first modified example of the third embodiment except for the structure of the valve unit 120*m*.

The valve unit 120*m* of this modified example unlike the first modified example of the third embodiment does not include the first filter and the second filter. Therefore, the first supply side valve 21, the first suction side valve 22, the second supply side valve 21*a*, and the second suction side valve 22*a* stored in the valve unit 120*m* are connected to the expander 40 in a state where the first supply side valve 21, the first suction side valve 22, the second supply side valve 21*a*, and the second suction side valve 22*a* can be separated from the expander 40 by the third self seal joint 33 and the sixth self seal joint 36.

In the pulse tube refrigerator 300*m* of this modified example as well as the twelfth modified example of the third embodiment, it is possible to easily perform the maintenance operations where the valve unit 120*m* is frequently separated from the compressor 10 and the expander 40*c* so that the wear dust in the vicinities of the first supply side valve 21, the first suction side valve 22, the second supply side valve 21*a*, and the second suction side valve 22*a* are removed.

In addition, in the pulse tube refrigerator 300*m* of this modified example, the first buffer 60 is mounted in the valve unit 120*m* and unified. Accordingly, it is possible to reduce the size and height of the expander 40*c*. Hence, it is possible to make the area where the pulse tube refrigerator 300*m* is located be small.

Thus, according to the pulse tube refrigerator 300*m*, it is possible to easily perform the maintenance operations where the wear dust are removed so that the pulse tube refrigerator can be miniaturized.

(Fourteenth Modified Example of the Third Embodiment)

Next, a pulse tube refrigerator of a fourteenth modified example of the third embodiment of the present invention is discussed with reference to FIG. 25.

Figure 25:
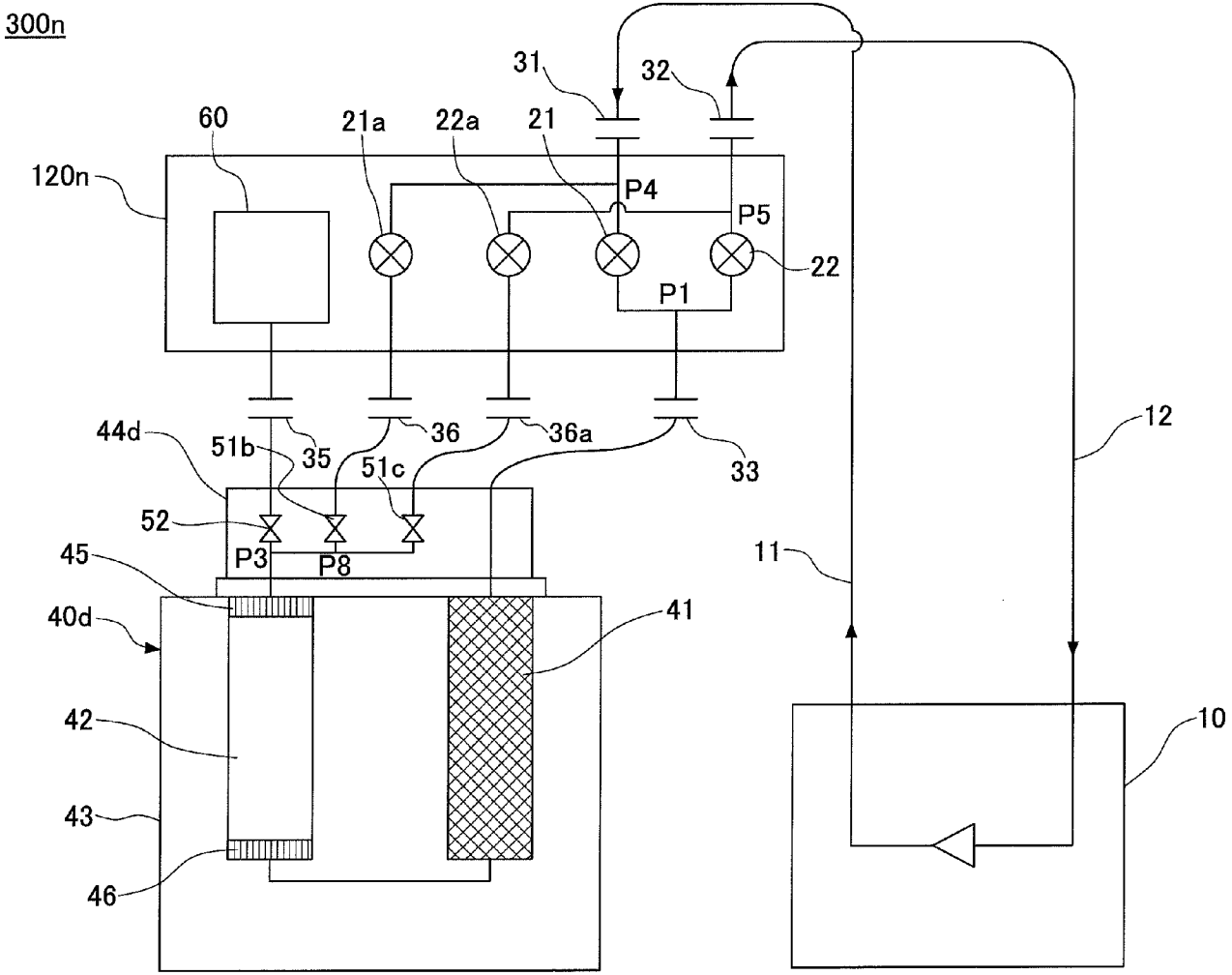
FIG. 25 is a schematic view of a structure of a pulse tube refrigerator of a fourteenth modified example of the third embodiment of the present invention.

FIG. 25 is a schematic view of a structure of a pulse tube refrigerator of the fourteenth modified example of the third embodiment of the present invention. In FIG. 25, parts that are the same as the parts shown in FIG. 1 through FIG. 24 are given the same reference numerals, and explanation thereof is omitted.

The pulse tube refrigerator of this modified example is different from the pulse tube refrigerator of the second modified example of the third embodiment in that the pulse tube refrigerator of this modified example does not include the first filter and the second filter.

In the second modified example of the third embodiment, the first filter and the second filter are provided in the pulse tube refrigerator. On the other hand, as shown in FIG. 25, the pulse tube refrigerator 300*n* of this modified example does not include the first filter and the second filter.

As shown in FIG. 25, the structure of the pulse tube refrigerator 300*n* of this modified example is the same as that of the second modified example of the third embodiment except for the structure of the valve unit 120*n*.

The valve unit 120*n* of this modified example unlike the second modified example of the third embodiment does not include the first filter and the second filter. Therefore, the first supply side valve 21, the first suction side valve 22, the second supply side valve 21*a*, and the second suction side valve 22*a* mounted in the valve unit 120*n* are connected to the expander 40*d* in a state where the first supply side valve 21, the first suction side valve 22, the second supply side valve 21*a*, and the second suction side valve 22*a* can be separated from the expander 40*d* by the third self seal joint 33 and the sixth self seal joints 36 and 36*a*.

In the pulse tube refrigerator 300*n* of this modified example as well as the twelfth modified example of the third embodiment, it is possible to easily perform the maintenance operations where the valve unit 120*n* is frequently separated from the compressor 10 and the expander 40*d* so that the wear dust in the vicinities of the first supply side valve 21, the first suction side valve 22, the second supply side valve 21*a*, and the second suction side valve 22*a* are removed.

In addition, in the pulse tube refrigerator 300*n* of this modified example, the first buffer 60 is mounted in the valve unit 120*n* and unified. Accordingly, it is possible to reduce the size and height of the expander 40*d*. Hence, it is possible to reduce the area where the pulse tube refrigerator 300*n* is located.

Thus, according to the pulse tube refrigerator 300*n*, it is possible to easily perform the maintenance operations where the wear dust is removed and the pulse tube refrigerator can be miniaturized.

(Fifteenth Modified Example of the Third Embodiment)

Next, a pulse tube refrigerator of a fifteenth modified example of the third embodiment of the present invention is discussed with reference to FIG. 26.

Figure 26:
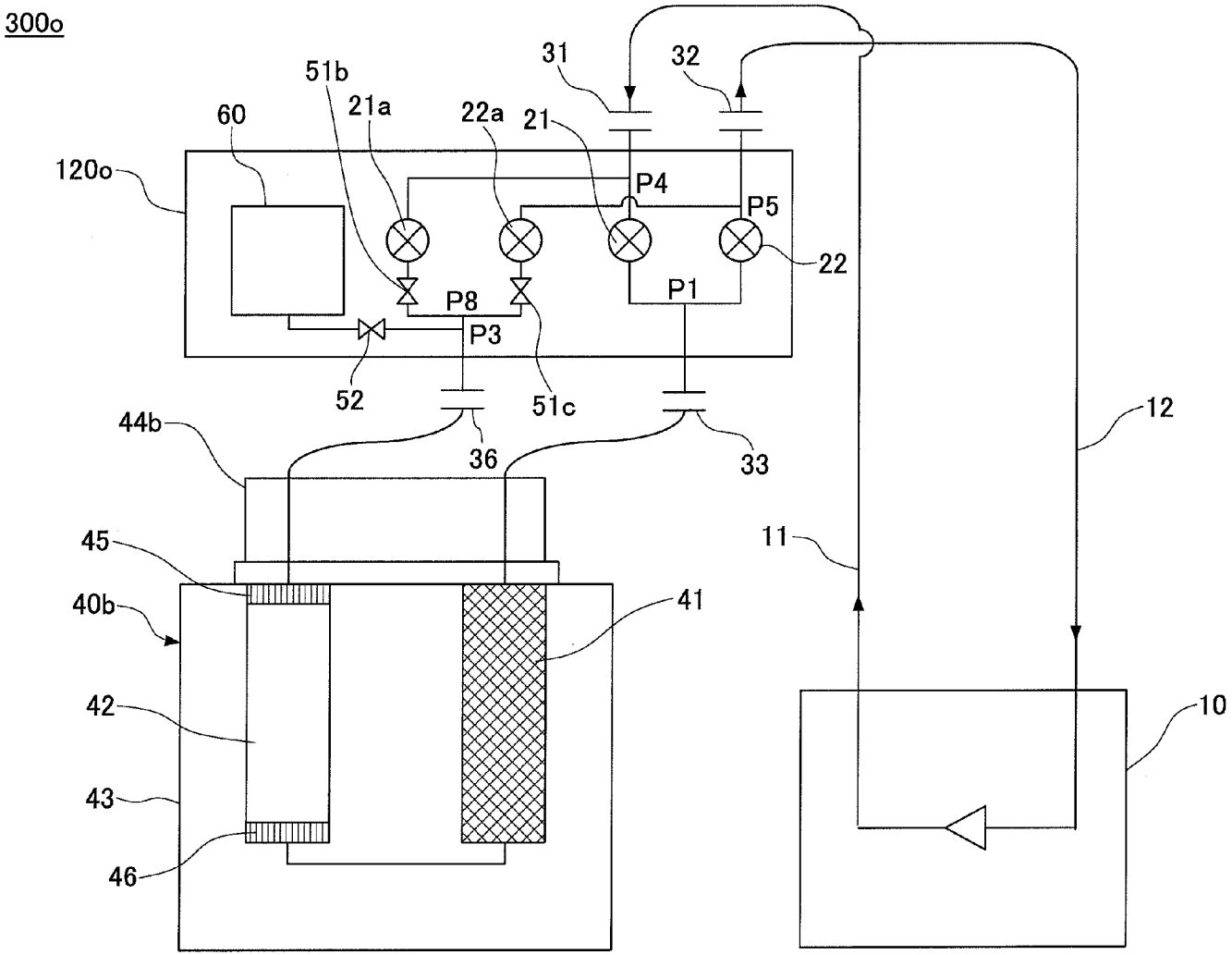
FIG. 26 is a schematic view of a structure of a pulse tube refrigerator of a fifteenth modified example of the third embodiment of the present invention.

FIG. 26 is a schematic view of a structure of a pulse tube refrigerator of the fifteenth modified example of the third embodiment of the present invention. In FIG. 26, parts that are the same as the parts shown in FIG. 1 through FIG. 25 are given the same reference numerals, and explanation thereof is omitted.

The pulse tube refrigerator of this modified example is different from the pulse tube refrigerator of the third modified example of the third embodiment in that the pulse tube refrigerator of this modified example does not include the first filter and the second filter.

In the third modified example of the third embodiment, the first filter and the second filter are provided in the pulse tube refrigerator. On the other hand, as shown in FIG. 26, the pulse tube refrigerator 300*o* of this modified example does not include the first filter and the second filter.

As shown in FIG. 26, the structure of the pulse tube refrigerator 300*o* of this modified example is the same as that of the third modified example of the third embodiment except for the structure of the valve unit 120*o*.

The valve unit 120*o* of this modified example unlike the third modified example of the third embodiment does not include the first filter and the second filter. Therefore, the first supply side valve 21, the first suction side valve 22, the second supply side valve 21*a*, and the second suction side valve 22*a* mounted in the valve unit 120*o* are connected to the expander 40*b* in a state where the first supply side valve 21, the first suction side valve 22, the second supply side valve 21*a*, and the second suction side valve 22*a* can be separated from the expander 40*b* by the third self seal joint 33 and the sixth self seal joint 36.

In the pulse tube refrigerator 300*o* of this modified example as well as the twelfth modified example of the third embodiment, it is possible to easily perform the maintenance operations where the valve unit 120*o* is frequently separated from the compressor 10 and the expander 40*b* so that the wear dust in the vicinities of the first supply side valve 21, the first suction side valve 22, the second supply side valve 21*a*, and the second suction side valve 22*a* are removed.

In addition, in the pulse tube refrigerator 300*o* of this modified example, the first buffer 60 is mounted in the valve unit 120*o* and unified. Accordingly, it is possible to reduce the size and height of the expander 40*b*. Hence, it is possible to reduce the area where the pulse tube refrigerator 300*o* is located.

Thus, according to the pulse tube refrigerator 300*o*, it is possible to easily perform the maintenance operations where the wear dust is removed and the pulse tube refrigerator can be miniaturized.

(Sixteenth Modified Example of the Third Embodiment)

Next, a pulse tube refrigerator of a sixteenth modified example of the third embodiment of the present invention is discussed with reference to FIG. 27.

Figure 27:
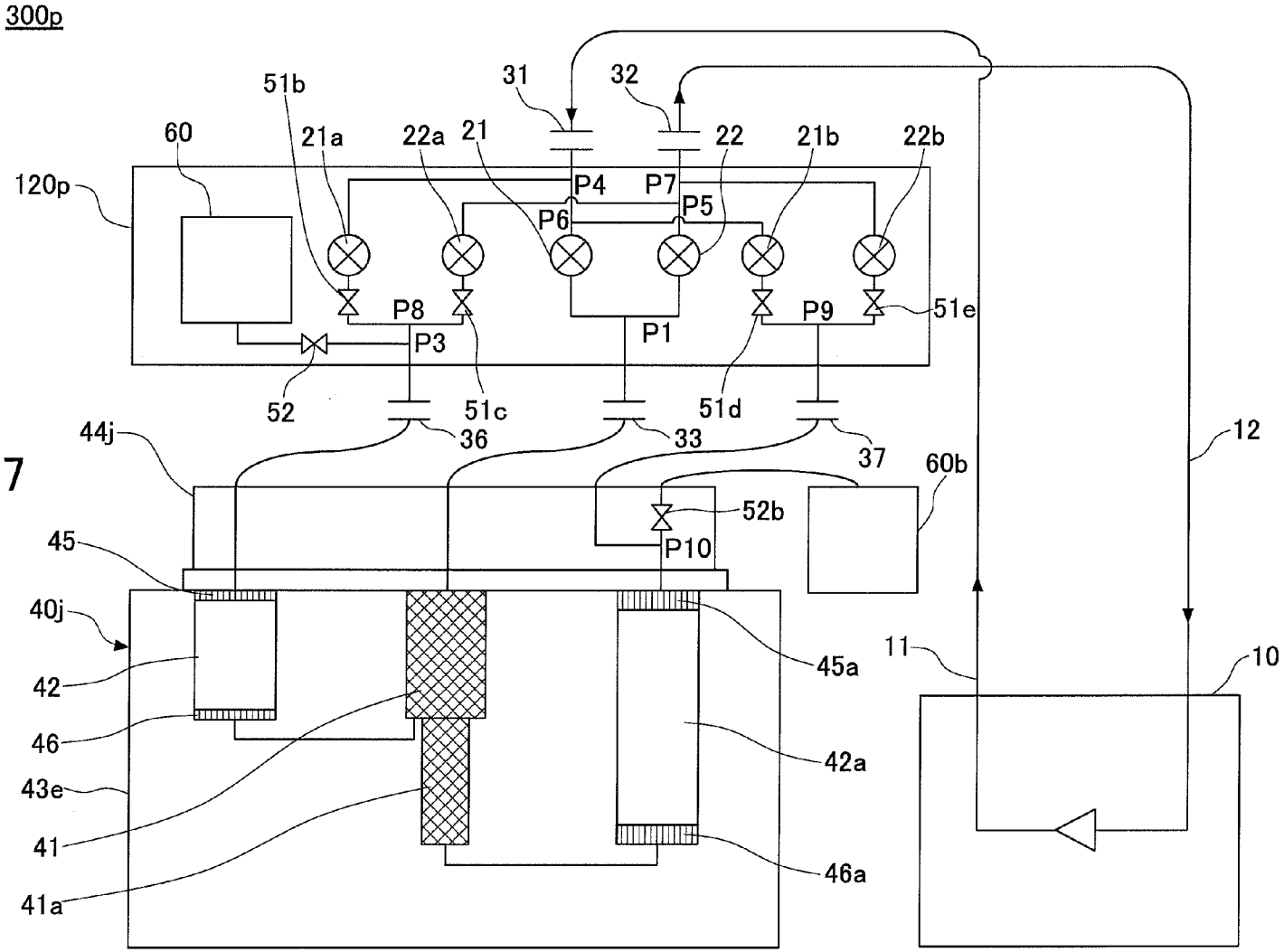
FIG. 27 is a schematic view of a structure of a pulse tube refrigerator of a sixteenth modified example of the third embodiment of the present invention.

FIG. 27 is a schematic view of a structure of a pulse tube refrigerator of the sixteenth modified example of the third embodiment of the present invention. In FIG. 27, parts that are the same as the parts shown in FIG. 1 through FIG. 26 are given the same reference numerals, and explanation thereof is omitted.

The pulse tube refrigerator of this modified example is different from the pulse tube refrigerator of the fourth modified example of the third embodiment in that the pulse tube refrigerator of this modified example does not include the first filter, the second filter, and the third filter.

In the fourth modified example of the third embodiment, the first filter, the second filter, and the third filter are provided in the pulse tube refrigerator. On the other hand, as shown in FIG. 27, the pulse tube refrigerator 300*p* of this modified example does not include the first filter, the second filter, and the third filter.

As shown in FIG. 27, the structure of the pulse tube refrigerator 300*p* of this modified example is the same as that of the fourth modified example of the third embodiment except for the structure of the valve unit 120*p*.

The valve unit 120*p* of this modified example unlike the fourth modified example of the third embodiment does not include the first filter, the second filter, and the third filter. Therefore, the first supply side valve 21, the first suction side valve 22, the second supply side valve 21*a*, and the second suction side valve 22*a* mounted in the valve unit 120*p* are connected to the expander 40*j* in a state where the first supply side valve 21, the first suction side valve 22, the second supply side valve 21*a*, and the second suction side valve 22*a* can be separated from the expander 40*j* by the third self seal joint 33, the sixth self seal joint 36, and the seventh self seal joint 37.

In the pulse tube refrigerator 300*p* of this modified example as well as the twelfth modified example of the third embodiment, it is possible to easily perform the maintenance operations where the valve unit 120*p* is frequently separated from the compressor 10 and the expander 40*j* so that the wear dust in the vicinities of the first supply side valve 21, the first suction side valve 22, the second supply side valve 21*a*, and the second suction side valve 22*a* are removed.

In addition, in the pulse tube refrigerator 300*p* of this modified example, the first buffer 60 is mounted in the valve unit 120*p* and unified. Accordingly, it is possible to reduce the size and height of the expander 40*j*. Hence, it is possible to reduce the area where the pulse tube refrigerator 300*p* is located.

Thus, according to the pulse tube refrigerator 300*p*, it is possible to easily perform the maintenance operations where the wear dust are removed and the pulse tube refrigerator can be miniaturized.

(Seventeenth Modified Example of the Third Embodiment)

Next, a pulse tube refrigerator of a seventeenth modified example of the third embodiment of the present invention is discussed with reference to FIG. 28.

Figure 28:
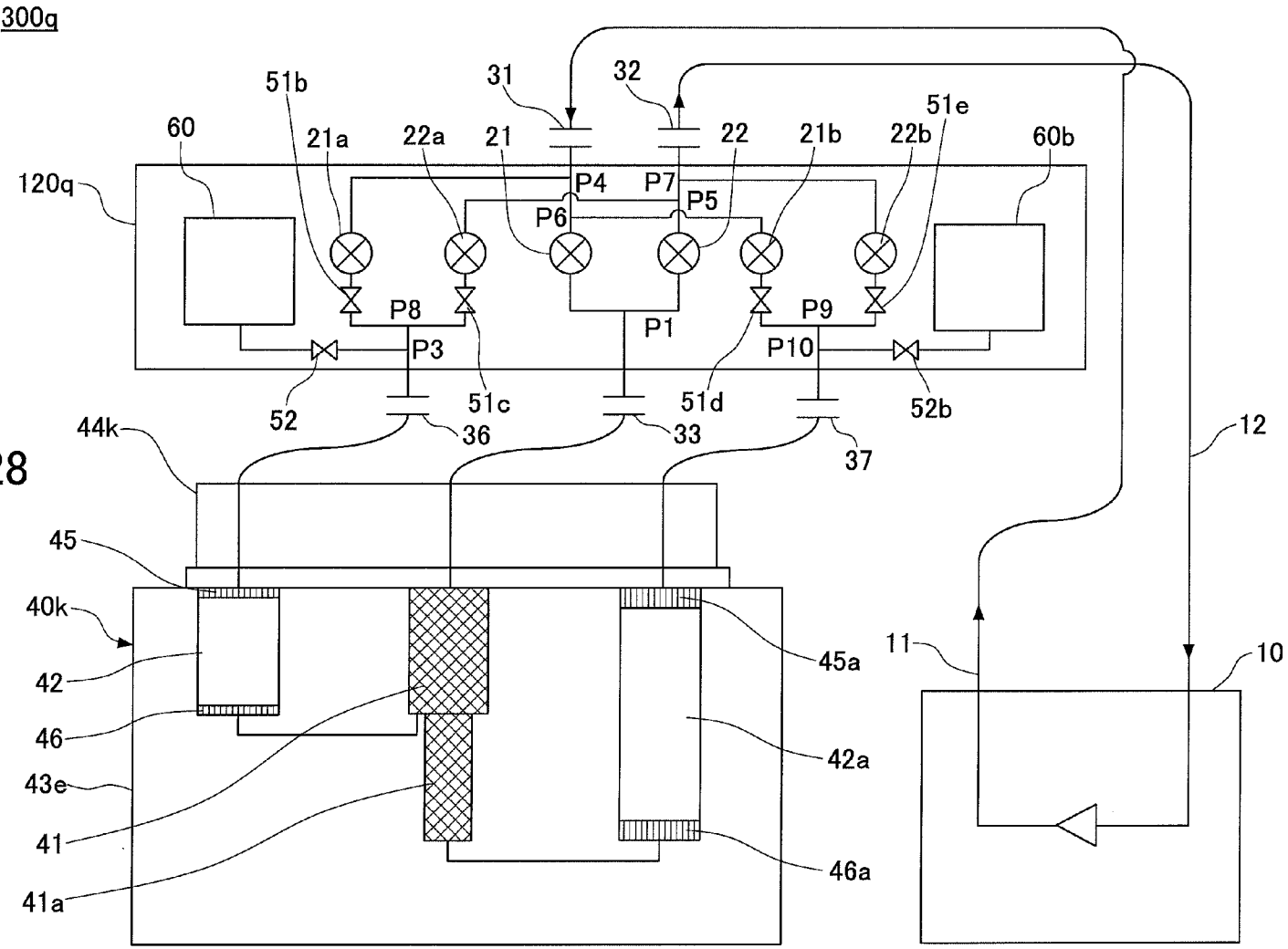
FIG. 28 is a schematic view of a structure of a pulse tube refrigerator of a seventeenth modified example of the third embodiment of the present invention.

FIG. 28 is a schematic view of a structure of a pulse tube refrigerator of the seventeenth modified example of the third embodiment of the present invention. In FIG. 28, parts that are the same as the parts shown in FIG. 1 through FIG. 27 are given the same reference numerals, and explanation thereof is omitted.

The pulse tube refrigerator of this modified example is different from the pulse tube refrigerator of the fifth modified example of the third embodiment in that the pulse tube refrigerator of this modified example does not include the first filter, the second filter, and the third filter.

In the fifth modified example of the third embodiment, the first filter, the second filter, and the third filter are provided in the pulse tube refrigerator. On the other hand, as shown in FIG. 28, the pulse tube refrigerator 300*q* of this modified example does not include the first filter, the second filter, and the third filter.

As shown in FIG. 28, the structure of the pulse tube refrigerator 300*q* of this modified example is the same as that of the fifth modified example of the third embodiment except for the structure of the valve unit 120*q*.

The valve unit 120*q* of this modified example unlike the fifth modified example of the third embodiment does not include the first filter, the second filter, and the third filter. Therefore, the first supply side valve 21, the first suction side valve 22, the second supply side valve 21*a*, and the second suction side valve 22*a* mounted in the valve unit 120*q* are connected to the expander 40*k* in a state where the first supply side valve 21, the first suction side valve 22, the second supply side valve 21*a*, and the second suction side valve 22*a* can be separated from the expander 40*k* by the third self seal joint 33, the sixth self seal joint 36, and the seventh self seal joint 37, respectively.

In the pulse tube refrigerator 300*q* of this modified example as well as the twelfth modified example of the third embodiment, it is possible to easily perform the maintenance operations where the valve unit 120*q* is frequently separated from the compressor 10 and the expander 40*k* so that the wear dust in the vicinities of the first supply side valve 21, the first suction side valve 22, the second supply side valve 21*a*, and the second suction side valve 22*a* are removed.

In addition, in the pulse tube refrigerator 300*q* of this modified example, the first buffer 60 is mounted in the valve unit 120*q* and unified. Accordingly, it is possible to reduce the size and height of the expander 40*k*. Hence, it is possible to reduce the area where the pulse tube refrigerator 300*q* is located.

Thus, according to the pulse tube refrigerator 300*q*, it is possible to easily perform the maintenance operations where the wear dust are removed and the pulse tube refrigerator can be miniaturized.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that the various changes, substitutions, and alterations could be made hereto without departing from the spirit and scope of the invention.

What is claimed is:

1. A pulse tube refrigerator, comprising: a first pulse tube configured to perform adiabatic expansion of a coolant gas; a first regenerator connected to the first pulse tube, the first regenerator being configured to store cooling generated at the first pulse tube based on the adiabatic expansion of the coolant gas; a compressor configured to compress the coolant gas; a first supply side valve configured to put in communication or block off communication between a supply side of the compressor and a high temperature end of the first regenerator; a first suction side valve connected to the high temperature end of the first regenerator via a first joint point, the first joint point being an intermediate point between the supply side of the first supply side valve and the high temperature end of the first regenerator, the first suction side valve being configured to put in communication or block off communication between the high temperature end of the first regenerator and a suction side of the compressor; a first self seal joint provided between the supply side of the compressor and a suction side of the first supply side valve; a second self seal joint provided between a supply side of the first suction side valve and the suction side of the compressor; a third self seal joint provided between the first joint point and the high temperature end of the first regenerator; a first buffer connected with the high temperature end of the first pulse tube; a valve unit where the first supply side valve and the first suction side valve are mounted; a second pulse tube configured to perform adiabatic expansion of coolant gas; a second regenerator provided between a low temperature end of the second pulse tube and a low temperature end of the first regenerator; a third supply side valve connected to the supply side of the compressor via a sixth joint point, the sixth joint point being an intermediate point between the suction side of the first supply side valve and the first self seal joint, the third supply side valve being configured to put in communication or block off communication between the high temperature end of the second pulse tube and a supply side of the compressor; a third suction side valve connected to the suction side of the compressor via a seventh joint point, the seventh joint point being an intermediate point between the supply side of the first suction side valve and the second self seal 30 joint, the third suction side valve being configured to put in communication or block off communication between the high temperature end of the second pulse tube and the supply side of the compressor; and a seventh self seal joint provided between the supply side of the third supply side valve and the high temperature end of the second pulse tube; wherein the first buffer is mounted in the valve unit, wherein the third supply side valve and the third suction side valve are mounted in the valve unit; wherein a second buffer connected with the high temperature end of the second pulse tube via a tenth joint point being an intermediate point between the supply side of the third supply side valve and the seventh self seal joint; and wherein the second buffer is mounted in the valve unit.

2. The pulse tube refrigerator as claimed in claim 1, further comprising:

a second supply side valve connected to the supply side of the compressor via a fourth joint point, the fourth joint point being an intermediate point between the suction side of the first supply side valve and the first self seal joint, the second supply side valve being configured to put in communication or block off communication between the high temperature end of the first pulse tube and a supply side of the compressor; and a sixth self seal joint provided between the supply side of the second supply side valve and the high temperature end of the first pulse tube;

wherein the second supply side valve and the second suction side valve are mounted in the valve unit.

3. The pulse tube refrigerator as claimed in claim 1, wherein the first buffer is provided so as to be connected with the high temperature end of the first pulse tube via a third joint point being an intermediate point between the supply side of the second supply side valve and the sixth self seal joint.

4. A pulse tube refrigerator, comprising: a first pulse tube configured to perform adiabatic expansion of a coolant gas; a second pulse tube configured to perform adiabatic expansion of the coolant gas; a first regenerator connected to the first pulse tube, the first regenerator being configured to store cooling generated at the first pulse tube based on the adiabatic expansion of the coolant gas; a second regenerator connected to the first regenerator and the second pulse tube, the second regenerator being configured to store cooling generated at the second pulse tube based on the adiabatic expansion of the coolant gas; a compressor configured to compress the coolant gas; a first supply side valve configured to put in communication or block off communication between a supply side of the compressor and a high temperature end of the first regenerator; a first suction side valve connected to the high temperature end of the first regenerator via a first joint point, the first joint point being an intermediate point between the supply side of the first supply side valve and the high temperature end of the first regenerator, the first suction side valve being configured to put in communication or block off communication between the high temperature end of the first regenerator and a suction side of the compressor; a first self seal joint provided between the supply side of the compressor and a suction side of the first supply side valve; a second self seal joint provided between a supply side of the first suction side valve and the suction side of the compressor; a third self seal joint provided between the first joint point and the high temperature end of the first regenerator; a first buffer connected with a high temperature end of the first pulse tube; a second buffer provided connected only with a high temperature end of the second pulse tube; a sixth self seal joint provided between the high temperature end of the second pulse tube and the second buffer; and a valve unit where the first supply side valve and the first suction side valve are mounted; wherein the first buffer and the second buffer are mounted in the valve unit.

* * * * *